US007825877B2

(12) United States Patent
Yoshida

(10) Patent No.: US 7,825,877 B2
(45) Date of Patent: Nov. 2, 2010

(54) DISPLAY DEVICE

(75) Inventor: Yasunori Yoshida, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 1030 days.

(21) Appl. No.: 11/545,536

(22) Filed: Oct. 11, 2006

(65) Prior Publication Data

US 2007/0085778 A1 Apr. 19, 2007

(30) Foreign Application Priority Data

Oct. 18, 2005 (JP) ..... 2005-303767

(51) Int. Cl.
*G09G 3/20* (2006.01)

(52) U.S. Cl. ..... 345/75.2

(58) Field of Classification Search ..... 345/75.2, 345/82, 74; 315/169.1, 169.4; 313/306–307, 313/310, 506, 509, 581, 584, 586
See application file for complete search history.

(56) References Cited

U.S. PATENT DOCUMENTS 5,387,844 A * 2/1995 Browning ..... 315/169.3
5,404,074 A * 4/1995 Watanabe et al. ..... 313/495
5,638,086 A * 6/1997 Lee et al. ..... 345/75.2
6,118,417 A * 9/2000 Hush ..... 345/204
6,184,874 B1 2/2001 Smith et al.
6,229,506 B1 5/2001 Dawson et al.
6,373,454 B1 4/2002 Knapp et al.
6,559,819 B1 * 5/2003 Rumbaugh et al. ..... 345/75.2
7,064,493 B2 * 6/2006 Konishi ..... 315/169.1
7,088,048 B2 8/2006 Martin et al.
7,548,222 B2 * 6/2009 Le Roy et al. ..... 345/82
2002/0030646 A1 * 3/2002 Song et al. ..... 345/75.2
2003/0148565 A1 * 8/2003 Yamanaka ..... 438/200

(Continued)

FOREIGN PATENT DOCUMENTS

EP 1 473 755 A2 11/2004

(Continued)

OTHER PUBLICATIONS

M. Nagao, et al., HFC Coated SI-FEA With a Built-In Poly-Si TFT, IDW 04, Proceedings of the 11$^{th}$ International DisplayWorkshops, 2004, pp. 1225-1228.

(Continued)

*Primary Examiner*—Alexander Eisen
*Assistant Examiner*—Patrick Marinelli
(74) *Attorney, Agent, or Firm*—Nixon Peabody LLP; Jeffrey L. Costellia

(57) ABSTRACT

To provide a highly reliable display device whose electrical element is applied with a low voltage. The display device is an active matrix FED display device whose pixel has an individual extraction gate electrode, an emitter array, a driving transistor which is connected to the emitter array in series, a potential control circuit which controls the potential of the extraction gate electrode, and a circuit which includes a switching element and a voltage holding element. By varying the potential of the extraction gate electrode in accordance with Vgs of the driving transistor, the active matrix driving method is performed by connecting a driving transistor to the emitter array in series and voltage which is applied to the driving transistor can be reduced.

32 Claims, 38 Drawing Sheets

U.S. PATENT DOCUMENTS

| | | | | |
|---|---|---|---|---|
| 2004/0027050 | A1* | 2/2004 | Rasmussen | 313/495 |
| 2004/0070557 | A1 | 4/2004 | Asano et al. | |
| 2004/0222391 | A1* | 11/2004 | Martin et al. | 250/493.1 |
| 2005/0056846 | A1 | 3/2005 | Huang et al. | |
| 2006/0044505 | A1* | 3/2006 | Nakazawa | 349/150 |

FOREIGN PATENT DOCUMENTS

| | | |
|---|---|---|
| JP | 11-102637 | 4/1999 |
| JP | 2002-514320 | 5/2002 |
| JP | 2002-175764 | 6/2002 |
| JP | 2002-517806 | 6/2002 |
| JP | 2004-246204 | 9/2004 |
| WO | WO 98/48403 | 10/1998 |
| WO | WO 99/65011 | 12/1999 |

OTHER PUBLICATIONS

Guo, et al., P-46, Active-Matrix Addressing for Carbon Nanotube Field Emission Displays, EuroDisplay 2005, The 25th International Display Research Conference, 2005, pp. 366-368.

Search Report (Application No.06021077.0; EP09104) Dated Sep. 18, 2009.

* cited by examiner

PRIOR ART

PRIOR ART

PRIOR ART

PRIOR ART

PRIOR ART

PRIOR ART

DISPLAY DEVICE

BACKGROUND OF THE INVENTION

1. Field of the Invention

The present invention relates to a display device which includes an electron-emissive element. Specifically, the invention relates to a display device which includes a transistor in each pixel and a field electron-emissive element for controlling a gray scale by using the transistor.

2. Description of the Related Art

In recent years, a flat panel (flat panel type) display device has been actively developed as an image display device which replaces the mainstream Cathode Ray Tube (CRT). As such a flat panel display device, a display device including electron-emissive elements (also described as field electron-emissive elements) which emit light by electron-beam excitation utilizing electrons emitted by the electric field effect, namely, an electron emission display (FED: Field Emission Display) device has been proposed. An electron emission display device has been attracting attention because of its high display performance of a moving image and low power consumption, and there is an advantage that the contrast of a displayed image is high since it is a display device using self-luminous light-emitting elements unlike a display device using liquid crystals.

FED has a structure where a first substrate having a cathode electrode and a second substrate having an anode electrode provided with a phosphor layer are disposed to be opposed to each other, and the first substrate and the second substrate are sealed with a sealing material. An electron emitted from the cathode electrode moves through space between the first substrate and the second substrate to excite the phosphor layer provided to the anode electrode, so that an image can be displayed by light emission. Both the first substrate and the second substrate are sealed with a sealing material, and the space is kept at a high vacuum.

FED can be classified into a diode-type FED, a triode-type FED, and a tetrode-type FED according to the configuration of electrodes. A diode-type FED has a structure where striped patterned cathode electrodes are formed over a surface of a first electrode while striped patterned anode electrodes are formed over a surface of a second electrode so as to be crossed with the cathode electrode. The distance between the cathode electrode and the anode electrode is several μm to several mm. An electron is emitted from between the cathode electrode and the anode electrode by applying a voltage thereto. A voltage to be applied may be any level of voltage as log as it is less than 10 kV. The emitted electron reaches to the phosphor layer provided to the anode electrode to excite the phosphor layer, so that an image can be displayed by light emission.

A triode-type FED has a structure where an insulating film is formed over a first substrate which is formed with cathode electrodes, extraction gate electrodes are formed to be crossed with the cathode electrodes with the insulating film interposed therebetween. When the cathode electrodes and the extraction gate electrodes are seen from above, they are arranged in stripes or in matrix; and in the insulating film which is in an intersection region of each cathode electrode and each extraction gate electrode, an electron-emissive element which is an electron source is formed. By applying a voltage to the cathode electrode and the extraction gate electrode to apply a high electric field to the electron-emissive element, an electron can be emitted from the electron-emissive element. This electron is pulled toward the anode electrode of the second substrate to which a voltage higher than the voltage of the extraction gate electrode is applied, thereby exciting the phosphor layer provided to the anode electrode, so that an image can be displayed by light emission.

A tetrode-type FED has a structure where a placoid or thin film convergent electrode is formed between an extraction gate electrode and an anode electrode of a triode type-FED, and the convergent electrode has an opening in each pixel. By converging electrons emitted from a light-emissive element in each pixel by such a convergent electrode, the phosphor layer provided to the anode electrode can be exicited, and thus, an image can be displayed by light emission.

As electron-emissive elements, there are a Spindt-type electron-emissive element, a surface-conduction electron-emissive element, an edge-type electron-emissive element, a MIM (Metal-Insulator-Metal) element, a carbon nanotube electron-emissive element, and the like.

A Spindt-type electron-emissive element is an electron-emissive element including a conical electron-emissive element. The Spindt-type electron-emissive element has advantages compared to other electron-emissive elements in that (1) an electron extraction efficiency is high since it has a structure where an electron-emissive element is disposed in a central region of a gate electrode with the largest concentration of the electric field, (2) in-plane uniformity of a current of an electron-emissive element is high since patterns having the arrangement of electron-emissive elements can be accurately drawn to set suitable arrangement for distribution of the electric field, (3) an emission direction of electrons is regulated well, and the like.

As conventional Spindt-type electron-emissive elements, there are a conical electron-emissive element formed by depositing metal (see Reference 1: Japanese Published Patent Application No. 2002-175764), an element formed to have a conical electron-emissive portion using a MOSFET (see Reference 2: Japanese Published Patent Application No. Hei. 11-102637), and the like.

Here, description is made of electrical characteristics of electron-emissive elements with reference to FIGS. 14 and 15. A structure described in FIG. 14 shows an exemplary structure of a light-emitting element in one pixel which uses the passive matrix driving. A structure described in FIG. 14 includes an emitter array where a plurality of electron-emissive elements (hereinafter, also described as emitters) 10 are arranged, an extraction gate electrode 11 for applying an electric field to the emitter array, an insulating film 12 for electrically insulating the extraction gate electrode 11 from the emitter array, an anode electrode 15 provided away from the emitter array with a distance of several μm to several mm, a light-emitting material (also described as a fluorescent material) 16, and a cathode electrode 17.

Note that in this specification, an electrical element having a function of light emission is described as a light-emitting element. That is, an electrical element including the emitter array, the light-emitting material 16, and the anode electrode 15 corresponds to a light-emitting element. Note that the light-emitting element may include the extraction gate electrode 11 as shown in FIG. 14. In addition, the emitter array may be electrically connected to the cathode electrode 17, or the emitter array may be formed over the cathode electrode 17. Further, a potential of the extraction gate electrode 11 is denoted by Veg; a potential of the anode electrode 15 is denoted by Va; and a potential of the cathode electrode 17 is denoted by Vc.

In this specification, connection means electrical connection as long as there is no particular description. On the other hand, separation means a state in which an object is not connected to another object and electrically insulated from another object.

FIG. 15 shows electrical characteristics of the light-emitting element with the structure in FIG. 14 which is in a biased state. FIG. 15 shows a current-voltage characteristic of the light-emitting element in the case of fixing potentials of the cathode electrode 17 and the anode electrode 15 to swing a voltage between the extraction gate electrode 11 and the cathode electrode 17 (Veg−Vc). As shown in FIG. 15, the current-voltage characteristic of the light-emitting element is such that current hardly flows until (Veg−Vc) reaches the threshold voltage of the emitter array (hereinafter, also described as Veth); however, a current flows exponentially and rapidly when (Veg−Vc) becomes higher than Veth. Luminance of the light-emitting element is determined in accordance with the amount of this current, Va which is a potential of the anode electrode 15, Vc which is a potential of the cathode electrode 17, and the characteristics of the light-emitting material 16. For example, if the characteristics of the light-emitting material 16 are the same, and Va which is the potential of the anode electrode 15 and Vc which is the potential of the cathode electrode 17 are the same, luminance of the light-emitting element is dependent on the amount of current flowing to the emitter array. Note that an electric filed of Va which is the potential of the anode electrode 15 mainly works to accelerate electrons emitted from electron-emissive elements, so that it hardly contributes to the current-voltage characteristic of the light-emitting element. That is, a current flowing to the light-emitting element is substantially determined by a voltage between the extraction gate electrode 11 and the cathode electrode 17 (Veg−Vc).

Here, description is made of a driving method of a display device including a light-emitting element. The driving methods of the display device are classified roughly into an active matrix driving method and a passive matrix driving method. A display device using the passive matrix driving can be manufactured at low cost since it has a simple structure where the light-emitting elements are interposed between a matrix of electrodes; however, the passive matrix driving is not always suitable for a large-area or high-definition display device since other pixels cannot be driven while a certain pixel is driven.

In FIG. 14, the emitter array is driven by the extraction gate electrode 11 and the cathode electrode 17 formed in matrix, and a voltage between the extraction gate electrode 11 and the cathode electrode 17 (Veg−Vc) is controlled by applying appropriate potentials to the respective electrodes to control the luminance of the light-emitting element. FIG. 18 shows an example where light-emitting elements driven by the passive matrix driving method are arranged in matrix.

On the other hand, the manufacturing cost of a display device using the active matrix driving method is often higher than a display device using the passive matrix driving since active elements and means for holding luminance information are provided in each pixel; however, even when a certain pixel is driven, other pixels can emit light while at the same time holding luminance information. FIG. 19A shows an example where light-emitting elements driven by the active matrix driving method are arranged in matrix. Although FIG. 19A shows only four light-emitting elements, more than four light-emitting elements are often provided. A display device using an active matrix driving method includes a plurality of data lines 28, a plurality of scan lines 29 which are arranged to be at right angles or about at right angles to the plurality of data lines 28, a plurality of pixel circuits 24 which are arranged in a region where the data lines 28 and the scan lines 29 are crossed with each other, and a plurality of light-emitting elements. The pixel circuits 24 includes a driving transistor Tr1 which is an active element connected to an emitter array in series, a gate electrode potential control circuit 23 of a driving transistor, and a cathode electrode 27. Note that the cathode electrode 27 is an electrode for controlling a potential of one of either a source electrode or a drain electrode of the driving transistor Tr1, and the cathode electrode 27 may be shared with other wires such as the scan lines 29.

FIG. 19B shows an example of the gate electrode potential control circuit 23 of a driving transistor. A transistor 30 is conductive (turned on) when a High signal is input to a terminal S to transmit a potential of the data line 28 connected to a terminal D to a capacitor 31 and a terminal Q (this operation is also described as "data writing"). After that, the transistor 30 is not conductive (turned off) when a Low signal is input to the terminal S not to transmit the potentials of the data lines 28 connected to the terminal D to the capacitor 31 and the terminal Q; therefore, a potential of the terminal Q in the period when the transistor 30 has been on is held in the capacitor 31 until the transistor 30 is turned on again. In accordance with the potentials of the capacitor 31 and the terminal D at this time, Vgs of the driving transistor Tr1 is determined so that a drain current corresponding to Vgs keeps flowing through the driving transistor Tr1. In this manner, the active matrix driving method is realized.

As a conventional electron-emissive display device which uses an active matrix driving method, a display device disclosed in non-patent document 1 (IDW'04 pp. 1225-1228 "HfC coated Si-FEA with a built-in poly-Si TFT") is given, as an example. In non-patent document 1, an example in which HfC is formed over an emitter which is manufactured with amorphous silicon and sputtering treatment is applied to improve current-voltage characteristics of an emitter array is disclosed. In addition, an example where a thin film transistor (hereinafter, also described as TFT) which is manufactured with polysilicon is connected to the emitter array in series to perform the active matrix driving method is also disclosed.

In a display device using the active matrix driving method which uses a current driving-type light-emitting element, specifically an organic EL element which is an element having two terminals, there are techniques related to a compensating method for luminance variation of light-emitting elements due to the characteristic variation of transistors (see Reference 3: Japanese Published Patent Application No. 2004-246204, Reference 4: Japanese Translation of PCT International Application No. 2002-514320, and Reference 5: Japanese Translation of PCT International Application No. 2002-517806).

In this manner, the compensation for the variation of the transistors in the display device using the active matrix driving method which uses an organic EL element which is an element having two terminals has been examined.

As described above, when light-emitting elements of FED are driven by the active matrix driving method, an active element which controls a current flowing to the light-emitting elements is necessary. A transistor or a thin film transistor can be applied to this active element. In the case of employing a transistor as the active element, a structure as shown in FIG. 16 where an emitter 10 of a light-emitting element of FED and one of either a source electrode or a drain electrode of the driving transistor Tr1 are electrically connected to each other; the other of either the source electrode or the drain electrode of the driving transistor Tr1 is electrically connected to a cathode electrode 27; and a current Ids which flows to the driving transistor Tr1 and the light-emitting element are controlled by controlling a voltage which is applied to the gate electrode of the driving transistor Tr1 (hereinafter, also described as Vgs) can be provided. Note that in a conventional display device, when light-emitting elements of FED are driven by an active matrix driving method, the extraction gate electrode 11 is shared by the whole light-emitting elements and fixed at a certain potential Veg. In addition, the potential of the anode electrode 15 is fixed at Va. At this time, a voltage which is applied between the source electrode and the drain electrode of the driving transistor Tr1 is denoted by Vds, while a voltage which is applied between the extraction gate electrode 11 of the light-emitting elements and the emitter 10 is denoted by Vege.

The current Ids which flows into the driving transistor Tr1 and the light-emitting element, and a potential of the emitter 10 in the case of connecting the light-emitting element and the driving transistor Tr1 to each other as shown in FIG. 16 are described with reference to FIGS. 17A and 17B. In FIG. 17A, a point "a" shows an operating point in the case of applying a high level of voltage (Vgs) between the gate electrode and the source electrode of the driving transistor Tr1 to increase the amount of current Ids which flows into the driving transistor Tr1 and the light-emitting element in order to increase the luminance of the light-emitting element; a solid line A shows the current-voltage characteristics of the driving transistor Tr1; and a solid line B shows current-voltage characteristics of the light-emitting element. On the other hand, in FIG. 17B, a point "a" shows an operating point in the case of applying a low level of voltage Vgs between the gate electrode and the source electrode of the driving transistor Tr1 to decrease the amount of current Ids which flows to the driving transistor Tr1 and the light-emitting element to decrease the luminance of the light-emitting element; a solid line A shows the current-voltage characteristics of the driving transistor Tr1; and a solid line B shows the current-voltage characteristics of the light-emitting element.

The source-drain voltage Vds of the driving transistor Tr1 is relatively low when the luminance of the light-emitting element is high as shown in FIG. 17A, while the source-drain voltage Vds of the driving transistor Tr1 is decreased in order to decrease the luminance of the light-emitting element. From FIGS. 17A and 17B, the scope of Vds can be represented by the following formula 1.

$$0 < Vds < Veg - Vc - Veth \quad \text{[formula 1]}$$

Here, by quoting a voltage value disclosed in non-patent document 1, (Veg−Vc) is about 5 V and Veth is about 35 V. That is, a maximum value of Vds can be estimated to be about 20 V from the formula 1.

In this manner, when the light-emitting element of FED is driven by an active matrix driving method, a very high voltage is applied to the driving transistor Tr1 differently from the case of using an organic EL element. This point is one of the problems in the case of driving electric field electron-emissive light-emitting elements using the active matrix driving method. Thus, a pixel circuit of a display device which is driven by the active matrix driving method using the organic EL element cannot be simply employed since a very high voltage is applied to a transistor. In non-patent document 1, in order to make the driving transistor Tr1 endure this high voltage of 20 V, measures such as lengthening a channel length of the driving transistor Tr1, and making the gate electrode of the driving transistor Tr1 into a tine shape are taken.

However, even if efforts to increase the withstand voltage of the driving transistor Tr1 are made, the driving transistor Tr1 is easily deteriorated when a high voltage is continuously applied thereto. In addition, when a high voltage is continuously applied to the transistor, the reliability thereof is extremely decreased. This makes the yield of products decrease, so that it is very disadvantageous in cost as well. Accordingly, a voltage which is applied to the transistor is desirably as low as possible.

In addition, for an active matrix display device using a light-emitting element such as an organic EL element, there are techniques related to a compensating method for luminance variation of the light-emitting elements due to the characteristic variation of transistors as shown in Reference 3 to Reference 5. In an electric filed electron-emissive display device using the active matrix method which uses an electron-emissive element, a compensating method for the luminance variation of light-emitting elements due to the characteristic variation of transistors, the variation of the light-emitting elements, characteristic deterioration of the light-emitting elements, or the like becomes important.

SUMMARY OF THE INVENTION

In view of the foregoing problems, it is an object of the invention to provide an active matrix FED which performs the active matrix driving method by connecting a driving transistor Tr1 to an emitter array in series, where a voltage applied to the driving transistor Tr1 is minimized to improve the reliability and the yield of the FED, so that it can be manufactured at low cost. Further, it is another object of the invention to provide an active matrix FED where luminance variation of light-emitting elements due to the characteristic variation of transistors, characteristic deterioration of the light-emitting elements, or the like is compensated.

In view of above-described objects, the invention provides an active matrix FED display device having a plurality of pixels, each having an individual extraction gate electrode which is not connect to other extraction gate electrodes, an emitter array, a driving transistor Tr1 which is connected to the emitter array in series, a potential control circuit which controls a potential of the extraction gate electrode, and a circuit which includes a switching element and a voltage holding element. By varying the potential of the extraction gate electrode in accordance with Vgs of the driving transistor, the active matrix driving method is performed by connecting the driving transistor to the emitter array in series and a voltage which is applied to the driving transistor can be reduced.

A display device in accordance with one aspect of the invention includes a first electrode provided below an emitter, a second electrode provided around the emitter, a transistor, and a potential control circuit. One of either a source or a drain of the transistor is connected to the first electrode; a first terminal of the potential control circuit is connected to the second electrode; and a second terminal of the potential control circuit is connected to a gate of the transistor.

A display device in accordance with one aspect of the invention includes a first electrode provided below an emitter, a second electrode provided around the emitter, a first transistor, and a potential control circuit. The potential control circuit includes a second transistor and a resistor; one of terminals of the resistor is connected to the second electrode; the other terminal of the resistor is connected to one of either a source or a drain of the second transistor; a gate of the first transistor is connected to a gate of the second transistor; and one of either a source or a drain of the first transistor is connected to the first electrode.

A display device in accordance with one aspect of the invention includes a plurality of pixels each including a pixel circuit and a light-emitting element. The light-emitting element includes an extraction gate electrode, an anode electrode, a fluorescent material; and the pixel circuit includes a potential control circuit and an active element. The extraction gate electrode has a function of applying an electric field to an electron-emissive element; the anode electrode has a function of accelerating an electron emitted from the electron-emissive element; the fluorescent material is formed to be connected directly or indirectly to the anode electrode; the potential control circuit has a function of controlling a potential of the extraction gate electrode; and the active element is connected to the light-emitting element in series to control a current flowing to the light-emitting element.

A display device in accordance with one aspect of the invention includes a plurality of pixels each including a pixel circuit and a light-emitting element. The light-emitting element includes an extraction gate electrode, an anode electrode, a fluorescent material; and the pixel circuit includes a potential control circuit and an active element. The extraction gate electrode has a function of applying an electric field to an electron-emissive element; the anode electrode has a function of accelerating an electron emitted from the electron-emissive element; the fluorescent material is formed to be connected directly or indirectly to the anode electrode; the potential control circuit has a function of controlling a potential of the extraction gate electrode in accordance with a potential of a gate of the active element; and the active element is connected to the light-emitting element in series to control a current flowing to the light-emitting element.

In the invention, the pixel circuit can further include a switching element for controlling supply of a signal to the gate electrode of the active element.

In the invention, the pixel circuit can further include a circuit including a switching element and a voltage holding element.

A display device of the invention includes a cathode electrode which is electrically connected to the pixel circuit; and at least the active element is electrically connected between the cathode electrode and the electron-emissive element.

In the invention, the active element can be a transistor; the pixel circuit can include a transistor and a capacitor; and the potential control circuit can include a transistor and a resistor.

In the invention, the resistor can include a diode-connected transistor.

In the invention, the electron-emissive element may be any one of a Spindt-type electron-emissive element, a carbon nanotube electron-emissive element, a surface-conduction electron-emissive element, and a hot electron electron-emissive element.

In the invention, all of transistors which are included in the circuit having the switching element and the voltage holding element can have the same polarity.

In the invention, all of transistors which are included in the potential control circuit can have the same polarity.

In the invention, the electron-emissive element is a surface-conduction electron-emissive element, and a plurality of the electron-emissive elements is provided with respect to each pixel electrode.

As described above, by providing an individual extraction gate electrode in each pixel and varying the potential of the extraction gate electrode in accordance with Vgs of the driving transistor Tr1, active matrix drive can be performed with the driving transistor Tr1 connected to an emitter array in series, and with a reduced voltage applied to the driving transistor. Thus, an active matrix FED whose reliability and yield are improved and which can be manufactured at low cost can be provided. In addition, in a display device which is driven by the active matrix driving method using an electric field electron-emissive light-emitting element, a high-quality active matrix FED which has little luminance variation of light-emitting elements due to the characteristic variation of transistors, variation of the light-emitting elements, characteristic deterioration of the light-emitting elements, or the like can be provided. In addition, a display device with few losses of energy and low power consumption can be provided since resistance components of a path through which a current for driving the light-emitting elements flows can be reduced.

BRIEF DESCRIPTION OF THE DRAWINGS

In the accompanying drawings.

DETAILED DESCRIPTION OF THE INVENTION

Figure 1A:
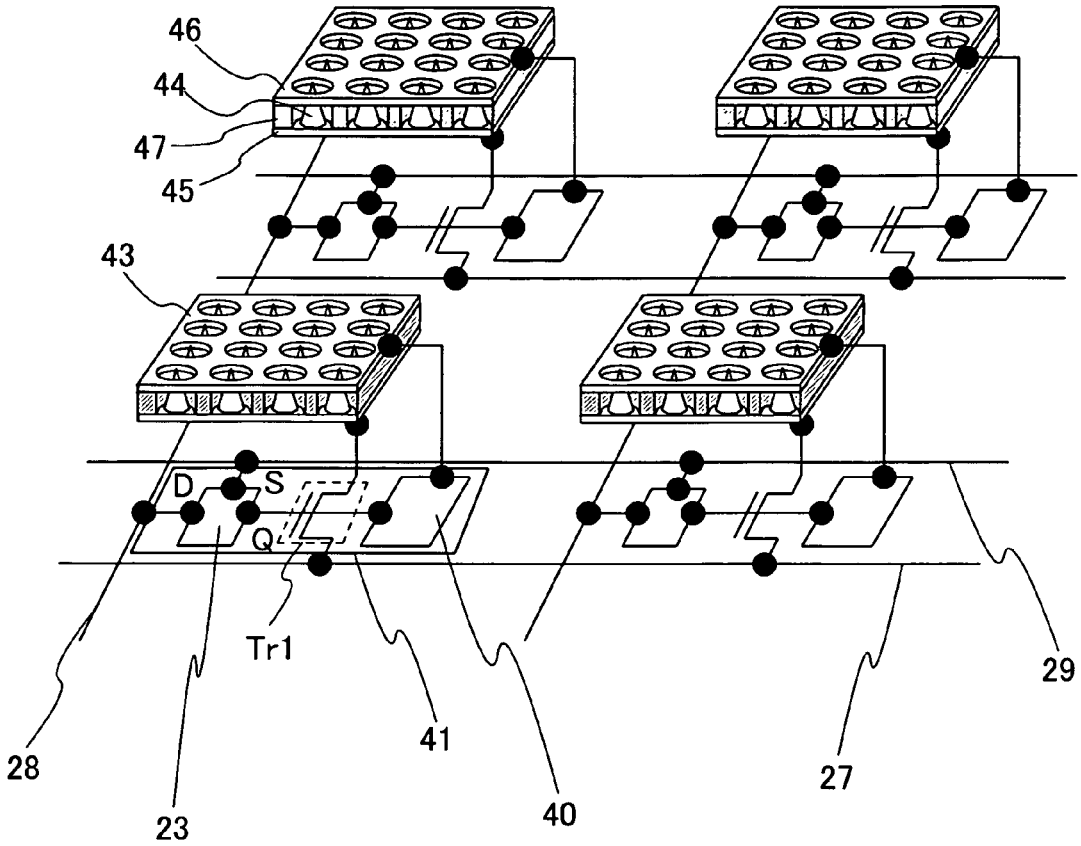
FIGS. 1A and 1B are diagrams showing a pixel circuit and a display region structure of a display device in the invention.

Although the invention will be fully described by way of embodiment modes with reference to the drawings, it is to be understood that various changes and modifications will be apparent to those skilled in the art. Therefore, unless such changes and modifications depart from the scope of the invention, they should be construed as being included therein. Therefore, the invention is not limited to the following description. Note that the same portions or portions having the same function are denoted by the same reference numerals, and repetitive description is omitted.

In the invention, a type of transistor which can be applied is not limited to a certain type. A thin film transistor (TFT) including a non-single crystalline semiconductor film typified by amorphous silicon or polycrystalline silicon, a MOS transistor which is formed by using a semiconductor substrate, an SOI substrate, or the like, a PN junction transistor, a bipolar transistor, a transistor using an organic semiconductor, carbon nanotube, or the like, or other transistors can be applied. In addition, a type of a substrate over which a transistor is formed is not limited to a certain type; therefore, the transistor can be formed over a single crystalline substrate, an SOI substrate, a glass substrate, or the like.

Note that the description "being connected" is synonymous with the description "being electrically connected" in the invention. In the configurations disclosed in this specification, other elements may be interposed between elements having a predetermined connecting relation. That is, other elements which enable an electrical connection (e.g., a switch, a transistor, a capacitor, a resistor, or a diode) may be provided.

Embodiment Mode 1

In this embodiment mode, a display device in accordance with the invention is described with reference to FIGS. 1A and 1B. A display device of the invention includes a plurality of data lines 28, a plurality of scan lines 29 which are provided to be at right angles to the respective data lines, a pixel circuit which is provided in an intersection region (also described as pixel region) of the data lines 28 and the scan lines 29, and light-emitting elements. Each light-emitting element includes an emitter array 43, a fluorescent material, and an anode electrode, and the fluorescent material and the anode electrode are provided on an opposite substrate. The emitter array 43 includes an emitter 44, a cathode electrode which is provided below the emitter, an extraction gate electrode 46 which is provided so as to surround the upper circumference of the emitter, and an insulating material 47 which is provided so as to surround the circumference of the whole emitter to insulate each emitter. A display device of the invention may also include an electrode for converging electrons emitted from the emitter or the like in the circumference of the emitter 44 which is above the extraction gate electrode 46.

A pixel region 41 includes a gate electrode potential control circuit 23 of a driving transistor, a driving transistor Tr1 which controls a current supplied to an electron-emissive element, and a potential control circuit 40 of an extraction gate electrode, which controls the potential of the extraction gate electrode 46 of a light-emitting element in accordance with Vgs of the driving transistor Tr1. The pixel region 41 can be formed over an insulating surface. An insulating surface means a surface of an insulating substrate such as a glass substrate, or a surface of a semiconductor substrate covered with an insulating material. A voltage holding element means a capacitor which includes an insulating material interposed between electric conductors.

In this embodiment mode, description is made by using Spindt-type electro-emissive elements, and a pixel configuration where 4×4=16 Spindt-type electron-emissive elements are provided in one pixel region 41 is described; however, the invention is not limited to this. One pixel region 41 can include one electron-emissive element or it can include a plurality of electron-emissive elements. In the case of providing a plurality of electron-emissive elements in one pixel region 41, the driving transistor Tr1 may be one. Note that in order to obtain a high current density, a plurality of Spindt-type electro-emissive elements are preferably connected to the driving transistor Tr1.

Figure 1B:
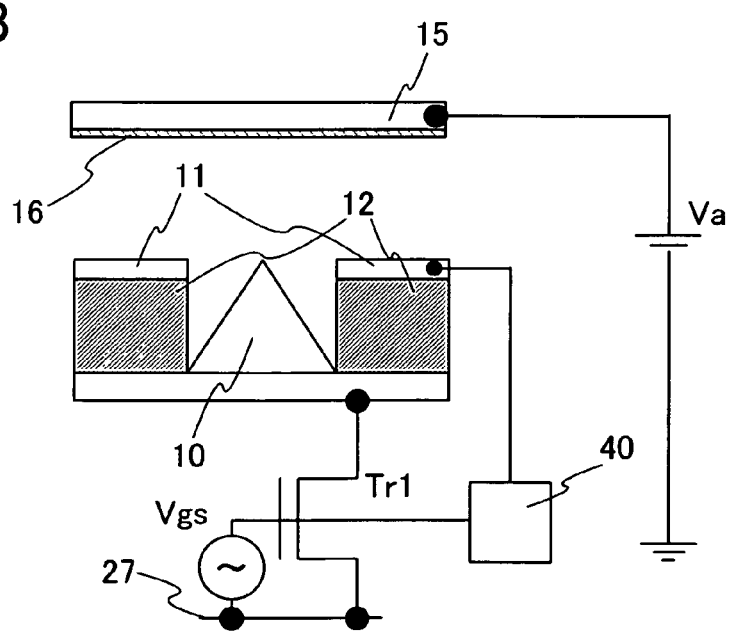

Note that although a pixel configuration where the data lines and the scan lines meet at right angles regularly is described in FIGS. 1A and 1B, the pixel configuration of the invention can be applied to other arrangement of the pixel region 41 by shifting each of the scan lines or each of the data lines, which is so-called a delta arrangement in addition to a stripe arrangement since the invention is related to a circuit configuration of a pixel. In the case of a delta arrangement, the arrangements of a red fluorescent material, a green fluorescent material, and a blue fluorescent material which emit light by utilizing electrons emitted from the electron-emissive elements are also arranged in delta arrangement.

Figure 2A:
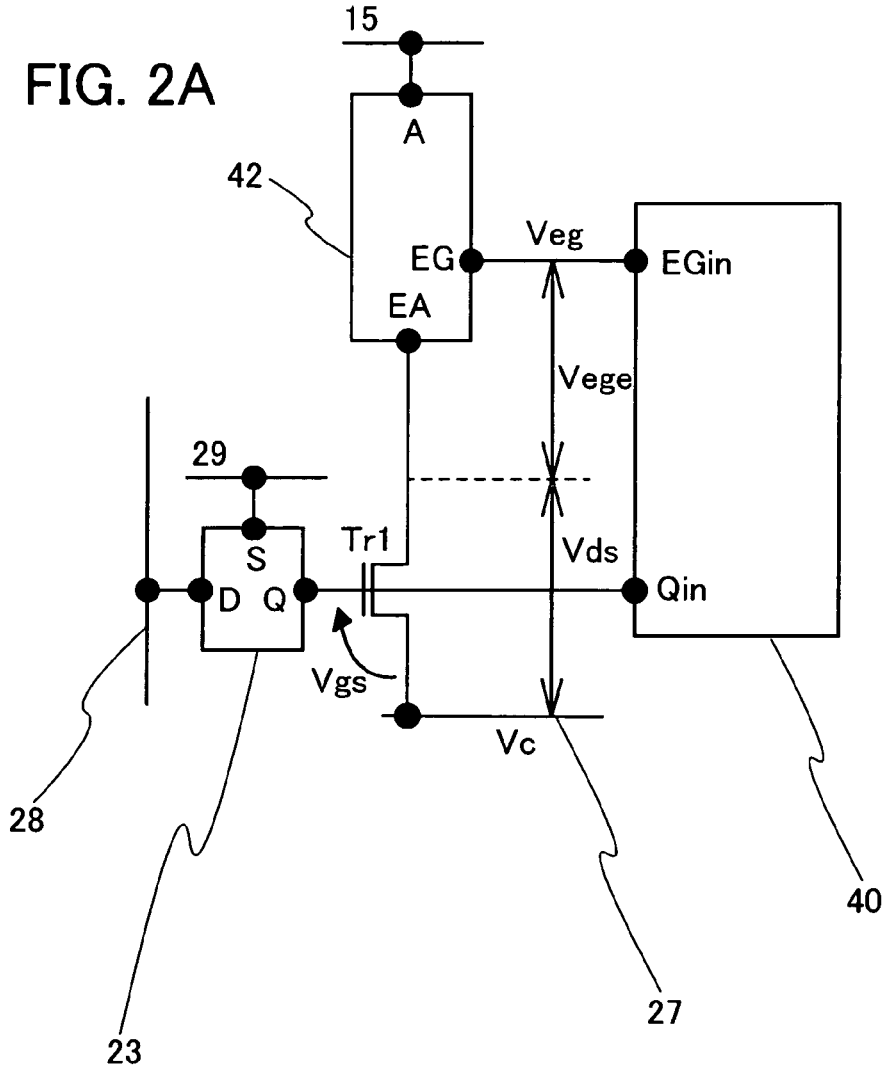
FIGS. 2A and 2B are diagrams showing a pixel circuit and a light-emitting element of a display device in the invention.
Figure 2B:
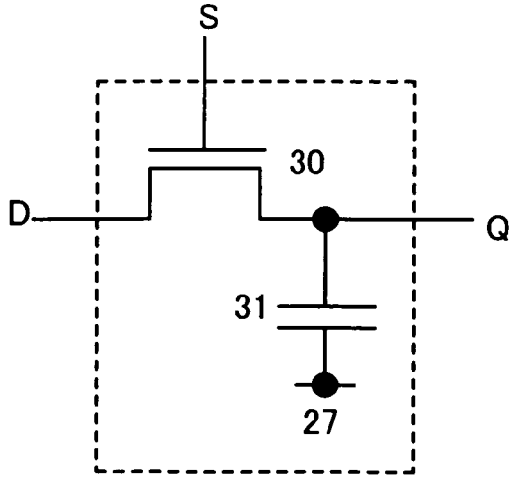

FIGS. 2A and 2B are circuit diagrams showing the connection of the pixel circuit of the display device in the invention described in FIGS. 1A and 1B, and a light-emitting element which is controlled with the pixel circuit. A pixel circuit described in FIG. 2A includes at least one data line 28, one scan line 29, one gate electrode potential control circuit 23 of a driving transistor, one driving transistor Tr1, and one potential control circuit 40 of an extraction gate electrode.

Note that the potential of a cathode 27 is determined so as to make the driving transistor Tr1 perform in the saturation region in a period in which a light-emitting element 42 emits light. Therefore, the cathode 27 may be provided as the power supply line for the driving transistor Tr1 as shown in FIGS. 1A and 1B, or it may be connected to a scan line of the pixel region or a scan line of other regions. In the case of providing the cathode 27 as the power supply line for the driving transistor Tr1 as shown in FIGS. 1A and 1B, electric charges can stably be supplied to the driving transistor Tr1 and the light-emitting element 42. In addition, in the case of connecting the cathode electrode 27 to a scan line of the pixel region or a scan line 29 of other regions, the area dimension of a region other than the cathode electrode 27 in the pixel region can be enlarged, which is advantageous in designing the pixel region. Note that the operating region of the driving transistor Tr1 is not limited to the saturation region; and thus, it may be the linear region.

The gate electrode potential control circuit 23 of a driving transistor is a circuit for controlling Vgs of the driving transistor Tr1, and includes a terminal D connected to the data line 28, a terminal S connected to the scan line 29, and a terminal Q connected to a gate electrode of the driving transistor Tr1. Note that the extraction gate electrode 11 in each pixel region may be electrically insulated from extraction gate electrodes in other pixel regions to be controlled individually in driving light-emitting elements of FED by using the active matrix driving method. In addition, the potential of the cathode electrode 27 is denoted by Vc and the potential of the anode electrode 15 is denoted by Va. The potential Va of the anode electrode 15 may be a fixed potential. At this time, a voltage applied between the source electrode and the drain electrode of the driving transistor Tr1 is denoted by Vds, while a voltage applied to the extraction gate electrode 11 of the light-emitting elements and the emitter array 43 is denoted by Vege.

The gate electrode potential control circuit 23 of a driving transistor has functions of dividing in terms of time to drive a plurality of pixel circuits provided in a display device in matrix with a switching element, and holding Vgs of the driving transistor Tr1 with a voltage holding element. FIG. 2B shows an exemplary circuit including such a switching element and a voltage holding element. In a circuit described in FIG. 2B, a capacitor 31 is connected to one terminal of a transistor 30; the transistor 30 is turned on by inputting a High signal to a terminal S which is a gate electrode side; and the potential of the data line 28 connected to a terminal D which is one of either a source electrode or a drain electrode of the transistor 30 side is transmitted to the capacitor 31 and a terminal Q which is the other of either the source electrode or the drain electrode. That is, data is written thereto.

After that, when the transistor 30 is turned off by inputting a Low signal to the terminal S, the potential of the data line 28 connected to the terminal D is not transmitted to the capacitor 31 and the terminal Q. Then, the potential of the terminal Q in the period when the transistor has been on is held in the capacitor 31 until the transistor 30 is turned on again. Vgs of the driving transistor Tr1 is determined in accordance with the potentials of the capacitor 31 and the terminal Q, and a drain current which corresponds to Vgs continuously flows through the driving transistor Tr1. In this manner, the active matrix driving method can be achieved. Note that in the gate electrode potential control circuit 23 of a driving transistor of the invention, a parasitic capacitance of the gate electrode of the driving transistor Tr1 can be substituted for the capacitor 31 which holds the potential of the gate electrode of the driving transistor Tr1; therefore a capacitor for holding the potential of the gate electrode of the driving transistor Tr1 is not necessarily to be provided in examples described in this specification.

The gate electrode of the driving transistor Tr1 is connected to the terminal Q of the gate electrode potential control circuit 23 of a driving transistor and a terminal Qin of the potential control circuit 40 of an extraction gate electrode; one of either the source electrode or the drain electrode of the driving transistor Tr1 is connected to the cathode electrode 27; and the other of the either the source electrode or the drain electrode of the driving transistor Tr1 is connected to a terminal EA of the light-emitting element 42. Note that there is a case that switching elements or the like are interposed between the cathode electrode 27 and the driving transistor Tr1, and between the terminal EA of the light-emitting element 42 and the driving transistor Tr1 depending on the configuration of the gate electrode potential control circuit 23 of a driving transistor, and the invention includes such a case. A transistor can be applied as a switching element.

The potential control circuit 40 of an extraction gate electrode includes the terminal Qin which is connected to the gate electrode of the driving transistor Tr1 and the terminal Q of the gate electrode potential control circuit 23 of a driving transistor, and a terminal EGin which is connected to the terminal EG of the light-emitting element 42. The potential control circuit 40 of an extraction gate electrode has a function of outputting a voltage in accordance with Vgs of the driving transistor Tr1 input to the terminal Q to the terminal EG of the light-emitting element 42 through the terminal EGin. An exemplary circuit having such a function and an effect thereof will be described later.

The light-emitting element 42 includes a terminal A which is connected to the anode electrode 15, a terminal EA which is connected to either the source electrode or the drain electrode of the driving transistor Tr1, and a terminal EG which is connected to the terminal EGin of the potential control circuit 40 of an extraction gate electrode. The terminal EA of the light-emitting element 42 is connected to an emitter 10 while the terminal EG of the light-emitting element 42 is connected to the extraction gate electrode 11. Note that in a conventional display device, the potential of the extraction gate electrode 11 is shared by all the light-emitting elements and is fixed at a certain potential Veg when the light-emitting elements of EFD are driven by using the active matrix driving method, while in the invention, a case where the extraction gate electrode 11 is formed individually in each pixel is included. In addition, the potential of the anode electrode 15 is denoted by Va.

An exemplary circuit having necessary functions for the potential control circuit 40 of an extraction gate electrode is described with reference to FIG. 4. An exemplary circuit of the potential control circuit 40 of an extraction gate electrode described in FIG. 4 includes a wire EGmax, a wire EGmin, a wire REF, a transistor Tr2, a transistor Tr3, and a resistor R. Although the transistor Tr2 and the transistor Tr3 are P-channel transistors, they may be N-channel transistors. In addition, the resistor R is formed of a material having a higher ohmic value than wiring materials, for example, it may be formed of silicon or Indium Tin Oxide (also described as ITO).

The transistor Tr3, the resistor R, and the transistor Tr2 are connected in series in this order between the wire EGmax and the wire EGmin. In addition, a connecting node of the transistor Tr3 and the resistor R is connected to the terminal EGin. Further, a gate electrode of the transistor Tr2 is connected to the terminal Qin. The wire REF is connected to a gate electrode of the transistor Tr3.

Figure 4:
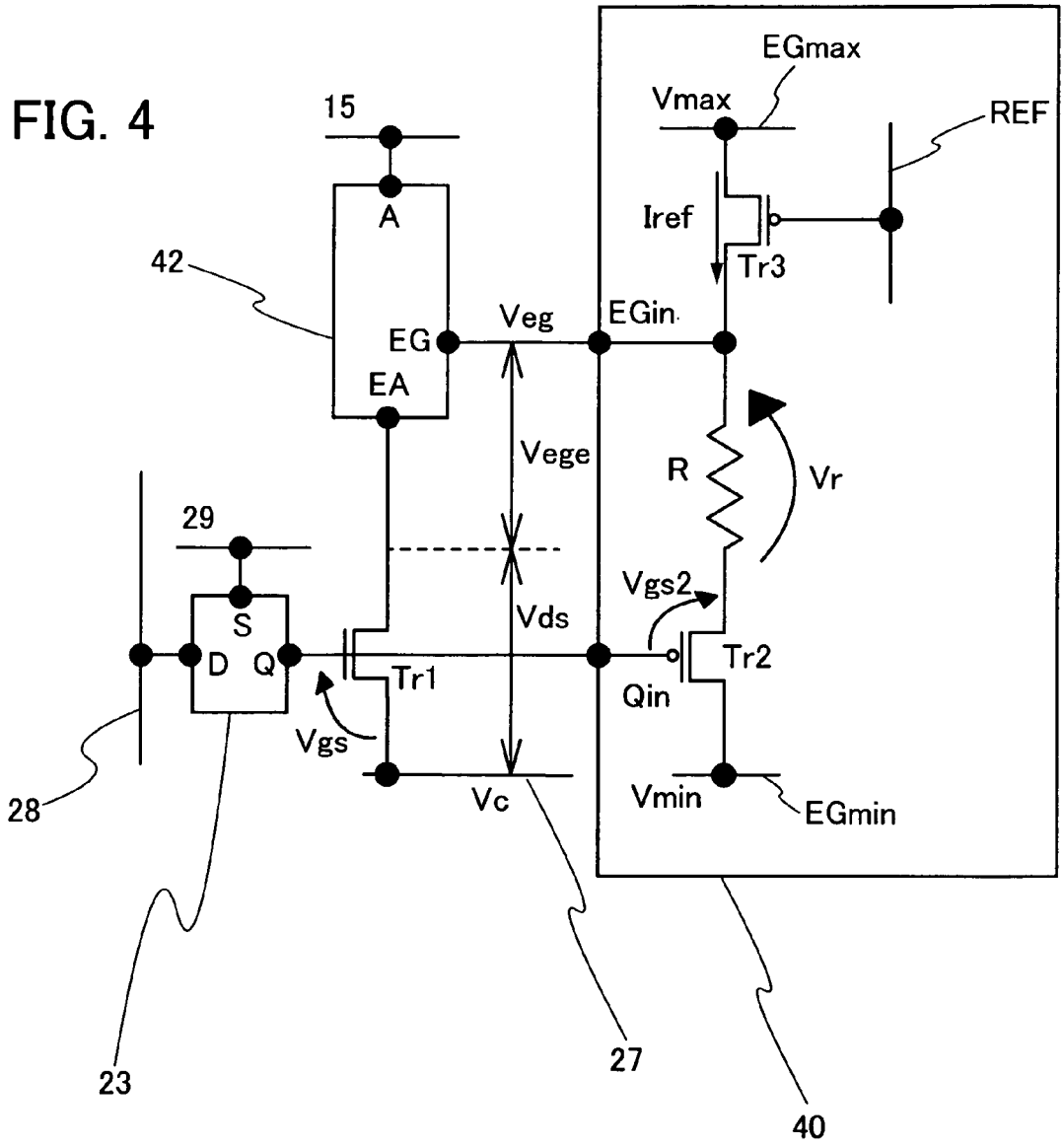
FIG. 4 is a diagram showing an exemplary potential control circuit of the invention.

Next, a bias voltage applied to the potential control circuit 40 of an extraction gate electrode described in FIG. 4 is described. A potential Vmax is applied to the wire EGmax; a potential Vmin is applied to the wire EGmin; and a potential Vref is applied to the wire REF. Since the potential Vmax is the maximum value of a voltage (Veg) which is applied to the terminal EG connected to the extraction gate electrode 11 of the light-emitting element 42, the potential Vmax is preferably set higher than the potential of the extraction gate electrode 11 which is necessary for obtaining the maximum luminance by supplying the maximum current to the light-emitting element 42 and the driving transistor Tr1. The potential Vmin is a potential which is lower than the potential Vmax and a potential when the transistor Tr2 and the transistor Tr3 perform in the saturation region, as well as a potential equal to or lower the potential of the gate electrode of the transistor Tr2 (Vc+Vgs). In particular, if the cathode electrode 27 is connected to the wire EGmin, the area dimension of a region other than the wire EGmin can be enlarged, which is advantageous in designing the pixel region. In addition, the wire EGmin may be connected either the scan line of the pixel or the scan line of other pixels.

The potential Vref is a bias potential which is applied to the gate electrode of the transistor Tr3 in order to keep a current Iref flowing through the transistor Tr3, the resistor R, and the transistor Tr2 at an appropriate value. A necessary value of Iref depends on the resistance value of the resistor R and the characteristics of the transistor Tr2. Note that the transistor Tr2 and the transistor Tr3 may perform in the linear region since a potential $V_{EG}$ of the terminal EGin is only required to be at higher than a potential of $V_Q$ of the terminal Qin.

Next, an operation when the bias voltage is applied to the potential control circuit 40 of an extraction gate electrode described in FIGS. 2A and 2B under the aforementioned condition is described. First, a potential of the electrode of the connecting node of the transistor Tr2 and the resistor R is higher than the potential of the wire EGmin. That is, the connecting node of the transistor Tr2 and the resistor R is a source electrode of the transistor Tr2. Accordingly, the transistor Tr2 has a source follower connection with a drain grounded. At this time, a gate-source voltage of the transistor Tr2 (hereinafter, also described as Vgs2) which is high enough to flow Iref is applied to the Vgs2 since the current Iref flows through the transistor Tr2. Vgs2 depends only on the value of Iref when the transistor Tr2 performs in the saturation region; and therefore, Vgs2 does not change as long as Iref does not change. Here, the potential of the gate electrode of the transistor Tr2 is equal to the potential of the gate electrode of the driving transistor Tr1, (Vc+Vgs). Accordingly, the potential of the source electrode of the transistor Tr2 is (Vc+Vgs+Vgs2).

In addition, a voltage Vr which is applied between the opposite electrodes of the transistor R is represented by (Iref× r) where the ohmic value of the resistor R is r since the current Iref flows through the resistor R. Here, since the electrode having a lower potential between the two electrodes of the transistor R is the source electrode of the transistor Tr2, the potential of the electrode EGin having a high potential between the two electrodes of the transistor R is represented by the following formula 2.

$$Veg=Vc+Vgs+Vgs2+Vr \quad \text{[formula 2]}$$

In the right hand side of the formula 2, Vc is the potential of the cathode electrode 27 and can be determined arbitrarily. Reference symbol Vgs denotes the gate-source voltage of the driving transistor Tr1, and it is a voltage determining the amount of current supplied to the light-emitting element 42, which is determined in accordance with the potential of the data line 28 or the potential of the gate electrode potential control circuit 23 of a driving transistor. As the Vgs becomes higher, the luminance of the light-emitting element becomes higher since a large amount of current flows through the driving transistor Tr1 and the light-emitting element 42. Reference symbols Vgs2 and Vr both denote potentials which only depend on Iref. That is, the potential Veg of the extraction gate electrode 11 of the light-emitting element 42 changes in accordance with Vgs of the driving transistor Tr1 when the current Iref does not change. In this manner, the potential control circuit 40 of an extraction gate electrode is realized.

Here, the potential control circuit 40 of an extraction gate electrode may be a circuit which outputs a higher potential than the potential of the gate electrode of the driving transistor Tr1 to the extraction gate electrode 11 of the light-emitting element 42 in accordance with the potential of the gate electrode of the driving transistor Tr1. FIGS. 24A to 24D show other examples of the potential control circuit 40 of an extraction gate electrode described in FIG. 4.

Figure 24A:
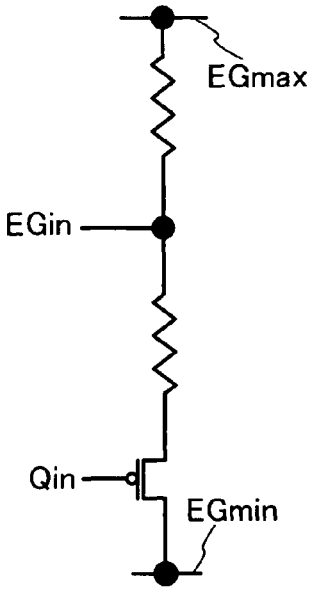
FIGS. 24A to 24D are diagrams showing potential control circuits of an extraction gate electrode included in a display device in the invention.
Figure 24B:
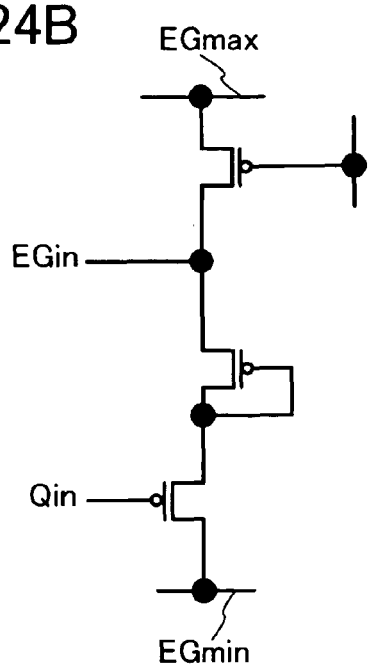
Figure 24C:
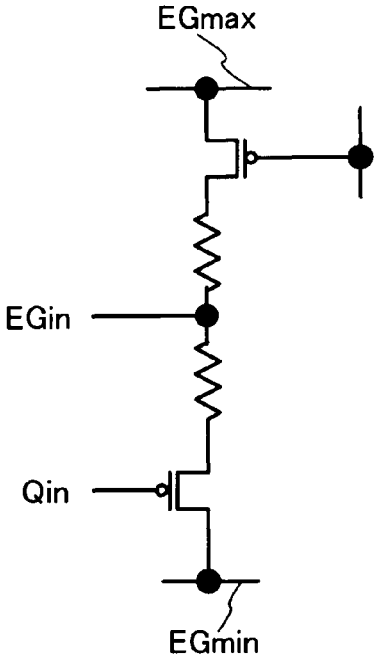
Figure 24D:
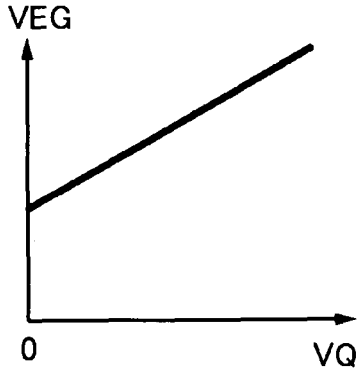

FIG. 24A shows an example using a resistor as a substitute for the transistor Tr3 in FIG. 4. FIG. 24B shows an example using a diode-connected transistor as a substitute for the resistor in FIG. 4. FIG. 24C shows an example adding a resistor between the transistor Tr3 and the terminal EGin in FIG. 4. In this manner, electric characteristics of the potential control circuit 40 of an extraction gate electrode may be such that the potential $V_{EG}$ of EGin is higher than the potential $V_Q$ of Qin and the potentials $V_{EG}$ and $V_Q$ may change with positive correlation as shown in FIG. 24D; therefore various circuits can be employed in addition to the example described in FIG. 4.

Note that when the potential $V_{EG}$ of EGin is not at higher than the potential $V_Q$ of Qin as in the case of connecting the gate electrode of the driving transistor Tr1 to the extraction gate electrode, for example, Vgs of the driving transistor Tr1 becomes high so that the reliability is decreased since a high voltage which is equal to or higher than the threshold voltage of the light-emitting element 42 is needed to be applied to Qin. Therefore, it is necessary that the potential $V_{EG}$ of EGin be at higher than the potential $V_Q$ of Qin.

Next, as shown in FIG. 4, how a voltage Vds between the source electrode and the drain electrode (hereinafter described as the source-drain voltage) of the driving transistor Tr1 changes by the potential control circuit 40 of an extraction gate electrode is described with reference to FIGS. 5A and 5B.

Figure 5A:
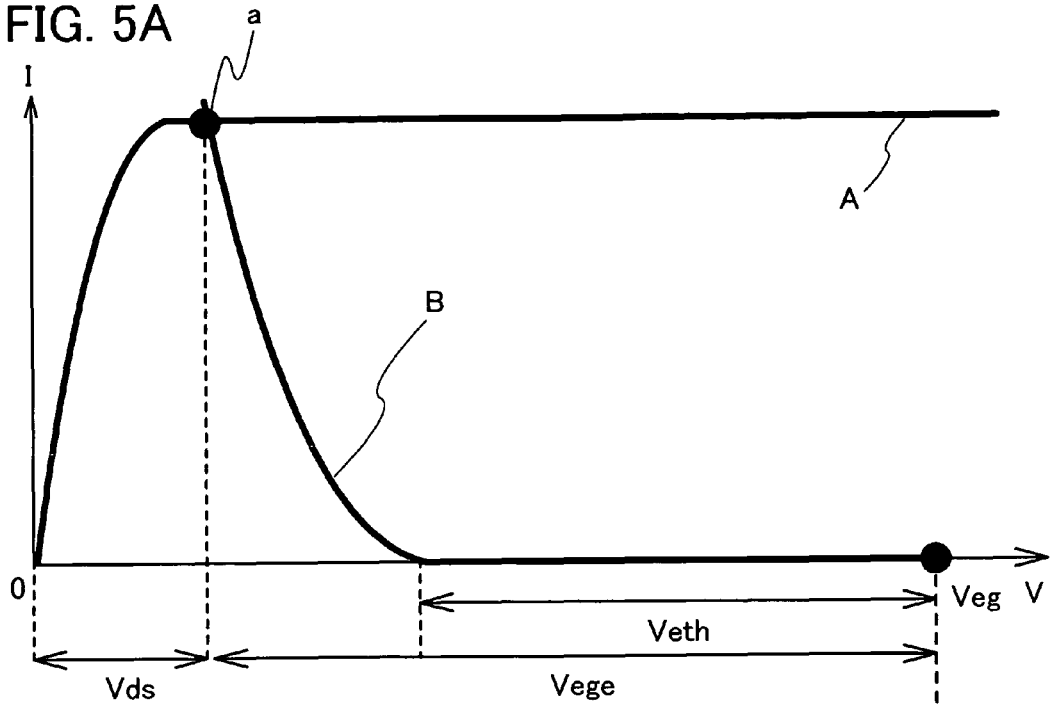
FIGS. 5A and 5B are diagrams showing operating points of an active matrix FED element in the invention.
Figure 5B:
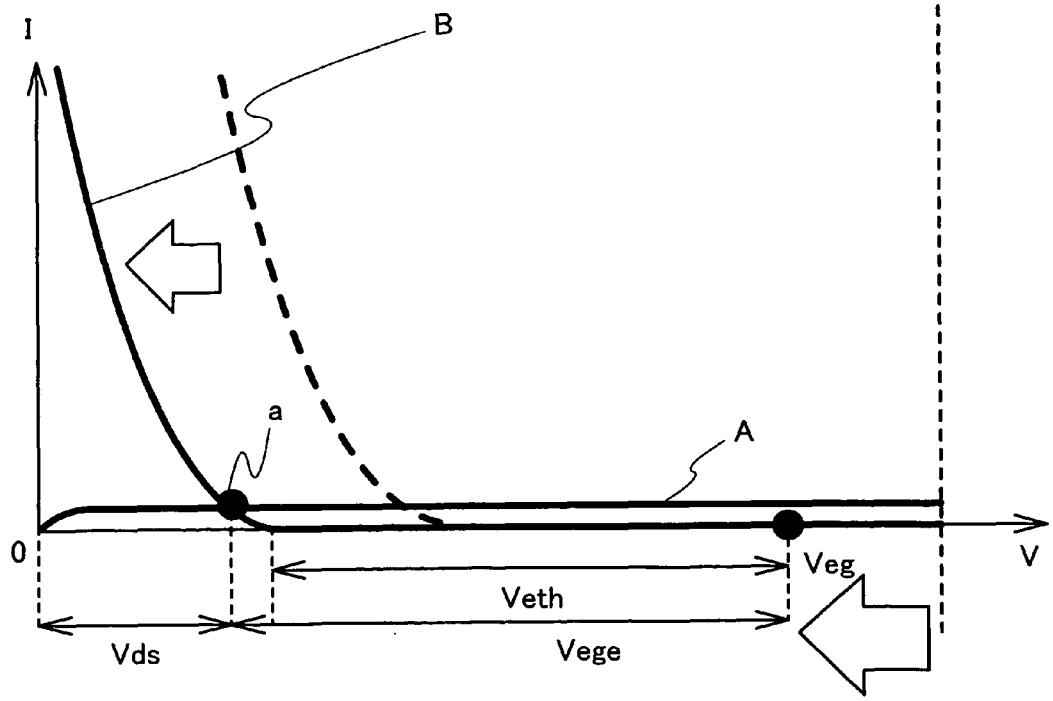

In FIG. 5A, a point "a" shows an operating point in the case of applying a high level of voltage as a gate-source voltage Vgs of the driving transistor Tr1 to increase the amount of current Ids which flows to the driving transistor Tr1 and the light-emitting element 42 in order to increase the luminance of the light-emitting element 42; a solid line A shows the current-voltage characteristics of the driving transistor Tr1; and a solid line B shows the current-voltage characteristics of the light-emitting element 42. On the other hand, in FIG. 5B, a point "a" shows an operating point in the case of applying a low level of voltage as a gate-source voltage Vgs of the driving transistor Tr1 to decrease the amount of current Ids which flows to the driving transistor Tr1 and the light-emitting element 42 to decrease luminance of the light-emitting element 42; a solid line A shows the current-voltage characteristics of the driving transistor Tr1; and a solid line B shows the current-voltage characteristics of the light-emitting element 42. For reference, a broken line in FIG. 5B shows the current-voltage characteristics of the light-emitting element 42 in the case of not employing the potential control circuit 40 of an extraction gate electrode. When the current-voltage characteristics of the light-emitting element 42 in the invention are compared with the broken line in FIG. 5B, the source-drain voltage Vds of the driving transistor Tr1 is lower than that of the conventional display device since the current-voltage characteristics of the light-emitting element 42 are shifted in the left direction and the operating point is shifted in the left direction correspondingly.

This is because the voltage Veg which is applied to the extraction gate electrode 11 of the light-emitting element 42 is changed in accordance with the level of the gate-source voltage Vgs of the driving transistor Tr1 based on the formula 2. Accordingly, the driving transistor Tr1 can be performed in the saturation region, and Vds of the driving transistor Tr1 which is higher when the luminance of the light-emitting element 42 is low can be decreased. Here, the range of Veg is determined by the range of the gate-source voltage Vgs of the driving transistor Tr1. When the threshold voltage of the driving transistor Tr1 is denoted by Vth, the minimum value of Veg is (Vth+Vgs2+Vr+Vc). Accordingly, the range of Vds of the driving transistor Tr1 can be represented by the following formula 3.

$$0<Vds<Vth+Vgs2+Vr-Veth \quad \text{[formula 3]}$$

In the right hand side of the formula 3, Vgs2 and Vr can be determined by the current Iref, the characteristics of the transistor Tr2, and the ohmic value of the resistor R. Note that it is preferable to increase Vr by increasing the ohmic value of the resistor R than to increase Vgs2 since a high voltage is not applied to the transistor Tr2.

Here with reference to the voltage value disclosed in the non-patent document 1, Veg is about 55 V, Veth is about 35 V, Vgs is about 13 V at the maximum, and Vc can be 0 V. That is, in the invention, when the light-emitting element 42 emits light at the maximum luminance, in other words, when Vgs is at the maximum, the voltage Veg which is applied to the extraction gate electrode 11 of the light-emitting element 42 may be about 55 V. In addition, in order not to apply a high voltage to the transistor Tr2, the gate-source voltage Vgs2 of the transistor Tr2 is set to be about 2 V. At this time, since the potential of the source electrode of the transistor Tr2 is about 15 V, voltage which is applied to the resistor R is desirably set to be about 40 V.

By taking the aforementioned set voltage values as an example, Vds in the case of minimizing the luminance of the light-emitting element 42 is estimated. When the threshold voltage of the driving transistor Tr1 is 1 V, Vgs and Vg2 in the case of minimizing the luminance of the light-emitting element 42 are 1 V and 2 V respectively, and the voltage applied to the resistor R is 40 V; therefore, the potential Veg of the extraction gate electrode 11 of the light-emitting element 42 is 43 V. Accordingly, the source-drain voltage Vds of the driving transistor Tr1 is Veg−Veth=43−35=8 V. Although the source-drain voltage Vds of the driving transistor Tr1 is about 20 V when the potential control circuit 40 of an extraction gate electrode is not provided, the light-emitting element 42 can be driven with Vds as low as 10 V or lower by employing the pixel configuration of the invention. Note that Vmax is preferably not higher than 60 V since the source-drain voltage of the transistor Tr3 may become high if the potential Veg becomes low.

Embodiment Mode 2

A display device of the invention includes the potential control circuit 40 of an extraction gate electrode described in Embodiment Mode 1 in a pixel circuit; however, it also includes a gate electrode potential control circuit 23 of a driving transistor in the pixel circuit. Although the invention can be applied to either the case of driving the display device with an analog value and the case of driving it with a digital value, it is particularly preferable in the display device of the invention that the gate electrode potential control circuit 23 of a driving transistor be a circuit which can process analog values, since the potential control circuit 40 of an extraction gate electrode can control the extraction gate electrode 11 of the light-emitting element 42 with analog values even if the gate-source voltage Vgs of the driving transistor Tr1 has an analog value.

However, electric characteristics of the driving transistor Tr1 vary in each pixel. Then, there is a case in which a current value flowing through the driving transistor Tr1 and the light-emitting element 42 varies even if the same Vgs is applied between the gate electrode and the source electrode of the driving transistor Tr1 in different pixels. The luminance of the light-emitting element 42 is observed to be varied among different pixels since it is proportional to the current value flowing thereto; and thus, it has a significantly adverse effect on the display quality. In addition, the degree of the adverse effect is greater in the display device which is driven with analog values than the display device which is driven with digital values. In the display device of the invention, compensating the variation among pixels is a necessary factor.

Therefore, in this embodiment mode, a pixel circuit which compensates the luminance variation of the light-emitting elements due to the characteristic variation of transistors and an operation thereof are described. A circuit which compensates the characteristic variation of transistors may be achieved with the gate electrode potential control circuit 23 of a driving transistor. An example of a gate electrode potential control circuit 23 of a driving transistor which has a function of compensating the characteristic variation of transistors is described below.

Figure 20A:
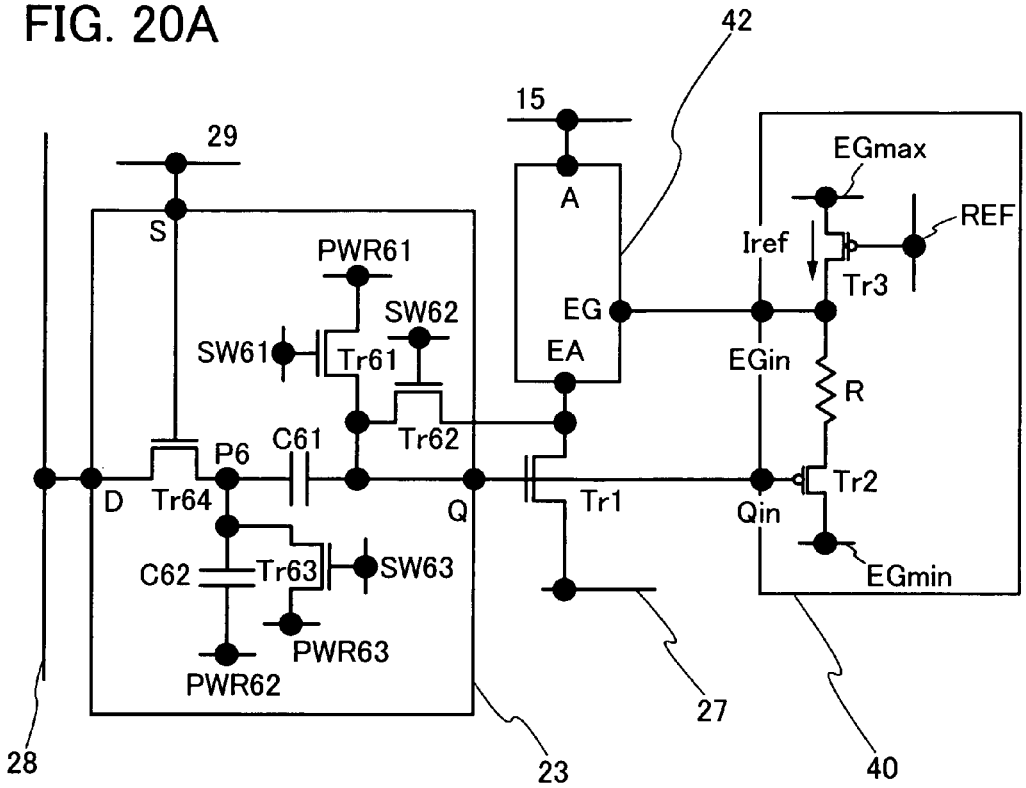
FIG. 20A is a diagram showing a pixel circuit of a display device in the invention.
Figure 20B:
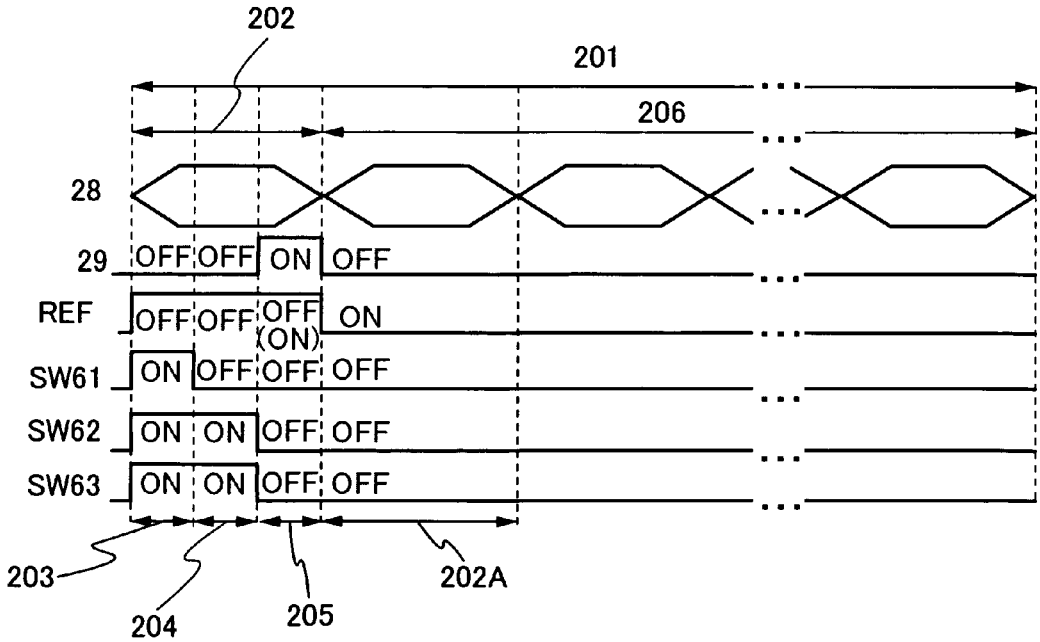
FIG. 20B is a timing chart thereof.

FIG. 20A shows an exemplary pixel circuit for compensating threshold voltages while FIG. 20B shows an exemplary timing chart of driving signals thereof. In a pixel circuit for compensating threshold voltages described in FIG. 20A, the gate electrode potential control circuit 23 of a driving transistor includes a transistor Tr61 a transistor Tr62, a transistor Tr63, a transistor Tr64, a wire SW61, a wire SW62, a wire SW63, a wire PWR61, a wire PWR62, a wire PWR63, a capacitor C61, and a capacitor C62.

The capacitor C61 and the capacitor C62 are connected in series; one of electrodes of the capacitor C61 which is not connected to the capacitor C62 is connected to a terminal Q; and one of electrodes of the capacitor C62 which is not connected to the capacitor C61 is connected to a wire PWR62. A gate electrode of the transistor Tr61 is connected to the wire SW61; one of either a source electrode or a drain electrode of the transistor Tr61 is connected to the wire PWR61; and the other of either the source electrode or the drain electrode of the transistor Tr61 is connected to the terminal Q. A gate electrode of the transistor Tr62 is connected to the wire SW62; one of either a source electrode or a drain electrode of the transistor Tr62 is connected to a terminal EA of the light-emitting element 42; and the other of either the source electrode or the drain electrode of the transistor Tr62 is connected to the terminal Q. A gate electrode of the transistor Tr63 is connected to the wire SW63; one of either a source electrode or a drain electrode of the transistor Tr63 is connected to the wire PWR63; and the other of either the source electrode or the drain electrode of the transistor Tr63 is connected to a connecting node of the capacitor C61 and the capacitor C62 (hereinafter, this node is also described as electrode P6). A gate electrode of the transistor Tr64 is connected to a terminal S; one of either a source electrode or a drain electrode of the transistor Tr64 is connected to a terminal D; and the other of either the source electrode or the drain electrode of the transistor Tr64 is connected to the electrode P6.

Note that in the pixel circuit described in FIG. 20A, the driving transistor Tr1 is described as an N-channel transistor while the transistors Tr2 and Tr3 are described as P-channel transistors. Switching elements included in the gate electrode potential control circuit 23 of a driving transistor are all described as N-channel transistors; however, an operation of the gate electrode potential control circuit 23 of a driving transistor is not limited by the polarities of the switching elements. When the switching elements included in the gate electrode potential control circuit 23 of a driving transistor are P-channel transistors, a timing chart whose signals are inverted from signals of corresponding wires described in FIG. 20B may be employed.

A potential which is applied to the wire PWR61 is preferably equal to or higher than a potential of a cathode electrode 27 by the threshold voltage of the driving transistor Tr1 in an initialization period 203 and a threshold wiring period 204 in FIG. 20B. In addition, the potential which is applied to the wire PWR61 may be set arbitrarily in other periods; however, the potential which is applied to the wire PWR61 is preferably a constant potential in the whole periods. A potential which is applied to the wire PWR62 is preferably a constant potential in the whole periods. Although the potential which is applied to the wire PWR62 is arbitrary, it may be about equal to the potential of the cathode electrode 27. The wire PWR62 may be connected to the cathode electrode 27. It is preferable that a potential which is enough to make the Tr61 turn off is applied to the wire SW61 in an off state while it is preferable that a potential which is enough to make the SW61 perform in the linear region is applied to the wire SW61 in an on state, since the wire SW61 is the wire for driving the transistor Tr61 as a switching element. It is preferable that a potential which is enough to make the transistor Tr62 turn off is applied to the wire SW62 in an off state while it is preferable that a potential which is enough to make the transistor Tr62 perform in the linear region is applied to the wire SW62 in an on state, since the wire SW62 is the wire for driving the transistor Tr62 as a switching element. It is preferable that a potential which is enough to make the transistor Tr63 turn off is applied to the wire SW63 in an off state while it is preferable that a potential which is enough to make the transistor Tr63 perform in the linear region is applied to the wire SW63 in an on state, since the wire SW63 is the wire for driving the transistor Tr63 as a switching element. It is preferable to set a potential which is applied to the terminal S such that is enough to make the transistor Tr64 turn off or perform in the linear region. A potential which is applied to the terminal D is a data potential which is a potential made from image data with a peripheral driver circuit. Note that this embodiment mode has a feature that a potential of the wire REF included in the potential control circuit 40 of an extraction gate electrode described in Embodiment Mode 1 can be changed in accordance with the scan line selecting period 202. By this feature, an electrical state of the light-emitting elements in the scan line selecting period 202 can be selectively made different from other periods. Therefore, in this embodiment mode, the wire REF is preferably patterned in stripes in the same manner as the scan line 29 so that the potential of the wire REF can be independently set by each scan line. It is preferable that a potential which is enough to decrease the current Iref is applied to the wire REF in an off state while it is preferably it is preferable that a potential which can supply the current Iref described in Embodiment Mode 1 is applied to the wire REFin an on state.

Next, operations of the pixel circuit are described with reference to FIGS. 20A and 20B. First, one frame period includes the scan line selecting period 202 and a light-emitting period 206. Note that when the scan line selecting period 202 terminates, a next scan line selecting period 202A starts. By scanning in sequence in this manner to perform writing, data potentials may be written into the whole pixels. Further, the scan line selecting period 202 includes the initialization period 203, the threshold wiring period 204, and a data writing period 205. Note that in the scan line selecting period 202, the wire REF of the potential control circuit 40 of an extraction gate electrode may be set to be at high level to turn the transistor Tr3 off. This helps to decrease Iref to decrease a voltage which is applied to the resistor R and the transistor Tr2. Then, the potential of the extraction gate electrode 11 of the light-emitting element 42 can be made equal to or lower than the threshold voltage of the light-emitting element 42 since a potential of the terminal EGin is decreased. That is, on/off states of the light-emitting element 42 can be controlled by varying the potential of the wire REF. In the pixel circuit for compensating the threshold voltage of the conventional display device, there is a case where a switching element is interposed between any two of the elements among the anode electrode 15, the light-emitting element 42, the driving transistor Tr1, and the cathode electrode 27 which are connected in series. However, the switching element has a higher ohmic value than the wires even if it is in an on state. In order to suppress wasteful power consumption, it is necessary to reduce elements which would be resistors as much as possible since a large current flows through a path which includes the light-emitting element 42. Therefore, this switching element is preferably not to be provided. By driving the pixel circuit of the display device of the invention in this manner, power consumption can be reduced since the switching element is not required to be provided on the path which includes the light-emitting element 42. In order to secure the reliability, a configuration where the potential of the wire EGmin is increased when the transistor Tr3 is in an off state may be employed since a source-drain voltage of the transistor Tr3 is increased when turning the transistor Tr3 off to decrease the potential of the terminal EGin. For example, the scan line 29, the wire SW61, the wire SW62, and the wire SW63 of the pixel may be connected to the wire EGmin. Note that in FIG. 20B, the wire SW62 and the wire SW63 may be shared since they have the same waveforms of driving signals. By sharing the wires, a layout area dimension of the wires can be reduced; area dimensions of other elements are increased to increase the degree of freedom for design; a parasitic capacitance of the wires is decreased to reduce the dullness of waveforms of signals; and power consumption can be reduced.

In addition, in FIG. 20B, the potential of the wire REF is at high level in the whole scan line selecting period 202 while the potential of the wire REF is not necessarily to be at high level in the data writing period 205, so it may be at low level. Since waveforms of driving signals of the wire SW62 and the wire SW63 are the same when the potential of the wire REF is at low level in the data writing period 205, timing generation circuits thereof may be shared by the wire SW62 and the wire SW63.

The initialization period 203 is a period to increase potentials of the gate electrode and the drain electrode of the driving transistor Tr1 to be at higher than the potential of the source electrode by the threshold voltage of the driving transistor Tr1 or higher than that in order to turn the driving transistor Tr1 on. At this time, the light-emitting element 42 is set to be in an off state. States of the transistors Tr61, Tr62, Tr63, Tr64, and Tr3 for achieving this state may be set, for example as shown in FIG. 20B, where the transistors Tr61, Tr62, and Tr63 are turned on while the transistors Tr64 and Tr3 are turned off. By setting the states in this manner, potentials of the gate electrode and the drain electrode of the driving transistor Tr1 and an electrode of the capacitor C61 on the terminal Q side become the potential of the wire PWR61, while a potential of the opposite electrode of the capacitor C61 becomes the potential of the wire PWR63, so that a voltage which is applied to the capacitor C61 is increased to be equal to or higher than the threshold voltage of the driving transistor Tr1. Note that the initialization period 203 is not necessarily to be in the scan line selecting period 202, and thus, it may be in a scan line selecting period of another row.

The threshold writing period 204 is a period to apply a potential difference corresponding to the threshold voltage of the driving transistor Tr1 to the opposite electrodes of the capacitor C61. States of the transistors Tr61, Tr62, Tr63, Tr64, and Tr3 for achieving this state may be set, for example as shown in FIG. 20B, where the transistors Tr62 and Tr63 are turned on while the transistors Tr61, Tr64, and Tr3 are turned off. By setting the potential of the electrode P6 to be about equal to the potential of the cathode electrode 27 to connect to the gate electrode and the drain electrode of the driving transistor Tr1 so as to bring the driving transistor Tr1 into a floating state, the electric charges which have been charged in the capacitor C61 in the initialization period 203 flows out through the driving transistor Tr1, so that the driving transistor Tr1 is turned off to stop an outflow of electric charges which have been charged in the capacitor C61 in the initialization period 203 when the electric charges which have been charged in the capacitor C61 in the initialization period 203 flows out through the driving transistor Tr1, and the gate-source voltage of the driving transistor Tr1 becomes equal to the threshold voltage of the driving transistor Tr1. Accordingly, a voltage corresponding to the threshold voltage of the driving transistor Tr1 can be applied to the opposite electrodes of the capacitor C61.

The data writing period 205 is a period to apply a voltage corresponding to the sum of the threshold voltage of the driving transistor Tr1 and a data potential made from image data with the peripheral driver circuit to the gate electrode of the driving transistor Tr1. States of the transistors Tr61, Tr62, Tr63, Tr64, and Tr3 for achieving this state may be set, for example as shown in FIG. 20B, where the transistor Tr64 is turned on while the transistors Tr61, Tr62, Tr63, and Tr3 are turned off. Note that as described above, the transistor Tr3 may be in an on state in the data writing period 205. By turning the transistors Tr61 and Tr62 off, the gate electrode of the driving transistor Tr1 is brought into a floating state from other electrodes; therefore, a voltage corresponding to the threshold voltage of the driving transistor Tr1 which is applied to the capacitor C61 in the threshold writing period 204 is held without relying on the potential of the electrode P6. By turning the transistor Tr64 on and turning the transistor Tr63 off in this condition to apply a data potential made from image data with the peripheral driver circuit to the terminal D, the potential of the electrode P6 becomes equal to the data potential. At this time, the threshold voltage which is held in the capacitor C61 does not change. Accordingly, the voltage corresponding to the sum of the threshold voltage of the driving transistor Tr1 and the data potential is applied to the gate electrode of the driving transistor Tr1.

The light-emitting period 206 is a period to hold a voltage which has been written into the gate electrode of the driving transistor Tr1 in the data writing period 205 for one frame period to continuously make the light-emitting element 42 emit light with luminance in accordance with a data voltage by continuously supplying a constant current value to the driving transistor Tr1 and the light-emitting element 42. States of the transistors Tr61, Tr62, Tr63, Tr64, and Tr3 for achieving this state may be set, for example as shown in FIG. 20B, where the transistor Tr3 is turned on while the transistors Tr61, Tr62, Tr63, and Tr64 are turned off. When the transistors Tr63 and Tr64 are turned off with the condition that the data potential is written into the electrode P6, the potential of the electrode P6 is held as the data potential. However, a current which flows to the driving transistor Tr1 and the light-emitting element 42 fluctuates when the potential of the electrode P6 fluctuates by noise effects on various kinds of signals in the pixel circuit, and thus, it is necessary to stabilize the potential of the electrode P6 in order to suppress the fluctuation of luminance of the light-emitting element 42. Therefore, it is preferable to suppress fluctuation of the potential of the electrode P6 by setting the wire PWR62 at a constant potential.

Figure 21A:
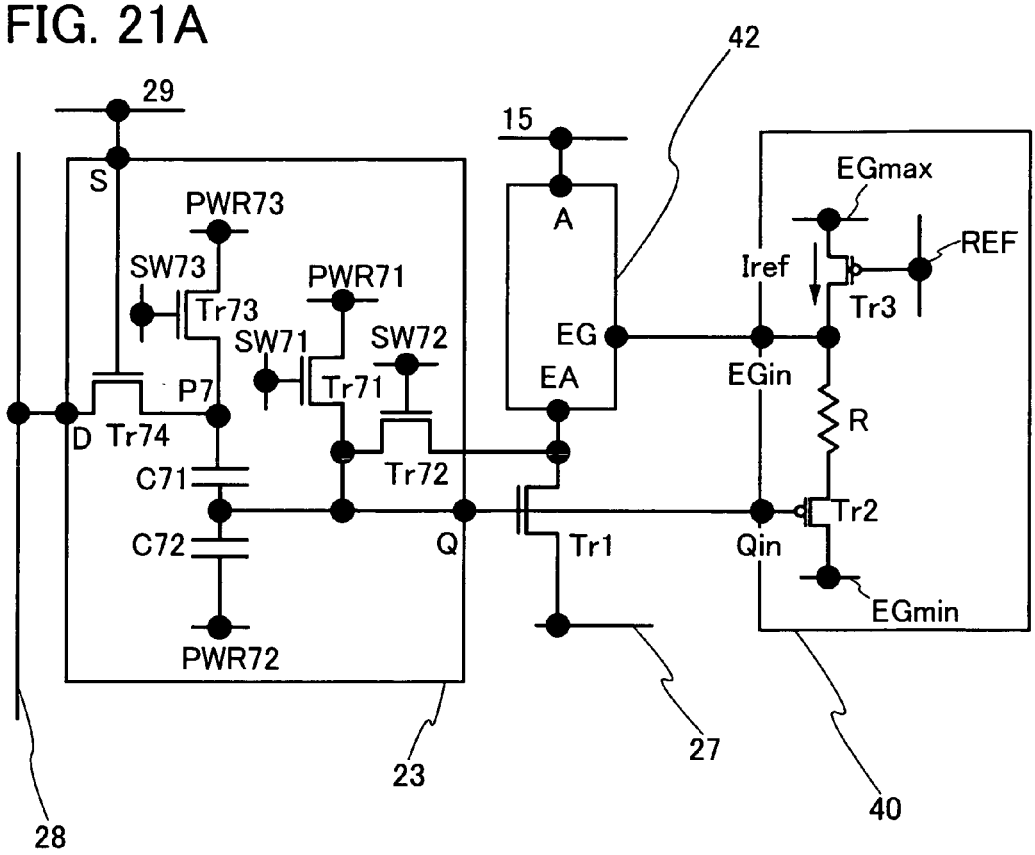
FIG. 21A is a diagram showing a pixel circuit of a display device in the invention.
Figure 21B:
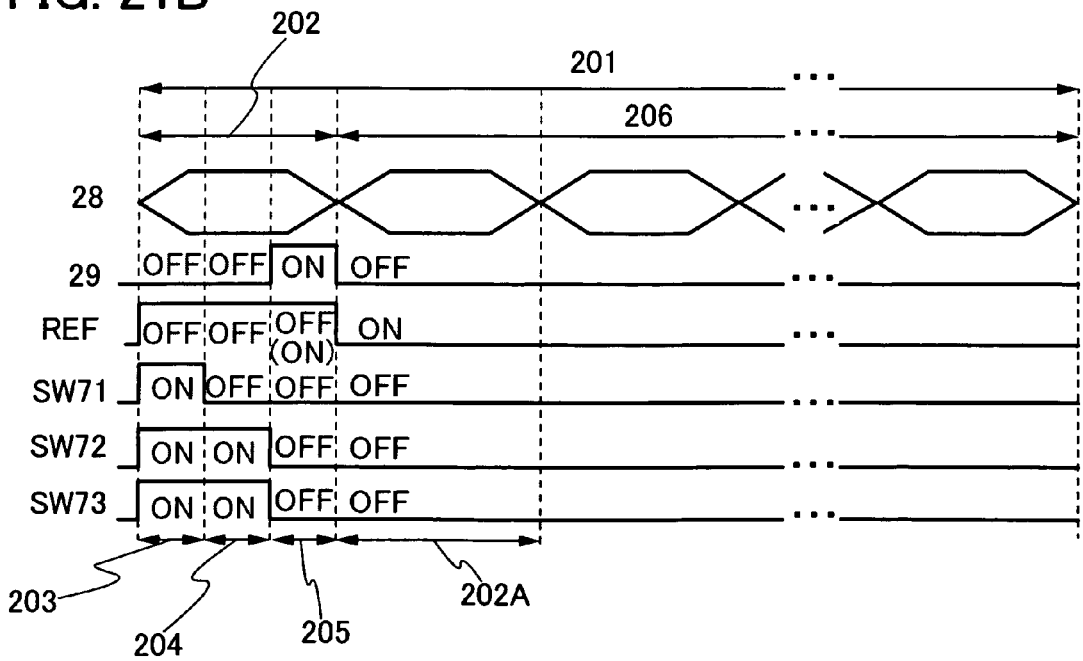
FIG. 21B is a timing chart thereof.

FIG. 21A shows an exemplary pixel circuit for compensating threshold voltages of the invention and FIG. 21B shows an exemplary timing chart of driving signals thereof. In a circuit described in FIG. 21A, the gate electrode potential control circuit 23 of a driving transistor includes a transistor Tr71, a transistor Tr72, a transistor Tr73, a transistor Tr74, a wire SW71, a wire SW72, a wire SW73, a wire PWR71, a wire PWR72, a wire PWR73, a capacitor C71, and a capacitor C72.

The capacitor C71 and the capacitor C72 are connected in series; and one of electrodes of the capacitor C71 which is connected to the capacitor C72 is connected to a terminal Q. The other electrode of the capacitor C71 which is not connected to the capacitor C72 is hereinafter described as an electrode P7. One of electrodes of the capacitor C72 which is not connected to the capacitor C71 is connected to the wire PWR72. A gate electrode of the transistor Tr71 is connected to the wire SW71; one of either a source electrode or a drain electrode of the transistor Tr71 is connected to the wire PWR71; and the other of either the source electrode or the drain electrode of the transistor Tr71 is connected to the terminal Q. A gate electrode of the transistor Tr72 is connected to the wire SW72; one of either a source electrode or a drain electrode of the transistor Tr72 is connected to a terminal EA of the light-emitting element 42; and the other of either the source electrode or the drain electrode of the transistor Tr72 is connected to the terminal Q. A gate electrode of the transistor Tr73 is connected to the wire SW73; one of either a source electrode or a drain electrode of the transistor Tr73 is connected to the wire PWR73; and the other of either the source electrode or the drain electrode of the transistor Tr73 is connected to the electrode P7. A gate electrode of the transistor Tr74 is connected to a terminal S; one of either a source electrode or a drain electrode of the transistor Tr74 is connected to a terminal D; and the other of either the source electrode or the drain electrode of the transistor Tr74 is connected to the electrode P7.

Note that in the pixel circuit described in FIG. 21A, the driving transistor Tr1 is described as an N-channel transistor while transistors Tr2 and Tr3 are described as P-channel transistors. Switching elements included in the gate electrode potential control circuit 23 of a driving transistor are all described as N-channel transistors; however, an operation of the gate electrode potential control circuit 23 of a driving transistor does not depend on the polarities of the switching elements. When the switching elements included in the gate electrode potential control circuit 23 of a driving transistor are P-channel transistors, a timing chart whose signals are inverted from signals of corresponding wires described in FIG. 21B may be employed.

In the pixel circuit described in FIG. 21A, voltages of the wire SW71, the wire SW72, and the wire SW73 correspond to the voltages of the wire SW61, the wire SW61, and the wire SW63, respectively, while voltages of the wire PWR71 and the wire PWR73 correspond to the wire PWR61 and the wire PWR 63, respectively, and thus repetitive description will be omitted. Note that the potential of the wire PWR 72 is different from the potential of wire PWR62, and the potential of the wire PWR72 is preferably about equal to the potential of the cathode electrode 27. Note that this embodiment mode has a feature that the potential of the wire REF included in the potential control circuit 40 of an extraction gate electrode which is described in Embodiment Mode 1 can be changed in accordance with the scan line selecting period 202. By this feature, an electrical state of the light-emitting elements in the scan line selecting period 202 can be selectively made different from other periods. Therefore, in this embodiment mode, the wire REF is preferably patterned in stripes in the same manner as the scan line 29 so that the potential of the wire REF can be independently set by each scan line. The potential which is applied to the wire REF is preferably low enough to decrease the current Iref in an off state while it is preferably a potential which can supply the current Iref described in Embodiment Mode 1 in an on state.

Next, operations of the pixel circuit are described with reference to FIGS. 21A and 21B. First, one frame period includes the scan line selecting period 202 and the light-emitting period 206. Note that when the scan line selecting period 202 terminates, a next scan line selecting period 202A starts. By scanning in sequence in this manner to perform writing, data potentials may be written into the whole pixels. Further, the scan line selecting period 202 includes the initialization period 203, the threshold wiring period 204, and the data writing period 205. Note that in the scan line selecting period 202, the wire REF of the potential control circuit 40 of an extraction gate electrode may be set to be at high level to turn the transistor Tr3 off. This helps to decrease Iref to decrease a voltage which is applied to the resistor R and the transistor Tr2. Then, the potential of the extraction gate electrode 11 of the light-emitting element 42 can be made equal to or lower than the threshold voltage of the light-emitting element 42 since the potential of the terminal EGin is decreased. That is, on/off states of the light-emitting element 42 can be controlled by varying the potential of the wire REF. In the pixel circuit for compensating the threshold voltages of the conventional display device, there is a case where a switching element is interposed between any two of the elements among the anode electrode 15, the light-emitting element 42, the driving transistor Tr1, and the cathode electrode 27 which are connected in series. However, the switching element has a higher ohmic value than the wires even if it is an on state. In order to suppress wasteful power consumption, it is necessary to reduce elements which would be resistors as much as possible since a large current flows between the cathode electrode 27 and the terminal EA of the light-emitting element 42. Therefore, this switching element is preferably not to be provided. By driving the pixel circuit of the display device of the invention in this manner, power consumption can be reduced since the switching element is not required to be provided on the path which includes the light-emitting element 42. In order to secure the reliability, a configuration where the potential of the wire EGmin is increased when the transistor Tr3 is in an off state may be employed since a source-drain voltage of the transistor Tr3 is increased when turning the transistor Tr3 off to decrease the potential of the terminal EGin. For example, the scan line 29, the wire SW71, the wire SW72, and the wire SW73 of the pixel may be connected to the wire EGmin.

Note that in FIG. 21B, the wire SW72 and the wire SW73 may be shared since they have the same waveforms of driving signals. By sharing the wires, a layout area dimension of the wires can be reduced; area dimensions of other elements are increased to increase the degree of freedom for design; a parasitic capacitance of the wires is decreased to reduce the dullness of waveforms of signals; and power consumption can be reduced.

In addition, in FIG. 21B, the potential of the wire REF is at high level in the whole scan line selecting period 202 while the potential of the wire REF is not necessarily to be at high level in the data writing period 205, so it may be at low level. Since waveforms of driving signals of the wire SW72 and the wire SW73 are the same when the potential of the wire REF is low level in the data writing period 205, timing generation circuits thereof may be shared by the wire SW72 and the wire SW73.

The initialization period 203 is a period to increase the potential of the gate electrode and the drain electrode of the driving transistor Tr1 to be higher than the potential of the source electrode by the threshold voltage of the driving transistor Tr1 or higher than that in order to turn the driving transistor Tr1 on. At this time, the light-emitting element 42 is set to be in an off state. States of the transistors Tr71, Tr72, Tr73, Tr74, and Tr3 for achieving this state may be set, for example as shown in FIG. 21B, where the transistors Tr71, Tr72, and Tr73 are turned on while the transistors Tr74 and Tr3 are turned off. By setting the states in this manner, potentials of the gate electrode and the drain electrode of the driving transistor Tr1 and the electrode of the capacitor C71 on the terminal Q side become the potential of the wire PWR71, while a potential of the opposite electrode of the capacitor C71 becomes the potential of the wire PWR73, so that a voltage which is applied to the capacitor C71 is increased to be equal to or higher than the threshold voltage of the driving transistor Tr1. Note that the initialization period 203 is not necessarily to be in the scan line selecting period 202, and thus, it may be in a scan line selecting period of another row.

The threshold writing period 204 is a period to apply a potential difference corresponding to the threshold voltage of the driving transistor Tr1 to the opposite electrodes of the capacitor C71 and the capacitor C72. States of the transistors Tr71, Tr72, Tr73, Tr74, and Tr3 for achieving this state may be set, for example as shown in FIG. 21B, where the transistors Tr72 and Tr73 are turned on while the transistors Tr71, Tr74, and Tr3 are turned off. By setting the potentials of the electrode P7 and the wire PWR72 to be about equal to the potential of the cathode electrode 27 to connect the gate electrode and the drain electrode of the driving transistor Tr1 so as to bring the driving transistor Tr1 into a floating state, the electric charges which have been charged in the capacitors C71 and C72 in the initialization period 203 flow out through the driving transistor Tr1, so that the driving transistor Tr1 is turned off to stop an outflow of electric charges which have been charged in the capacitors C71 and C72 in the initialization period 203 when the electric charges which have been charged in the capacitors C71 and C72 flow out through the driving transistor Tr1, and the gate-source voltage of the driving transistor becomes equal to the threshold voltage of the driving transistor Tr1. Accordingly, a voltage corresponding to the threshold voltage of the driving transistor Tr1 can be applied to the opposite electrodes of the capacitor C71 and the capacitor C72.

The data writing period 205 is a period to apply a voltage corresponding to the sum of the threshold voltage of the driving transistor Tr1 on the data potential made from image data with the peripheral driver circuit to the gate electrode of the driving transistor Tr1. States of the transistors Tr71, Tr72, Tr73, Tr74, and Tr3 for achieving this state may be set, for example as shown in FIG. 21B, where the transistor Tr74 is turned on while the transistors Tr71, Tr72, Tr73, and Tr3 are turned off. Note that as described above, the transistor Tr3 may be in an on state in the data writing period 205. By turning the transistors Tr71 and Tr72 off, the terminal Q is brought into a floating from other electrodes. However, since the capacitor C72 which is connected to the wire PWR72 with the constant potential is connected to the terminal Q, the potential of the terminal Q is a potential which depends on the capacitance values of the capacitors C71 and C72 (denoted by C1 and C2 respectively) and the potential of the electrode P7. When the potential of the cathode electrode 27 is denoted by Vc and the threshold voltage of the driving transistor Tr1 is denoted by Vth, the potentials of the wires PWR72 and PWR73 are denoted by Vc and the potential of the terminal Q is denoted by (Vc+Vth) at the time of when the threshold writing period 204 terminates. After that, in the data writing period 205, the gate-source potential Vgs of the driving transistor Tr1 when only the potential of the electrode P7 becomes a data voltage made from image data (also described as Vdata) with the peripheral driver circuit can be represented by the following formula 4.

$$Vgs=(C1/(C1+C2))\times(Vdata-Vc)+Vth \quad \text{[formula 4]}$$

The gate-source potential Vgs of the driving transistor Tr1 after the data writing period 205 includes the threshold voltage Vth itself. Accordingly, the current value flowing to the light-emitting element 42 and the luminance thereof can be controlled without being influenced by the threshold of Tr1 in each pixel by controlling the term which includes (Vdata−Vc).

The light-emitting period 206 is a period to hold a voltage which has been written into the gate electrode of the driving transistor Tr1 in the data writing period 205 over one frame period to continuously make the light-emitting element 42 emit light with a luminance in accordance with a data voltage by continuously supplying a constant current value to the driving transistor Tr1 and the light-emitting element 42. States of the transistors Tr71, Tr72, Tr73, Tr74, and Tr3 for achieving this state may be set, for example as shown in FIG. 21B, where the transistor Tr3 is turned on while the transistors Tr71, Tr72, Tr73, and Tr74 are turned off. When the transistors Tr73 and Tr74 are turned off with the condition that the data potential is written in the electrode P7, the potentials of the electrode P7 and the terminal Q are held as they are. However, a current which flows to the driving transistor Tr1 and the light-emitting element 42 fluctuates when the potential of the electrode P7 fluctuates by noise effects on various kinds of signals in the pixel circuit, and thus, it is necessary to stabilize the potentials of the electrode P7 and the terminal Q in order to suppress fluctuation of luminance of the light-emitting element 42. Therefore, it is preferable to suppress fluctuation of the potentials of the electrode P7 and the terminal Q by setting the wire PWR72 at a constant potential.

Figure 22A:
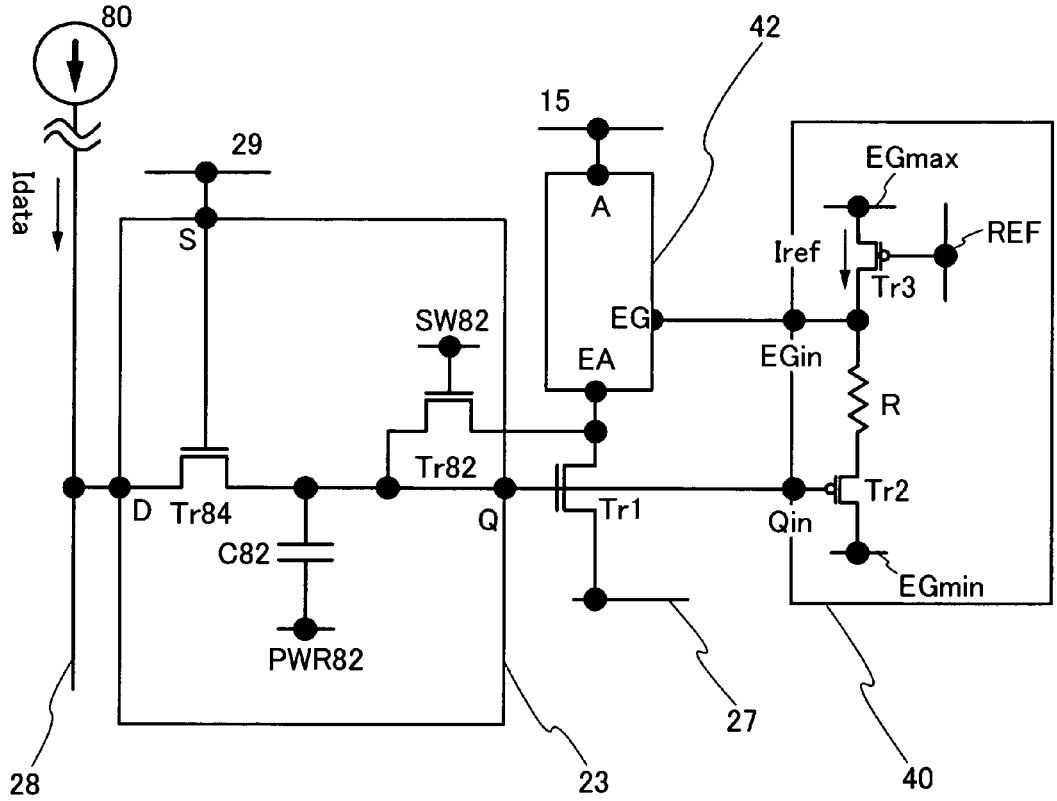
FIG. 22A is a diagram showing a pixel circuit of a display device in the invention.
Figure 22B:
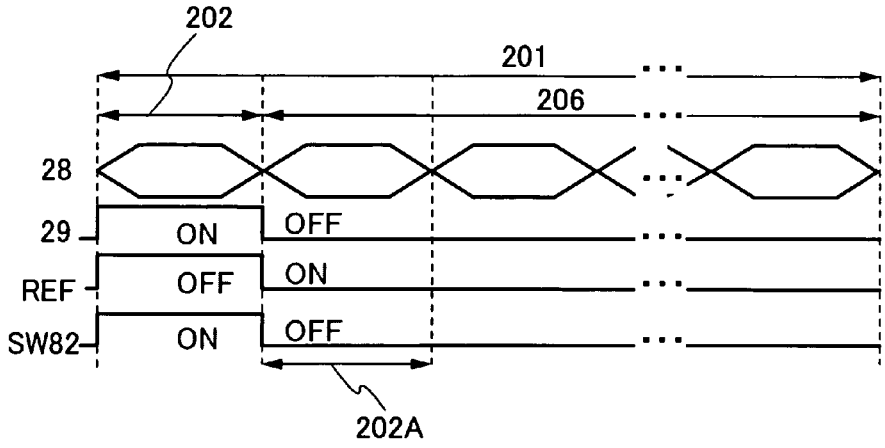
FIG. 22B is a timing chart thereof.

FIG. 22A shows an exemplary current input pixel circuit of the invention and FIG. 22B shows an exemplary timing chart of driving signals thereof. In a circuit described in FIG. 22A, the gate electrode potential control circuit 23 of a driving transistor includes a transistor Tr81, a transistor Tr82, a transistor Tr83, a transistor Tr84, a wire SW82, a wire PWR82, and a capacitor C82. Note that a current source 80 for supplying a data current Idata made from image data with the peripheral driver circuit may be provided outside a pixel region.

One of electrodes of the capacitor C82 is connected to the wire PWR82 while the other electrodes of the capacitor C82 is connected to the terminal Q. A gate electrode of the transistor Tr82 is connected to the SW82; one of either a source electrode or a drain electrode of the transistor Tr82 is connected to the terminal EA of the light-emitting element 42; and the other of either the source electrode or the drain electrode of the transistor Tr82 is connected to the terminal Q. A gate electrode of the transistor Tr84 is connected to the terminal S; one of either a source electrode or a drain electrode of the transistor Tr84 is connected to the terminal D; and the other of either the source electrode or the drain electrode of the transistor Tr84 is connected to the terminal Q.

Note that in the pixel circuit described in FIG. 22A, the driving transistor Tr1 is described as an N-channel transistor while the transistors Tr2 and Tr3 are described as P-channel transistors. Switching elements included in the gate electrode potential control circuit 23 of a driving transistor are all described as N-channel transistors; however, an operation of the gate electrode potential control circuit 23 of a driving transistor does not depend on the polarities of the switching elements. When the switching elements included in the gate electrode potential control circuit 23 of a driving transistor are P-channel transistors, a timing chart whose signals are inverted from signals of corresponding wires described in FIG. 22B may be employed.

A potential which is applied to the wire PWR82 is preferably a constant potential in the whole periods. Although the potential which is applied to the wire PWR82 is arbitrary, it may be about equal to the potential of the cathode electrode 27. The wire PWR82 may be connected to the cathode electrode 27. The potential which is applied to the wire SW82 is preferably low enough to turn the transistor Tr82 off when the wire SW82 is in an off state while the potential which is applied to the wire SW82 is preferably high enough for the transistor Tr82 to perform in the linear region when the wire SW82 is in an on state, since the wire SW82 is the wire for driving the transistor Tr82 as a switching element. A potential which is applied to the terminal S is preferably low enough to turn the transistor T84 off or high enough for the transistor Tr84 to perform in the linear region. A potential which is applied to the terminal D is a data potential which is a potential made from image data with the peripheral driver circuit. In the pixel circuit described in FIG. 22A, data is supplied as the current Idata and is input to the pixel circuit in the scan line selecting period 202.

Note that this embodiment mode has a feature that the potential of the wire REF included in the potential control circuit 40 of an extraction gate electrode which is described in Embodiment Mode 1 can be changed in accordance with the scan line selecting period 202. By this feature, an electrical state of the light-emitting element in the scan line selecting period 202 can be selectively made different from other periods. Therefore, in this embodiment mode, the wire REF is preferably patterned in stripes in the same manner as the scan line 29 so that the potential independently set by each scan line. The potential which is applied to the wire REF is preferably low enough to decrease the current Iref in an off state while it is preferably a potential which can supply current Iref described in Embodiment Mode 1 in an on state.

Next, operations of the pixel circuit are described with reference to FIGS. 22A and 22B. First, one frame period includes the scan line selecting period 202 and the light-emitting period 206. Note that when the scan line selecting period 202 terminates, a next scan line selecting period 202A starts. By scanning in sequence in this manner to perform writing, data potentials may be written into the whole pixels. In the scan line selecting period 202, the wire REF of the potential control circuit 40 of an extraction gate electrode may be set to be at high level to turn the transistor Tr3 off. This helps to decrease Iref to decrease a voltage which is applied to the resistor R and the transistor Tr2. Then, the potential of the extraction gate electrode 11 of the light-emitting element 42 can be made equal to or lower than the threshold voltage of the light-emitting element 42 since the potential of the terminal EGin is decreased. That is, on/off states of the light-emitting element 42 can be controlled by varying the potential of the wire REF.

The current input pixel of the conventional display device needs a switching element interposed between any two of the elements among the anode electrode 15, the light-emitting element 42, the driving transistor Tr1, and the cathode electrode 27 which are connected in series. The switching element has a higher ohmic value than the wires even if it is an on state. In order to suppress wasteful power consumption, it is necessary to reduce elements which would be resistors as much as possible since a large current flows through a path which includes the light-emitting element 42. By driving the pixel circuit of the display device of the invention in this manner, power consumption can be reduced since the switching element is not required to be provided on the path which includes the light-emitting element 42. In order to secure the reliability, a configuration where the potential of the wire EGmin is increased when the transistor Tr3 is in an off state may be employed since a source-drain voltage of the transistor Tr3 is increased when turning the transistor Tr3 off to decrease the potential of the terminal EGin. For example, the scan line 29 and the wire SW82 of the pixel may be connected to the wire EGmin.

Note that in FIG. 22B, the wire SW82 and the scan line 29 may be shared since they have the same waveforms of driving signals. By sharing the wires, a layout area dimension of the wires can be reduced; area dimensions of other elements are increased to increase the degree of freedom for design; a parasitic capacitance which is attached to the wires is decreased to reduce the dullness of waveforms of signals; and power consumption can be reduced. In addition, in FIG. 22B, since the waveform of a driving voltage of the wire REF is the same as the waveforms of driving signals of the wire SW82 and the scan line 29, timing generation circuits thereof may be shared by them.

The scan line selecting period 202 is a period to apply Vgs for allowing the driving transistor Tr1 to supply the data current a capacitor which is provided between the gate electrode of the driving transistor Tr1 and an electrode which has about equal potential to the source electrode or the drain of the driving transistor Tr1, by supplying the data current made from image data with the peripheral driver circuit to the driving transistor Tr1 with the condition that the gate electrode and the source electrode of the driving transistor Tr1 are connected to each other. States of the transistors Tr82, Tr84, and Tr3 for achieving this state may be set, for example as shown in FIG. 22B, where the transistors Tr82 and Tr84 are turned on while the transistor Tr3 is turned off. When the data current Idata flows through the data line 28 from the current source 80 in this state, the data current Idata is also supplied to the driving transistor Tr1 through the transistors Tr82 and Tr84. At this time, the gate-source voltage Vgs of the driving transistor Tr1 is equal to the source-drain voltage Vds thereof since the gate electrode and the source electrode thereof are connected to each other. That is, the driving transistor Tr1 performs in the saturation region. At this time, Vgs which is high enough to supply the data current Idata is applied to the driving transistor Tr1 operating in the saturation region.

The light-emitting period 206 is a period to hold a voltage which has been written into the gate electrode of the driving transistor Tr1 in the data writing period 205 over one frame period to continuously make the light-emitting element emit light with luminance in accordance with a data voltage by continuously supplying a constant current value to the driving transistor Tr1 and the light-emitting element 42. States of the transistors Tr82, Tr84, and Tr3 for achieving this state may be set, for example as shown in FIG. 22B, where the transistor Tr3 is turned on while the transistors Tr82 and Tr84 are turned off. The gate-source voltage Vgs which has been applied to the driving transistor Tr1 in the scan line selecting period 202 is held by the capacitor C82 even if the transistors Tr82 and Tr84 are turned off. Accordingly, Vgs in the light-emitting period 206 has a level high enough to supply the data current Idata to the driving transistor Tr1 operating in the saturation region like in the scan line selecting period 202. Although the source-drain voltages applied to the driving transistor Tr1 is not necessarily the same in the scan line selecting period 202 and in the light-emitting period 206, a current Ids which flows through the driving transistor Tr1 is determined only by the gate-source voltage Vgs as long as the driving transistor Tr1 operates in the saturation region, so that Ids has the same among as Idata. That is, a display device with uniformity and high quality can be obtained without being influenced by variation of characteristics of the driving transistor Tr1 since Ids having the same current value as the data current Idata can be supplied to the light-emitting element 42 independently of the electric characteristics of Vth of the driving transistor Tr1, such as the threshold voltage Vth and mobility.

Note that the current input pixel circuit as shown in FIG. 22A can employ other current-driven light-emitting elements such as an organic EL element. There is a problem that time required for one frame is too long since Idata has to be made small due to a small current value at the time of light emission, in particular, time for charging the parasitic capacitance of the data line or the capacitor C82 becomes too long at the time of writing the data current Idata with lowgray scales. However, such a problem can be avoided in the invention using electron-emissive elements. This is because factors which determine the luminance of the light-emitting element 42 are not only dependent on the current value flowing thereto but also the characteristics of a light-emitting material 16 provided to the anode electrode 15 and the potential of the anode electrode 15. That is, in the case of obtaining the same luminance, the current value is not limited to a specific value, and thus, it can be various values. Accordingly, a problem of shortage of charge time due to a small Idata can be avoided, by designing the voltage of the anode electrode 15 or the characteristics of the light-emitting material 16 so that the current Ids flowing to the light-emitting element 42 is increased without changing the luminance of the light-emitting element 42. At this time, the value of the current Ids is large so that the pixel circuit of the invention in which switching elements are not required to be provided between elements such as the anode electrode 15, the light-emitting element 42, the driving transistor Tr1, and the cathode electrode 27 is extremely advantageous in that energy loss by resistance components can be suppressed to the minimum.

The gate electrode potential control circuit 23 of a driving transistor of the pixel circuit in the invention can employ various kinds of circuits in addition to the aforementioned exemplary circuit. The invention can be applied to other circuits in addition to the aforementioned exemplary circuit, since the display device of the invention has a feature that switching elements are not required to be provided between the respective elements such as the anode electrode 15, the light-emitting element 42, the driving transistor Tr1, and the cathode electrode 27. Note that the configuration of the potential control circuit 40 of an extraction gate electrode is not limited to the aforementioned configuration, and thus, any configuration may be employed as long as the extraction gate electrode 11 of the light-emitting element 42 can be controlled in accordance with the operation of the pixel circuit, and thus the electrical state of the light-emitting element 42 can be controlled.

Embodiment Mode 3

Figure 23:
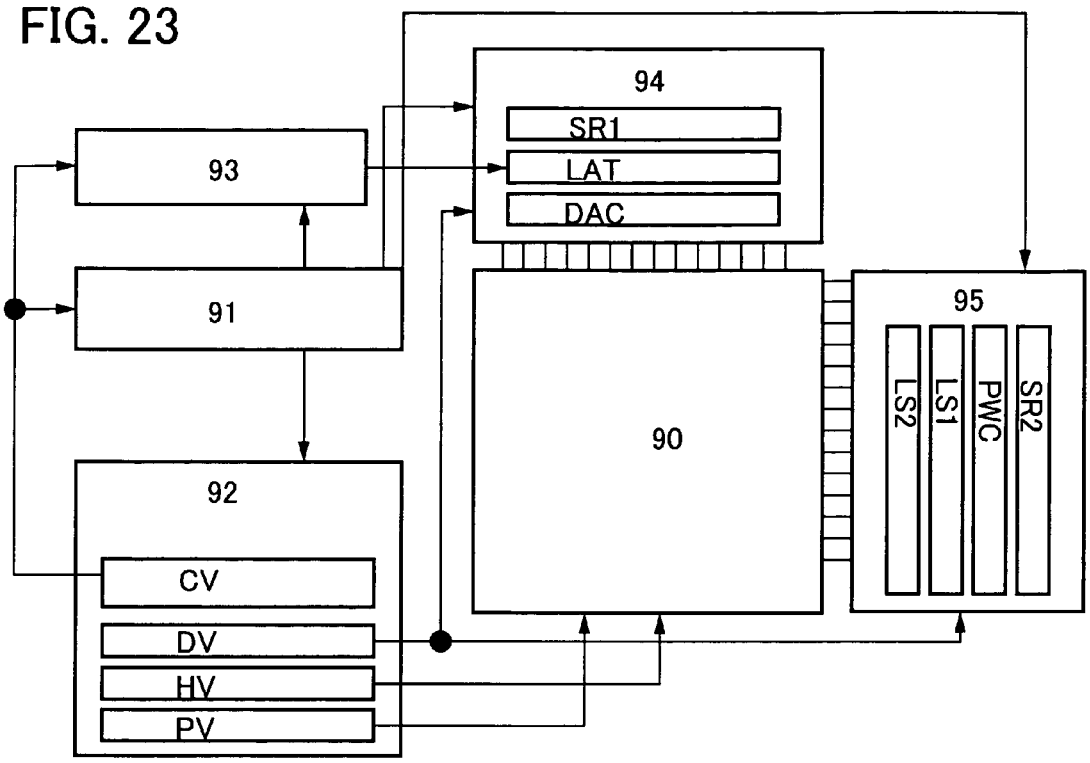
FIG. 23 is a diagram showing a display device in the invention.

In this embodiment mode, description is made of a configuration of the whole display device of the invention. Although various kinds of configurations of the display device of the invention can be considered, here, description is made of an exemplary configuration of the peripheral driver circuit which realizes the operation of the pixel circuit described in Embodiment Mode 2. FIG. 23 shows an exemplary configuration of a display device which includes the pixel circuits described in FIG. 20A, FIG. 21A, or FIG. 22A. A display device described in FIG. 23 includes a pixel portion 90, a control circuit 91, a power supply circuit 92, an image data converter circuit 93, a data line driver 94, and a scan line driver 95. The power supply circuit 92 includes a power supply CV for the control circuit and the image data converter circuit, a power supply DV for the drivers, a high voltage power supply HV, and a power supply PV for the pixel portion. The data line driver 94 includes a shift register SR1, a latch circuit LAT, and a D/A converter DAC. The scan line driver circuit 95 includes a shift register SR2, a pulse width control circuit PWC, a level shifter LS1, and a level shifter LS2.

The pixel portion 90 is connected to the data line driver 94 through a plurality of data lines 28, and the pixel portion is also connected to the scan line driver 96 through a plurality of wires. The control circuit 91 is connected to the power supply circuit 92, the image data converter circuit 93, the data line driver 94, and the scan line driver 95 through wires for controlling the respective circuits. The power supply circuit 92 supplies power of each circuit. The power supply CV for the control circuit and the image data converter circuit is connected to the control circuit 91 and the image data converter circuit 93. The power supply DV for the drivers is connected to the data line driver 94 and the scan line driver 95. The high voltage power supply HV is connected to the anode electrode 15 in the pixel portion 90. The power supply PV for the pixel portion is connected to a power supply wire in the pixel circuit. The image data converter circuit 93 is connected to an image data input terminal and the latch circuit LAT in the data line driver 94.

The voltage supplied to the control circuit 91 and the image data converter circuit 93 from the power supply CV is preferably as low as possible since they control circuit 91 and the image data converter circuit 93 conduct the logic operations, and thus, it is desirably about 3 V. The voltage supplied to the data line driver 94 and the scan line driver 95 from the power supply DV for the drivers is preferably as low as possible since the shift registers SR1 and SR2, the latch circuit LAT, and the pulse width control circuit PWC mainly conduct the logic operations, and thus, it is desirably about 3 V. However, with respect to the D/A converter DAC and the level shifters LS1 and LS2, the power supply DV for the drivers may have a configuration with which a voltage higher than the required to conduct the logic operation can be supplied since the voltage supplied is only necessary for the operations of the pixel circuit. In addition, since the power supply PV for the pixel portion also supplies a voltage required for the operation of the pixel circuit, the power supply DV for the drivers may have a configuration with which a voltage higher than the voltage required to conduct the logic operation can be supplied. The high voltage power supply HV may have a configuration with which a voltage as high as several kV to several ten kV can be supplied since the anode electrode 15 in the pixel portion 90 needs to be applied with a voltage as high as several kV to several ten kV in order to accelerate an electron emitted from an electron-emissive element.

The control circuit 91 may have a configuration which conducts an operation of generating clocks to be supplied to data line driver 94 and the scan line driver 95, an operation of generating timing pulses to be input to the shift registers SR1 and SR2, the latch circuit LAT, and the pulse width control circuit PWC, or the like. In addition, the control circuit 91 may have a configuration which conducts an operation of generating clocks to be supplied to the image data converter circuit, an operation of generating timing pulses outputting converted image data to the latch circuit LAT, or the like. The power supply circuit 92 may have a configuration where a power supply voltage can be changed and such voltage change may be controlled with the control circuit 92 in preparation for the case that a voltage required for the operation of the pixel circuit varies between different display devices, and also in order that the light-emitting element can emit light at an optimal luminance even when it is deteriorated.

When image data is input to the image data converter circuit 93, the image data converter circuit 93 converts image data into data which can be input to the data line driver 94 in accordance with the timing at which a signal is supplied from the control circuit 91, and then, outputs the data to the latch circuit. Specifically, it may be a configuration in which image data input with an analog signal is converted into a digital signal with the image converter circuit 93, and then, image data of the digital signal is output to the latch circuit LAT. The data line driver 94 operates the shift register SR1 in accordance with a clock signal and a timing pulse supplied from the control circuit 91; takes in the image data input to the latch circuit LAT with time division; and output a data voltage or a data current with an analog value to a plurality of the data lines 28 with the D/A converter DAC in accordance with the data which has been taken into the latch circuit LAT. Updating of the data voltage or the data current output to the data lines 28 may be conducted by a latch pulse supplied from the control circuit 91. In accordance with the updating of the data voltage or the data current output to the data lines 28, the scan line driver 95 operates the shift register SR2 in response to a clock signal and a timing pulse supplied from the control circuit 91 to scan a scan lines 29 sequentially. At this time, as in the case of driving the pixel circuit as shown in FIGS. 20A and 20B, a pulse width of each signal for the sequential scan operation may be of the one shown in a scan line selecting period 202, or the pulse width of each signal may be controlled by using the pulse width control circuit PWC since there is a case that the actual pulse width of each signal varies within the scan line selecting period 202. After controlling the pulse width of each signal to shape a waveform, the signal may be converted into a voltage which is necessary for the operation of the pixel circuit with the level shifters LS1 and LS2. At this time, for example, since voltages of signals which are input to a wire REF are greatly different from voltages of signals which are input to other wires, voltage conversion may be performed individually for each signal. At this time, if each signal has the same switching timing even if it has a different voltage, a structure in which the shift registers SR1 and Sr2 and a pulse width control circuit (a circuit including the shift registers SR1 and SR2 and the pulse width control circuit, are also collectively described as a timing generation circuit) may be shared, and only the level shifters LS1 and LS2 may be different. This helps to downsize the size of the circuit and reduce power consumption. Note that in FIG. 23, an example where the scan line driver 95 is disposed on one side of the pixel portion 90 is shown; however, a plurality of different scan line drivers may be employed for respective signals. In addition, the scan line driver 95 may be disposed on each side of the pixel portion 90. By disposing the scan line driver 95 in each side of the pixel portion 90, the weight balance of the display balance improves when it is mounted on an electronic device so that it is advantageous in increasing the degree of freedom for arrangement. Note that, as has already described, a transistor of the invention may be any kinds of transistors and formed over any kinds of substrates. A circuit as shown in FIG. 23 may be formed over a glass substrate, a plastic substrate, a single crystalline substrate, an SOI substrate, or any other substrates. A part of the circuits in FIG. 23 may be formed over one substrate while the other parts of the circuits in FIG. 23 may be formed over another substrate. That is, not all of the circuits in FIG. 23 are required to be formed over the same substrate. For example, in FIG. 23, the pixel portion 90 and the scan line driver 95 may be formed with transistors over a glass substrate while the data line driver 94 (or a part of it) may be formed over a single crystalline substrate, so that the IC chip thereof is connected to the glass substrate by COG (Chip On Glass). Alternatively, the IC chip may be connected to the glass substrate by TAB (Tape Automated Bonding) or a printed wiring board.

Embodiment Mode 4

In this embodiment mode, an exemplary structure of a light-emitting element of the invention is described with reference to FIGS. 3A to 3D.

Figure 3A:
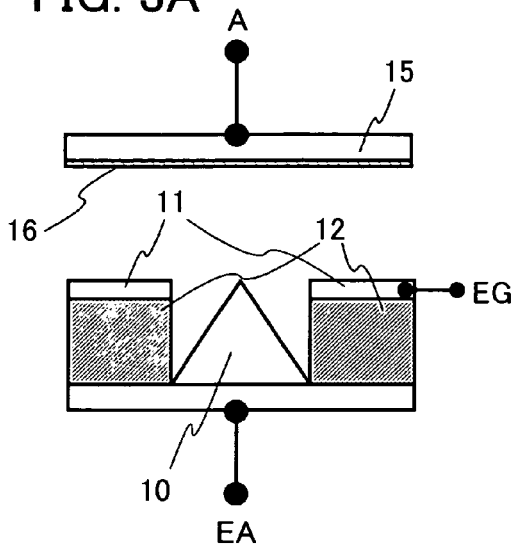
FIGS. 3A to 3D are diagrams showing exemplary light-emitting elements of a display device in the invention.

FIG. 3A is a view showing each electrode of a light-emitting element using a Spindt-type electron-emissive element corresponding to each terminal of the light-emitting element 42 in FIG. 2A. In FIG. 3A, the light-emitting element includes an anode electrode 15 which is formed over a second substrate (not shown), a light-emitting material 16 which is formed to be connected directly or indirectly to the anode electrode 15, a conular emitter 10 which is formed over a first substrate (not shown), an insulating film 12, and an extraction gate electrode 11. The terminal A of the light-emitting element 42 in FIG. 2A is connected to the anode electrode 15, the terminal EA is connected to the emitter 10, and the terminal EG is connected to the extraction gate electrode 11.

Figure 3B:
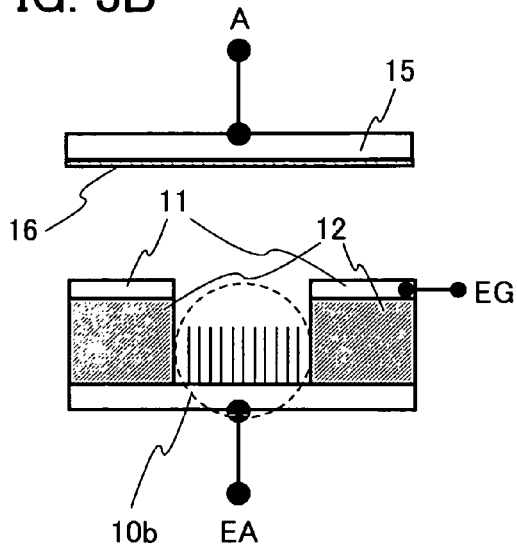

FIG. 3B is a view showing each electrode of a light-emitting element using a carbon nanotube (also described as CNT) electron-emissive element corresponding to each terminal of the light-emitting element 42 in FIG. 2A. In FIG. 3B, the light-emitting element includes an anode electrode 15 which is formed over a second substrate (not shown), a light-emitting material 16 which is formed to be connected directly or indirectly to the anode electrode 15, an acicular emitter 10*b* which is formed over a first substrate (not shown), an insulating film 12, and an extraction gate electrode 11. Note that the acicular emitter 10*b* may be formed of carbon nanotube. In addition, a plurality of the acicular emitter 10*b* may be gathered as shown in FIG. 3B. The terminal A of the light-emitting element 42 in FIG. 2A is connected to the anode electrode 15, the terminal EA is connected to the emitter 10*b*, and the terminal EG is connected to the extraction gate electrode 11.

Figure 3C:
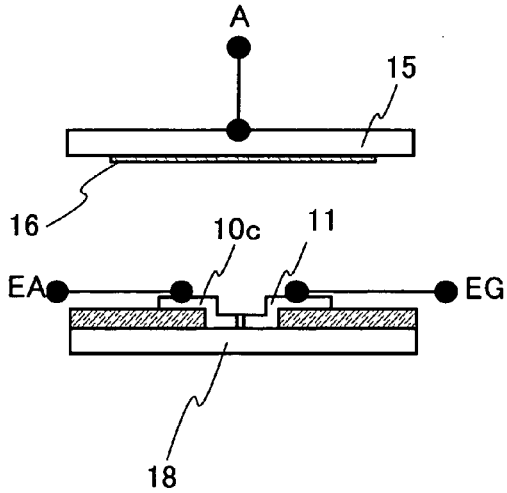

FIG. 3C is a view showing each electrode of a light-emitting element using a surface-conduction electron-emissive element corresponding to each terminal of the light-emitting element 42 in FIG. 2A. In FIG. 3C, the light-emitting element includes an anode electrode 15 which is formed over a second substrate (not shown), a light-emitting material 16 which is formed to be connected directly or indirectly to the anode electrode 15, a thin film emitter 10*c* which is formed over a first substrate 18, and an extraction gate electrode 11. The terminal A of the light-emitting element 42 in FIG. 2A is connected to the anode electrode 15, the terminal EA is connected to the emitter 10*c*, and the terminal EG is connected to the extraction gate electrode 11.

Figure 3D:
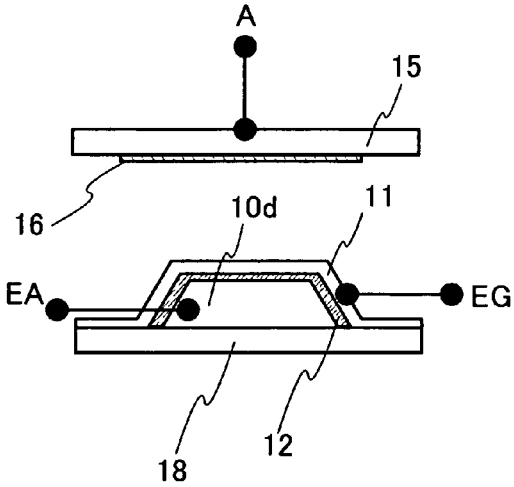

FIG. 3D is a view showing each electrode of a light-emitting element using a hot electron (also described as MIM-type) electron-emissive element corresponding to each terminal of the light-emitting element 42 in FIG. 2A. In FIG. 3D, the light-emitting element includes an anode electrode 15 which is formed over a second substrate (not shown), a light-emitting material 16 which is formed to be connected directly or indirectly to the anode electrode 15, an island-shaped emitter 10*d* which is formed over a substrate 18, an insulating film 12, and an extraction gate electrode 11. The terminal A of the light-emitting element 42 in FIG. 2A is connected to the anode electrode 15, the terminal EA is connected to the emitter 10*d*, and the terminal EG is connected to the extraction gate electrode 11.

Since the invention is related to a pixel circuit, numerous structures of the aforementioned light-emitting elements can be applied.

Embodiment Mode 5

In this embodiment mode, description is made of a top view of a pixel portion. Note that in this embodiment mode, a thin film transistor (TFT) can be employed as a transistor.

Figure 6:
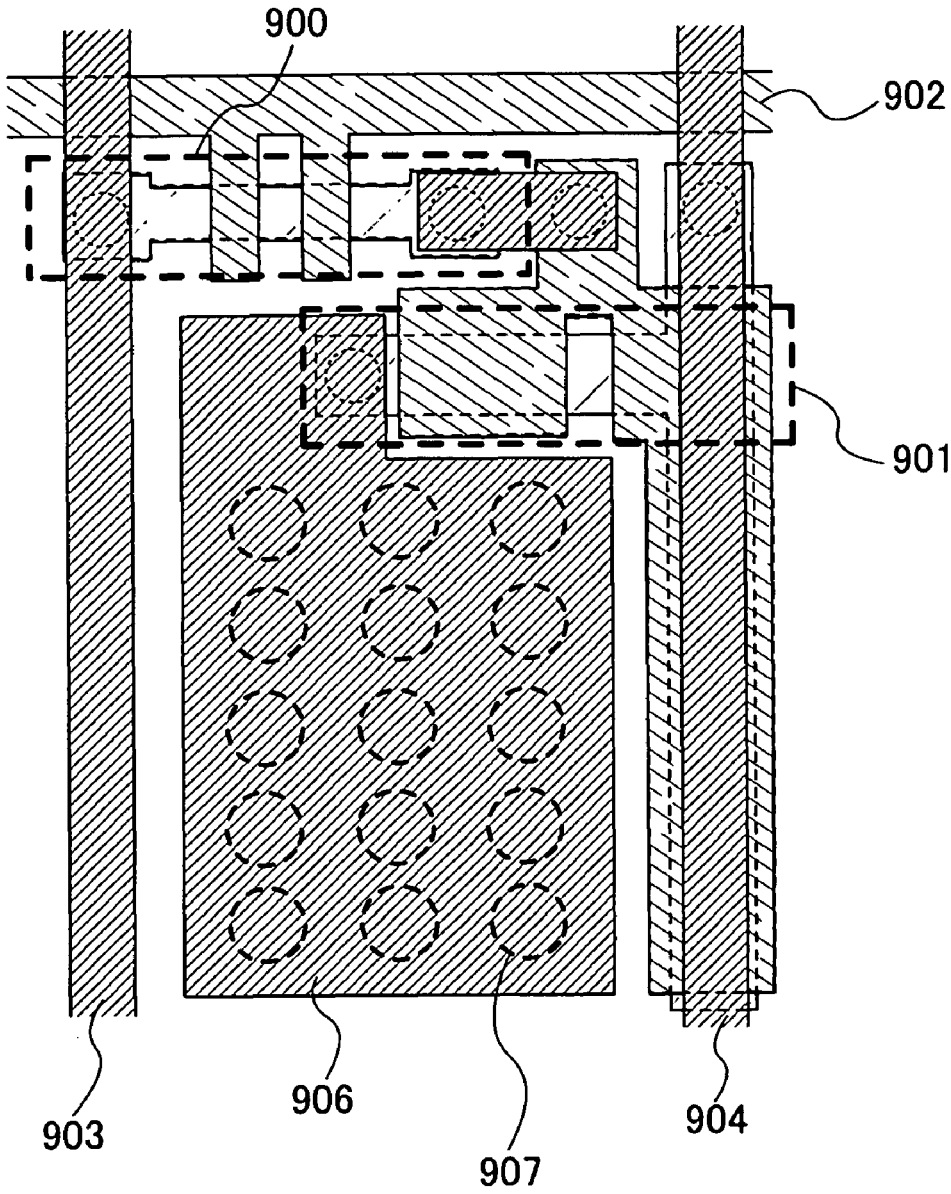
FIG. 6 is a top view of a pixel portion of a display device in the invention.

As shown in FIG. 6, a pixel portion includes a light-emitting element in a region where a scan line 902 and a signal line 903 are crossed with each other. In addition, a power supply line 904 is provided in parallel to the signal line 903. The light-emitting element includes an N-channel switching transistor 900 and an N-channel driving transistor 901, and a pixel electrode 906 which is connected to the driving transistor 901 includes a plurality of emitters 907. In this embodiment mode, description is made of a case where 3×5=15 emitters are provided; however, the number of the emitters may be either one or plural. As the number of the emitters increases, As the number of electrons generated from one pixel portion increases; and thus, reduction of power consumption can be expected. The switching transistor 900 is formed by using a transistor having a plurality of gate electrodes for one semiconductor film, namely, a multi-channel transistor; however, it may be formed by using a transistor having one gate electrode. The driving transistor 901 has a longer channel length than a channel width. By increasing the length of a channel, variation of transistors can be reduced. Since the display device of the invention conducts image display with electrons being emitted above the pixel electrode, namely, a top-emission, the degree of freedom for arrangement of transistors or the like is high. Therefore, a semiconductor film of the driving transistor 901 can be designed so that the channel length is formed to be long. One of either a source electrode or a drain electrode of the switching transistor 900 is electrically connected to a gate electrode of the driving transistor 901. Therefore, when a selecting signal is input to the scan line 902 to select the switching transistor 900, a video signal is input from the signal line 903 and a current flows between the source electrode and the drain electrode of the switching transistor 900. After that, when the gate voltage of the driving transistor becomes higher than the threshold voltage thereof, the driving transistor 901 is selected so that a current is supplied thereto from the power supply line 904. Accordingly, a voltage is applied to the emitters 907 which are formed over the pixel electrode 906, so that electrons are emitted from the emitters 907.

The scan line 902 and a gate electrode of each transistor can be formed from the same conductive film. That is, by forming a conductive film and then processing it into a predetermined shape, the scan line 902 and a gate electrode of each transistor can be obtained. Needless to say, scan line 902 and gate electrodes of each transistor can be formed from different conductive films; however, they are preferably formed from the same conductive film in order to reduce the number of processes. In addition, the signal line 903, the power supply line 904, a wire for electrically connecting and the switching transistor 900 to the driving transistor 901, and the pixel electrode 906 can be formed from the same conductive film. That is, by forming a conductive film and then processing it into a predetermined shape, the signal line 903, the power supply line 904, the wire for electrically connecting the switching transistor 900 to the driving transistor 901, and the pixel electrode 906 can be obtained. Needless to say, the signal line 903, the power supply line 904, the wire for electrically connecting the switching transistor 900 to the driving transistor 901, and the pixel electrode 906 can be formed from different conductive films; however, they are preferably formed from the same conductive film in order to reduce the number of processes. These conductive films can be formed by using known materials. In order to reduce power consumption, materials having a low ohmic value is preferably employed. Further, in order to prevent a short-circuit between the conductive films, an insulating film is interposed therebetween. The insulating film can be formed of either an inorganic material or an organic material.

With such a pixel portion, an active matrix FED device can be provided.

Embodiment Mode 6

In this embodiment mode, description is made of a top view of a pixel portion different from the aforementioned embodiment mode. Note that in this embodiment mode, a thin film transistor (TFT) can be employed as a transistor.

Figure 7:
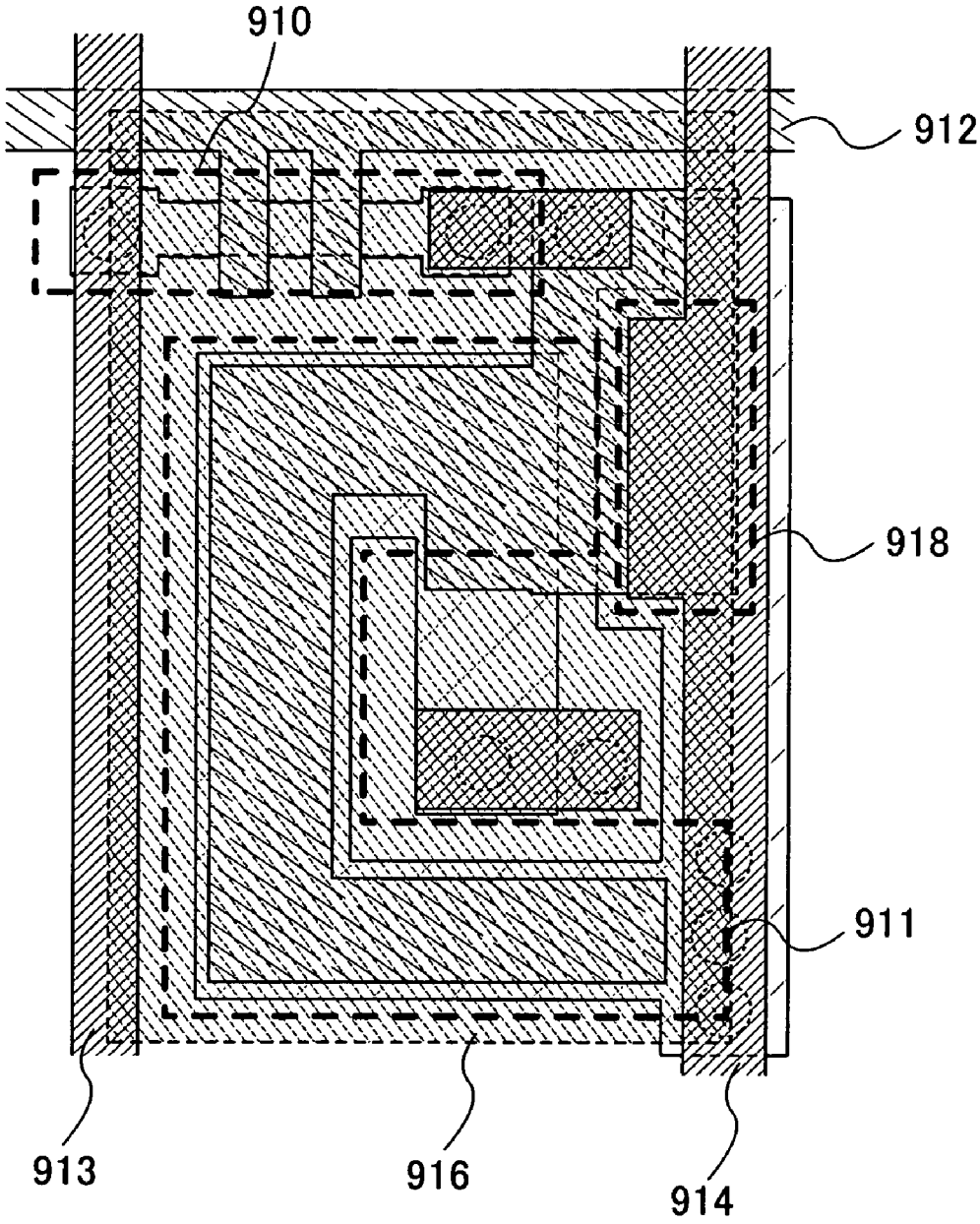
FIG. 7 is a top view of a pixel portion of a display device in the invention.

FIG. 7 differs from FIG. 6 in that the shape of a driving transistor 911 is rectangular and the channel length thereof is longer than that of the aforementioned embodiment mode as shown in FIG. 7. In addition, FIG. 7 differs from FIG. 6 in that a pixel electrode 916 is formed of a conductive film different from a conductive film of the signal line 903, the power supply line 904, and a wire for electrically connecting the switching transistor 900 to the driving transistor 901. Since the pixel electrode 916 is formed of the different conductive film, the area dimension of the pixel electrode 916 is enlarged. That is, the pixel electrode 916 is provided so as not to be in contact with a pixel electrode of an adjacent pixel since it is a top-emission display device; and thus, the pixel electrode 916 can be formed in a region which overlaps a scan line 912, a signal line 913, and a power supply line 914. Either a single emitter or a plurality of emitters can be formed in the pixel electrode 916. In addition, a part of the power supply line 914 is to be wider in order to form a capacitor 918. The capacitor is formed from the power supply line 914, a part of a semiconductor film of the driving transistor 911, and an insulating film provided therebetween. In addition, a switching transistor 910, the scan line 912, and the signal line 913 are similar to the aforementioned embodiment mode.

With such a pixel portion, an active matrix FED device can be provided.

Embodiment Mode 7

In this embodiment mode, description is made of a top view of a pixel portion different from the aforementioned embodiment modes. Note that in this embodiment mode, a thin film transistor (TFT) can be employed as a transistor.

Figure 8:
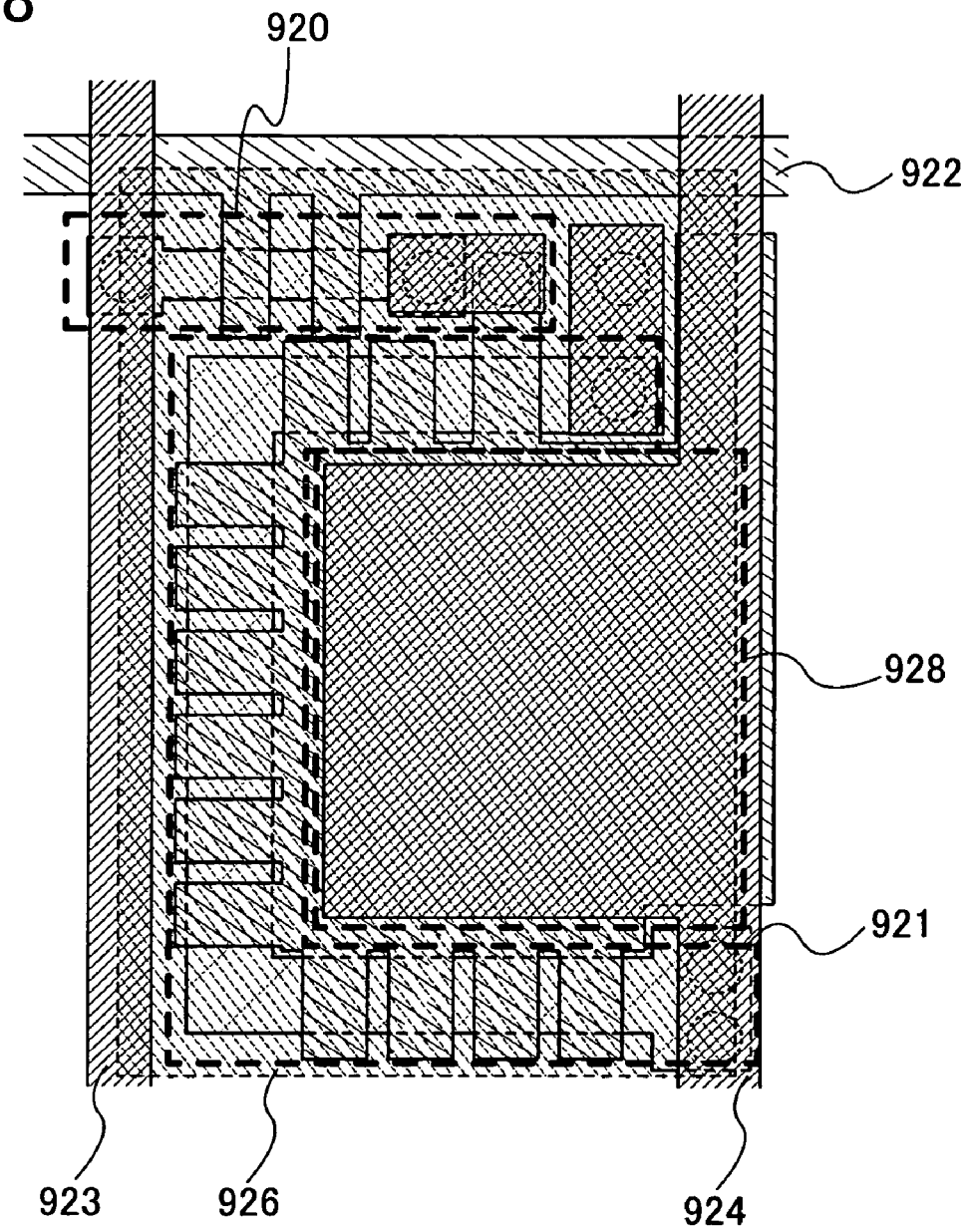
FIG. 8 is a top view of a pixel portion of a display device in the invention.

FIG. 8 differs from the aforementioned embodiment mode in that the shape of a driving transistor 921 is rectangular and the transistor is a multi-channel transistor having a plurality of gate electrodes as shown in FIG. 8. A plurality of gate electrodes are provided so as to overlap a semiconductor film processed into rectangular shape, and a plurality of gate electrodes are provided in comb shapes. With the gate electrodes which are provided in comb shapes in this manner, the multi-channel driving transistor 921 can be formed efficiently. In addition, a part of a power supply line 924 is enlarged in order to form a capacitor 928. Unlike the aforementioned embodiment modes, capacity of the capacitor 921 can be increased since it is provided over a depressed portion of the rectangular driving transistor 921. The capacitor 928 is formed from the power supply line 924, a part of a semiconductor film of the driving transistor 921, and an insulating film provided therebetween. Such arrangement can be supplied to the pixel of the aforementioned embodiment mode having a rectangular driving transistor. In addition, unlike the aforementioned embodiment mode, a pixel electrode 926 is formed of a conductive film different from a conductive film of the signal line 903, the power supply line 904, and a wire for electrically connecting the switching transistor 900 to the driving transistor 901. Since the pixel electrode 926 is formed of the different conductive film, the area dimension of the pixel electrode 926 is enlarged. That is, the pixel electrode 926 is provided so as not to be in contact with a pixel electrode of an adjacent pixel since it is a top-emission display device; and thus, the pixel electrode 926 can be formed in a region which overlaps a scan line 922, a signal line 923, and the power supply line 924. Either a single emitter or a plurality of emitters can be formed in the pixel electrode 926. In addition, a switching transistor 920, the scan line 922, and the signal line 923 are similar to the aforementioned embodiment mode.

With such a pixel portion, an active matrix FED device can be provided.

Embodiment Mode 8

In this embodiment mode, description is made of a top view of a surface-conduction pixel portion including surface-conduction electron emissive elements, which is different from the aforementioned embodiment modes. Note that in this embodiment mode, a thin film transistor (TFT) can be employed as a transistor.

Figure 9:
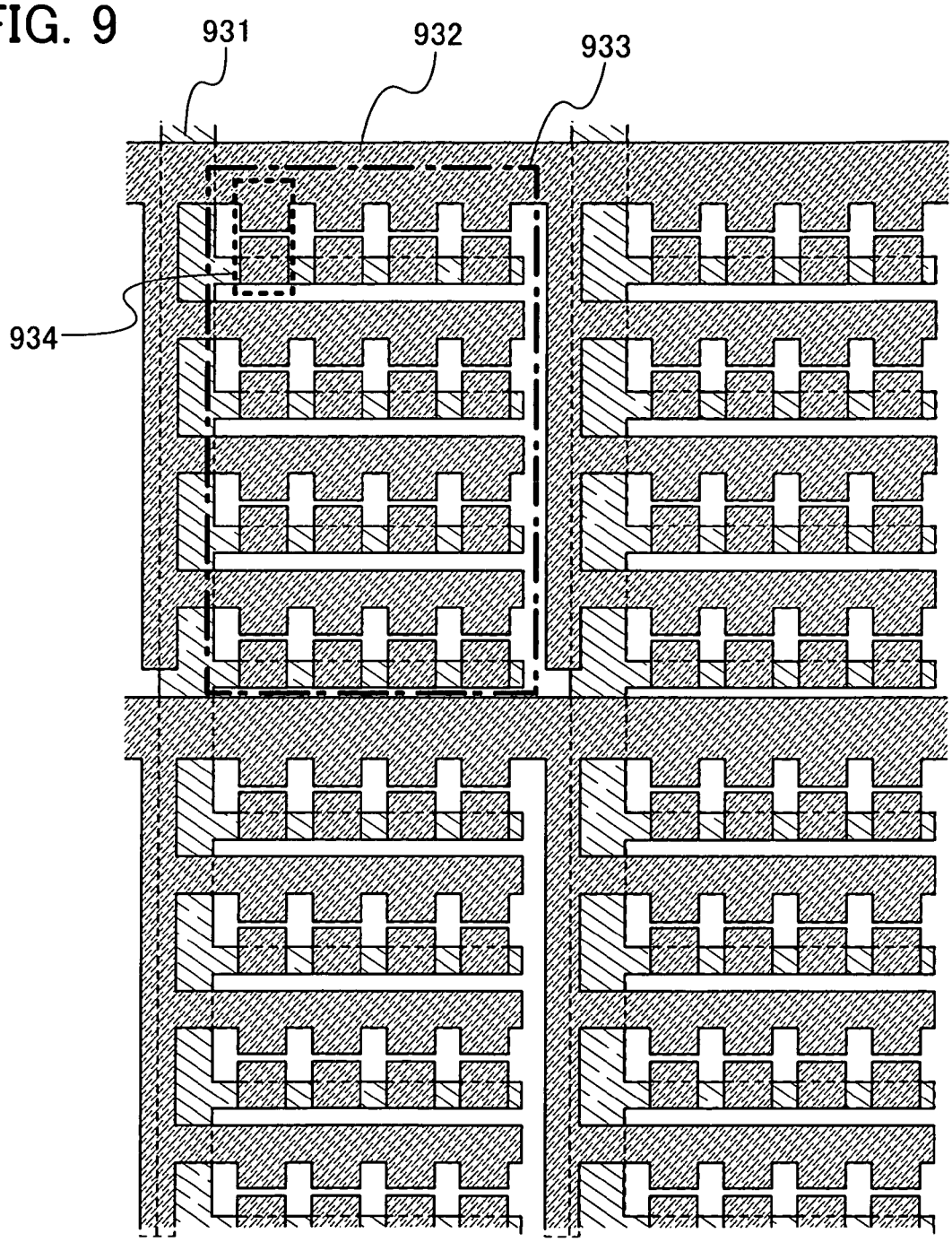
FIG. 9 is a top view of a pixel portion of a display device in the invention.

As shown in FIG. 9, a pixel portion 933 including a first electrode 931 and a second electrode 932 which are crossed with each other has an emitter 934 having a pair of electrodes. Description is made of a case where 4×4=16 emitters are provided to the emitter 934; however, the invention is not limited to this. The number of the emitters 934 may be either one or plural. The more the number of the emitters increases, the more the number of electrons generated from one pixel portion increases; and thus, reduction of power consumption can be expected. The first electrode 931 is processed into a comb shape in the pixel portion 933 in order to form a plurality of emitters, and connected to one of electrodes of each emitter 934. In addition, the second electrode 932 has a comb shape, and is disposed at even intervals while at the same time in parallel to the first electrode 931 to be connected to the other electrode of the emitter 934. Note that the second electrode 932 and the other electrode of the emitter 934 can be formed from the same conductive film. Needless to say, another electrode of the emitter 934 can be formed from the same conductive film. The first electrode 931 and the second electrode 932 can be formed by using known conductive materials. In order to reduce power consumption, a material having a low ohmic value is preferably employed. Although not shown in the drawing, the pixel portion 933 includes thin film transistors which form a switching transistor and a driving transistor. The driving transistor is electrically connected to the first electrode 931, and selection of the first electrode 931 is controlled by on/off of the driving transistor. When the first electrode 931 is selected, an electron is emitted from one of electrodes of the emitter 934 connected to the driving transistor.

With such a pixel portion, an active matrix FED device can be provided.

Embodiment Mode 9

In this embodiment mode, description is made of a method for manufacturing an active matrix FED device.

Figure 10A:
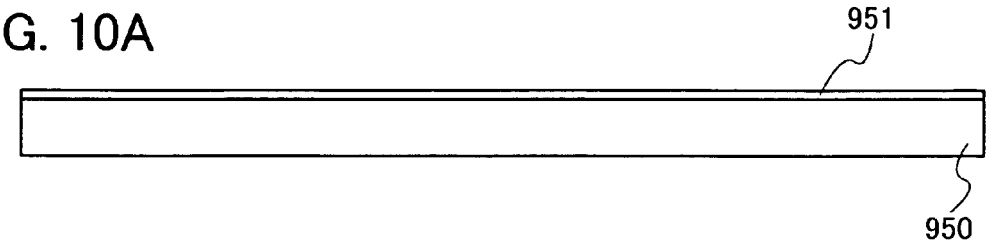
FIGS. 10A to 10E are diagrams showing a manufacturing process of a display device in the invention.

As shown in FIG. 10A, a substrate having an insulating surface (hereinafter described as insulating substrate) 950 is prepared. A glass substrate, a quartz substrate, a plastic substrate, and the like can be employed as the insulating substrate 950. For example, by employing the plastic substrate, a highly flexible and lightweight liquid crystal display device can be provided. In addition, by thinning the glass substrate by polishing or the like, a thin liquid crystal display device can be provided. Furthermore, a conductive substrate made of metal or the like or a semiconductor substrate made of silicon, over which an insulating layer is formed, can be employed as the insulating substrate 950.

An insulating film which functions as a base film (hereinafter described as a base insulating film) 951 is formed over the insulating substrate 950. With the base insulating film 951, invasion of impurities such as alkaline metal from the insulating substrate 950 can be prevented. Silicon oxide or silicon nitride can be employed as the base insulating film 951, and with such a material, invasion of impurities can be prevented more effectively. In addition, the base insulating film 951 can be formed by CVD or sputtering.

Figure 10B:
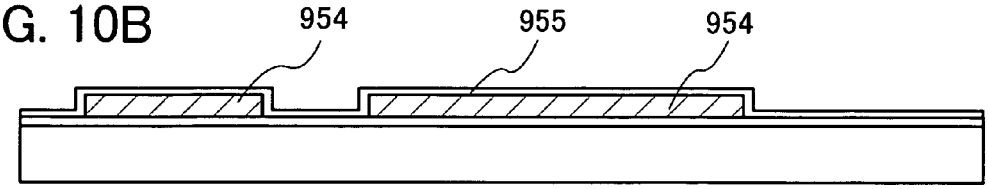

As shown in FIG. 10B, a semiconductor film is formed over the base insulating film 951 to be processed into an island-shape semiconductor film 954 having a predetermined shape. The semiconductor film 954 can be formed by using a silicon material or a mixed material of silicon and germanium. In addition, the semiconductor film 954 can be formed by using an amorphous semiconductor film, a microcrystalline semiconductor film, or a crystalline semiconductor film. By using a crystalline semiconductor film, it can be suitable for a switching element of a pixel portion since it has excellent electric characteristics. In addition, in the case of forming the pixel portion over the same substrate as a driver circuit portion, the microcrystalline semiconductor film can be used as a switching element of the driver circuit portion.

A gate insulating film 955 is formed so as to cover the semiconductor film 954. The gate insulating film 955 can be formed of silicon oxide or silicon nitride, and can have a single-layer structure or a stacked-layer structure. Such a gate insulating film 955 can be formed by CVD or sputtering.

Figure 10C:
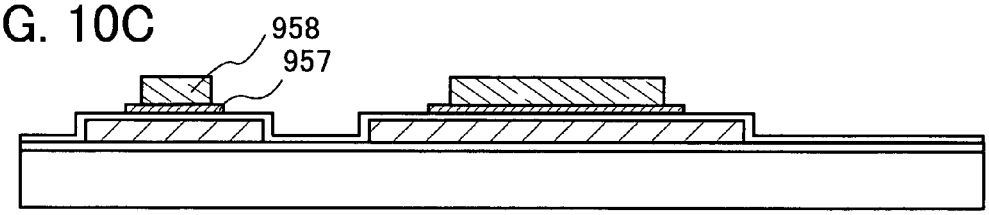

As shown in FIG. 10C, a gate electrode is formed over the semiconductor film 954 with the gate insulating film 955 interposed therebetween. The gate electrode can have a single-layer structure or a stacked-layer structure. In this embodiment mode, the gate electrode is formed to have a stacked-layer structure having a first conductive film 957 and a second conductive film 958. The first conductive film 957 and the second conductive film 958 can be formed of an element selected from tantalum (Ta), tungsten (W), titanium (Ti), molybdenum (Mo), aluminum (Al), chromium (Cr), or silver (Ag), or a nitride material which includes these elements as a main component. By employing a stacked-layer structure, the gate electrode can have various different functions. For example, the first conductive film 957 can have a function of an etching stopper while the second conductive film 958 can have a function of decreasing electric resistance.

Figure 10D:
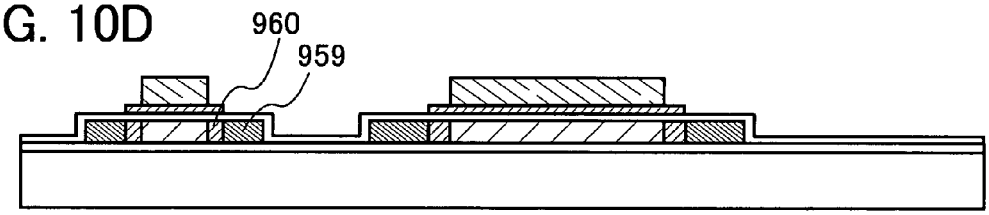

As shown in FIG. 10D, the semiconductor film 954 is doped with impurities in a self-aligned manner by using the gate electrode. The semiconductor film which is below the first conductive film 957 is also doped with impurities since the first conductive film 957 is thin, and thus a low concentration impurity region 960 and a high concentration impurity region 959 can be formed. A structure of a thin film transistor having the low concentration impurity region 960 in this manner is called an LDD (Lightly Doped Drain) structure, and further, a structure where the low concentration impurity region 960 overlaps the gate electrode is called a GOLD (Gate-drain Overlapped LDD) structure. Such a thin film transistor having the low concentration impurity region 960 can prevent a short channel effect which would be generated as the gate length becomes shorter.

Figure 10E:
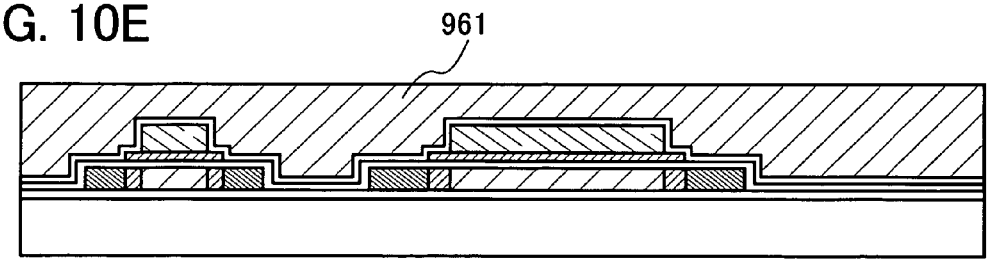

As shown in FIG. 10E, an insulating film 961 is formed so as to cover the gate electrode, the semiconductor film, and the like. The insulating film 961 can be formed of either an inorganic material or an organic material. As the inorganic material, silicon oxide or silicon nitride can be employed, for example. The organic material is formed of an organic compound such as an acrylic resin, a polyimide resin, a melamine resin, a polyester resin, a polycarbonate resin, a phenol resin, an epoxy resin, polyacetal, polyether, polyurethane, polyamide (nylon), a furan resin, or a diallyl phthalate resin; an inorganic siloxane polymer including a Si—O—Si bond among compounds made of silicon, oxygen, and hydrogen which is formed by using a siloxane polymer-based material as a starting material and is typified by silica glass; an organic siloxane polymer in which hydrogen bonded to silicon is substituted by an organic group such as methyl or phenyl, typified by an alkylsiloxane polymer, an alkylsilsesquioxane polymer, a silsesquioxane hydride polymer, an alkylsilsesquioxane hydride polymer, and the like. Such an organic material can be formed by a coating method, a droplet discharge method, or the like. In addition, the insulating film 961 can have either a single-layer structure or a stacked-layer structure. For example, in order to improve planarity, an insulating film made of an organic material is formed so that an insulating film made of an inorganic material which can prevent invasion of impurities can be formed thereover.

Figure 11A:
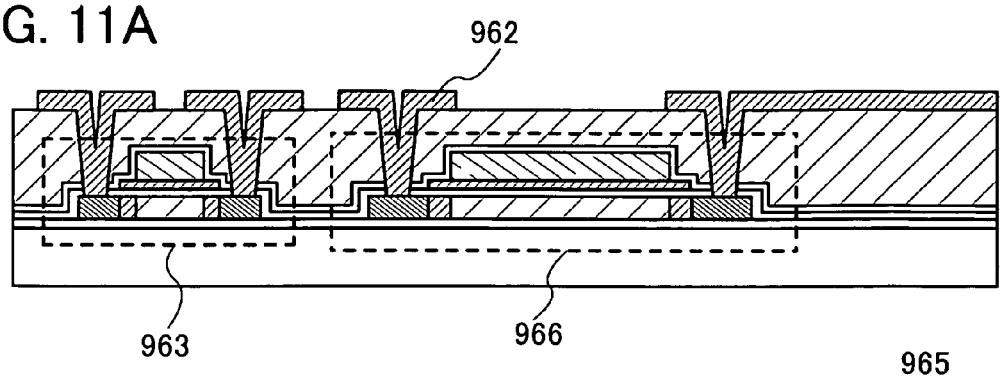
FIGS. 11A to 11D are diagrams showing a manufacturing process of a display device in the invention.

As shown in FIG. 11A, an opening portion is formed in the insulating film 961 to form a wire 962. The opening portion can be formed above the high concentration impurity region 959 by dry etching or wet etching. That is, the wire 962 functions as a source electrode or a drain electrode which is connected to the impurity region. The wire 962 can be formed of an element selected from tantalum (Ta), tungsten (W), titanium (Ti), molybdenum (Mo), aluminum (Al), chromium (Cr), silver (Ag), or silicon (Si), or an alloy material which includes these elements as a main component. The wire 962 can have either a single-layer structure or a stacked-layer structure. For example, the wire 962 can employ a stacked-layer structure which is obtained by stacking a Ti film, an alloy film of Al and Si, and a Ti film. Wire resistance can be reduced with the alloy film of Al and Si, and hillock caused by heating can be prevented with Si. In this manner, a first thin film transistor 963 and a second thin film transistor 966 can be formed. The first thin film transistor 963 functions as a switching transistor while the second thin film transistor 966 functions as a driving transistor. Since an emitter is formed over one of either a source electrode or a drain electrode of the second thin film transistor 966, it is formed to have a large area dimension. In this embodiment mode, the first thin film transistor 963 and the second thin film transistor 966 are formed as N-channel thin film transistors; however, both of the transistors may be P-channel transistors, or one of them may be a P-channel transistor and the other of them may be an N-channel transistor.

Figure 11B:
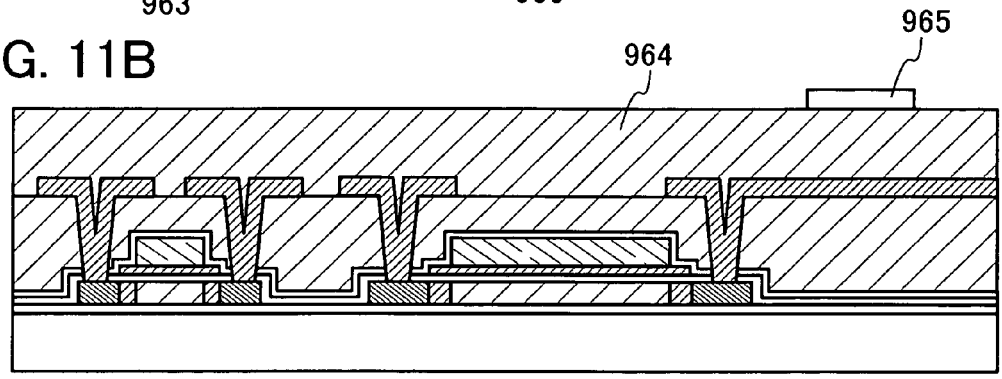

As shown in FIG. 11B, an etching layer 964 is formed so as to cover the thin film transistors 963 and 966. The etching layer 964 can be formed of either an inorganic material or an organic material. As the inorganic material, a silicon material such as silicon oxide or silicon nitride, or a mixed material of silicon and germanium can be employed. The organic material is formed of an organic compound such as an acrylic resin, a polyimide resin, a melamine resin, a polyester resin, a polycarbonate resin, a phenol resin, an epoxy resin, polyacetal, polyether, polyurethane, polyamide (nylon), a furan resin, or a diallyl phthalate resin; an inorganic siloxane polymer including a Si—O—Si bond among compounds made of silicon, oxygen, and hydrogen which is formed by using a siloxane polymer-based material as a starting material and typified by silica glass, or an organic siloxane polymer in which hydrogen bonded to silicon is substituted by an organic group such as methyl or phenyl, typified by an alkylsiloxane polymer, an alkylsilsesquioxane polymer, a silsesquioxane hydride polymer, an alkylsilsesquioxane hydride polymer; and the like. Such an organic material can be formed by a coating method, a droplet discharge method, or the like. In addition, the etching layer 964 can be formed with any materials as long as they can have a selection ratio to the wire 962 and the insulating film 961 since the etching layer 964 is etched in a later process, and etching can be simplified if the etching layer 964 is formed of a silicon material. After that, a mask 965 is selectively formed over the etching layer 964 so that it partially overlaps one of either the source electrode or the drain electrode of the second thin film transistor 966. The mask 965 can be formed of either an inorganic material or an organic material. In the case of using an organic material, a resist material or an acrylic material may be employed.

Figure 11C:
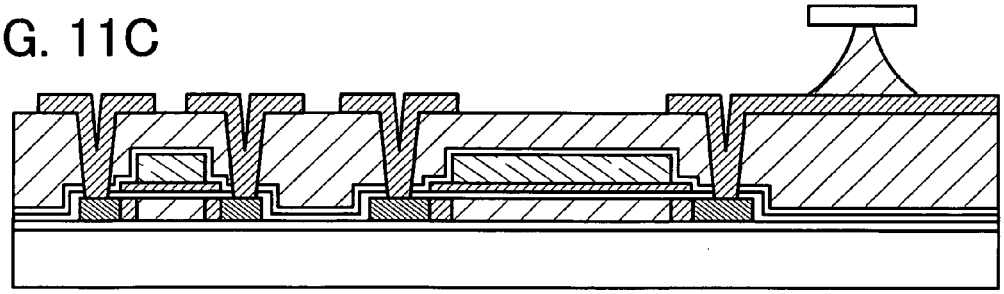

After that, the etching layer 964 is etched by using the mask 965 as shown in FIG. 11C. At this time, either dry etching or wet etching can be employed. Isotropic etching is preferably applied since the etching layer 964 is etched to the degree that a portion below the mask 965 is removed. In addition, etching may be conducted more than once. Accordingly, the time for etching can be shortened.

Figure 11D:
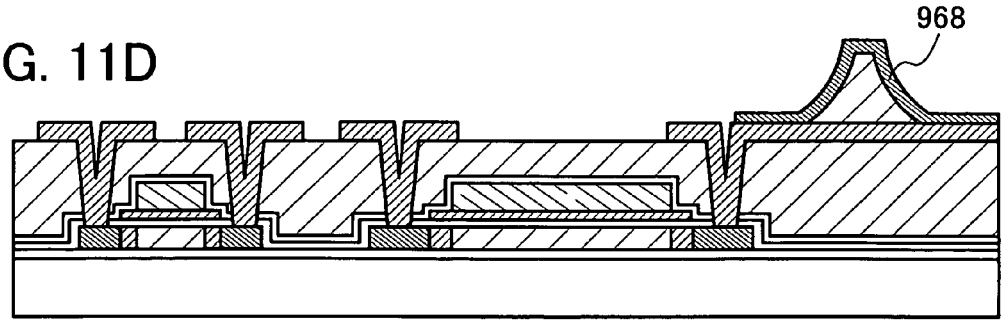

When the mask 965 is removed, as shown in FIG. 11D the etching layer 964 has a tapered edge. That is, the etching layer 964 has a cone shape typified by a circular cone shape and a quadrangular pyramid. A conductive film 968 is formed so as to cover the etching layer 964 having the cone shape. The conductive film 968 can be formed of an element selected from tantalum (Ta), tungsten (W), titanium (Ti), molybdenum (Mo), aluminum (Al), chromium (Cr), or silver (Ag), or an alloy material which includes these elements as a main component. The conductive film 968 is selectively formed so as to cover the etching layer 964 having the cone shape.

Figure 12A:
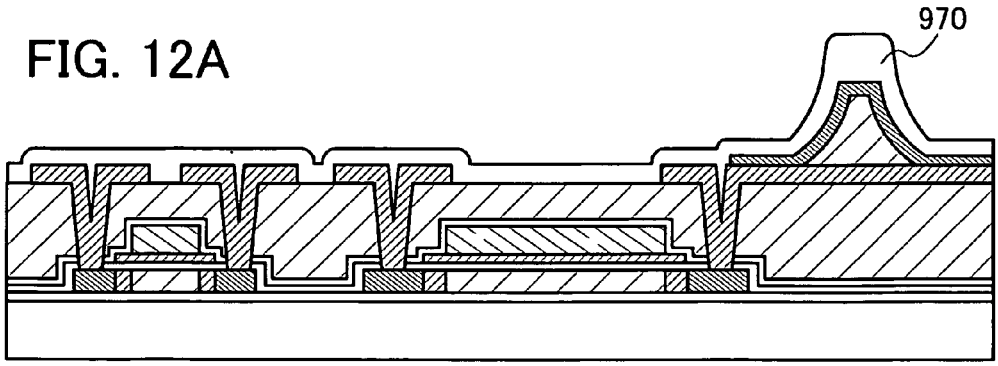
FIGS. 12A and 12C are diagrams showing a manufacturing process of a display device in the invention.

As shown in FIG. 12A, an insulating film 970 is formed so as to cover the wire 962 and the conductive film 968. The insulating film 970 can be formed of the same material or by the same method for manufacturing as the insulating film 961. The insulating film 970 may be formed of an inorganic material since it is preferably formed to go along with the shape of the etching layer 964 having the cone shape. Such an insulating film 970 can be formed by CVD or sputtering.

Figure 12B:
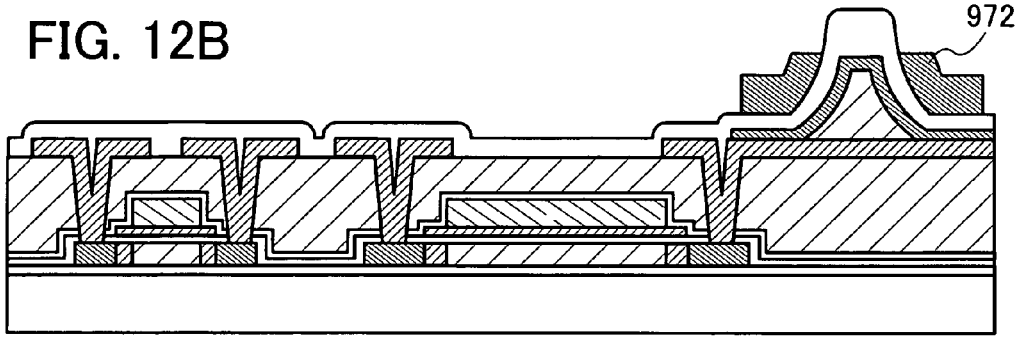

A conductive film 972 is formed around the etching layer 964 having the cone shape as shown in FIG. 12B. The conductive film 972 can be formed of an element selected from tantalum (Ta), tungsten (W), titanium (Ti), molybdenum (Mo), aluminum (Al), chromium (Cr), or silver (Ag), or an alloy material which includes these elements as a main component. The conductive film 972 can be formed by CVD or sputtering. The conductive film 972 can function as an extraction gate electrode.

Figure 12C:
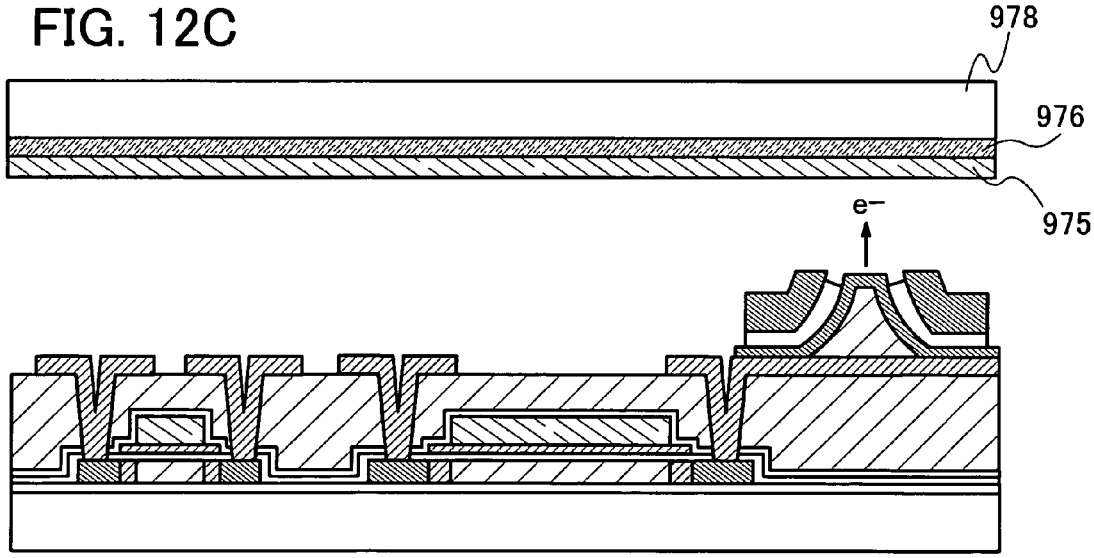

As shown in FIG. 12C, a substrate (hereinafter described as an opposite substrate) 978 is attached so as to be opposed to the insulating substrate 950. The opposite substrate 978 includes an anode electrode 976 and a fluorescent material 975. Space which is formed by attachment of the opposite substrate 978 may be filled with inert gas. A spacer is preferably formed in order to hold a gap between the insulating substrate 950 and the opposite substrate 978. A columnar spacer or a spherical spacer can be employed as the spacer. The anode electrode 976 needs to have light-transmitting properties, and can employ a light-transmitting conductive material such as ITO, zinc oxide (ZnO), indium zinc oxide (IZO), or zinc oxide to which gallium is added (GZO). Further, indium tin oxide having silicon oxide (hereinafter described as ITSO), or ITO to which zinc oxide (ZnO) is mixed can be employed as well. The fluorescent material 975 may be formed separately for each of red (R), green (G), and blue (B).

A display device which is formed in this manner can display images with electrons which are emitted from the conductive film 968 having a cone shape to be pulled toward to the anode electrode 976, and then pass through the fluorescent material 975.

In this manner, an active matrix FED device can be provided.

Embodiment Mode 10

In this embodiment mode, description is made of a method for manufacturing an active matrix FED device different from the aforementioned embodiment mode.

Figure 13A:
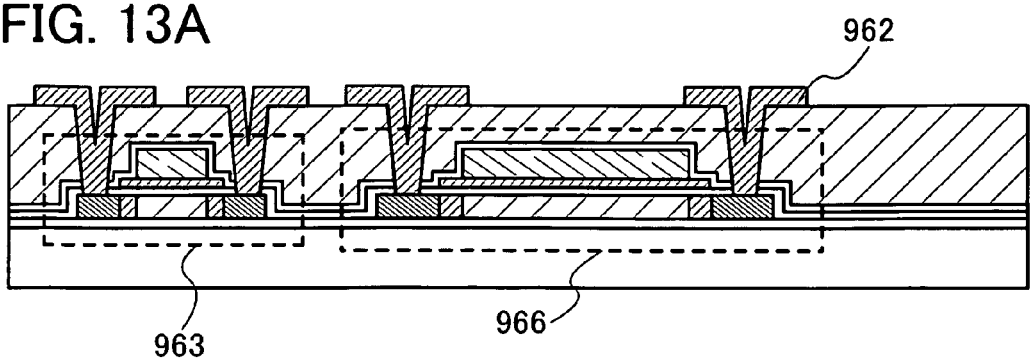
FIGS. 13A to 13C are diagrams showing a manufacturing process of a display device in the invention.
Figure 13B:
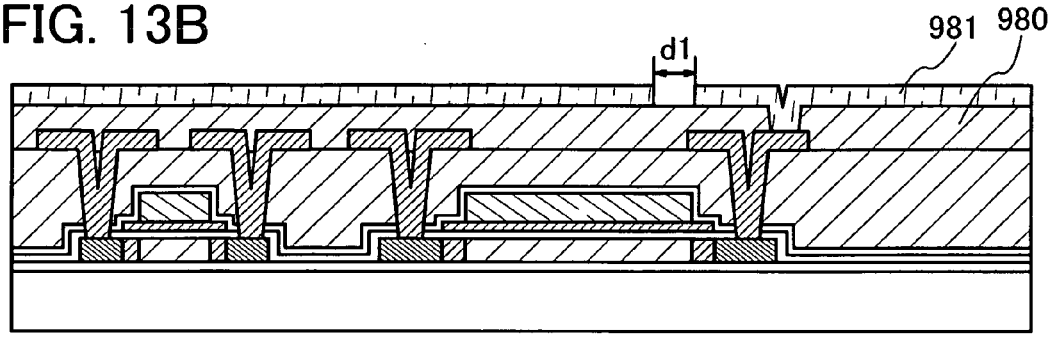

As shown in FIG. 13A, the wire 962 shown FIG. 11A is formed through the process in the aforementioned mode. At this time, the wire 962 which is connected to the second thin film transistor 966 may be processed so as to have a smaller area dimension than the one shown in FIG. 11A. In order to stack an insulating film 980 over the insulating film 961 as shown in FIG. 13B. That is, by stacking the insulating film 980, an electrode or the like can be formed by effectively utilizing an insulating surface of an uppermost face. The insulating film 980 can be formed of the same material or by the same method for manufacturing as the insulating film 961.

The insulating film 980 is preferably formed of an organic material in order to improve planarity. An opening portion is formed to the insulating film 980 to form a conductive film 981 so as to be electrically connected to the wire 962. The conductive film 981 can be formed of an element selected from tantalum (Ta), tungsten (W), titanium (Ti), molybdenum (Mo), aluminum (Al), chromium (Cr), or silver (Ag), or an alloy material which includes these elements as a main component. An opening portion having a width d1 is formed in a predetermined position of the conductive film 981. The width d1 is preferably as small as possible so that power consumption can be reduced.

Figure 13C:
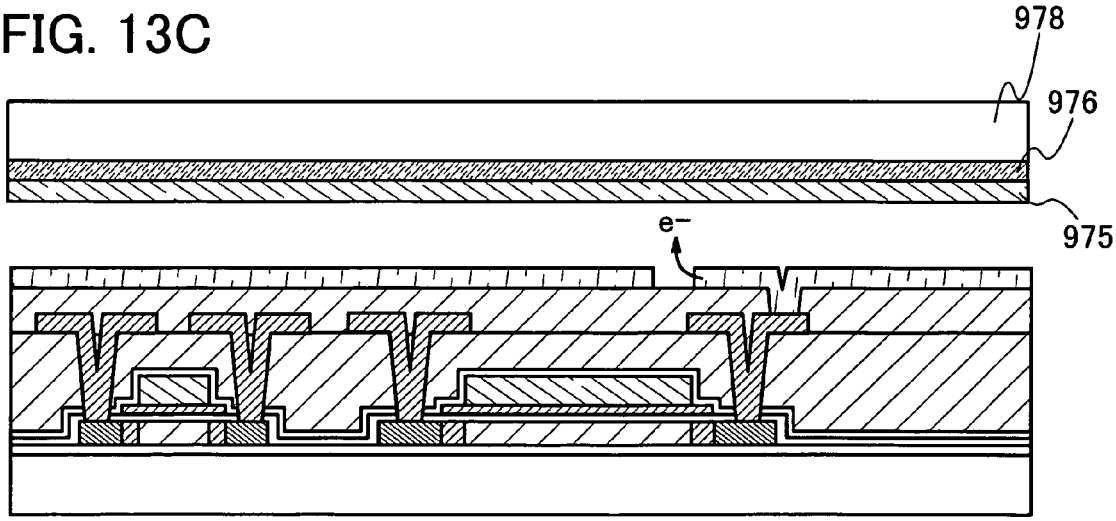
Figure 14:
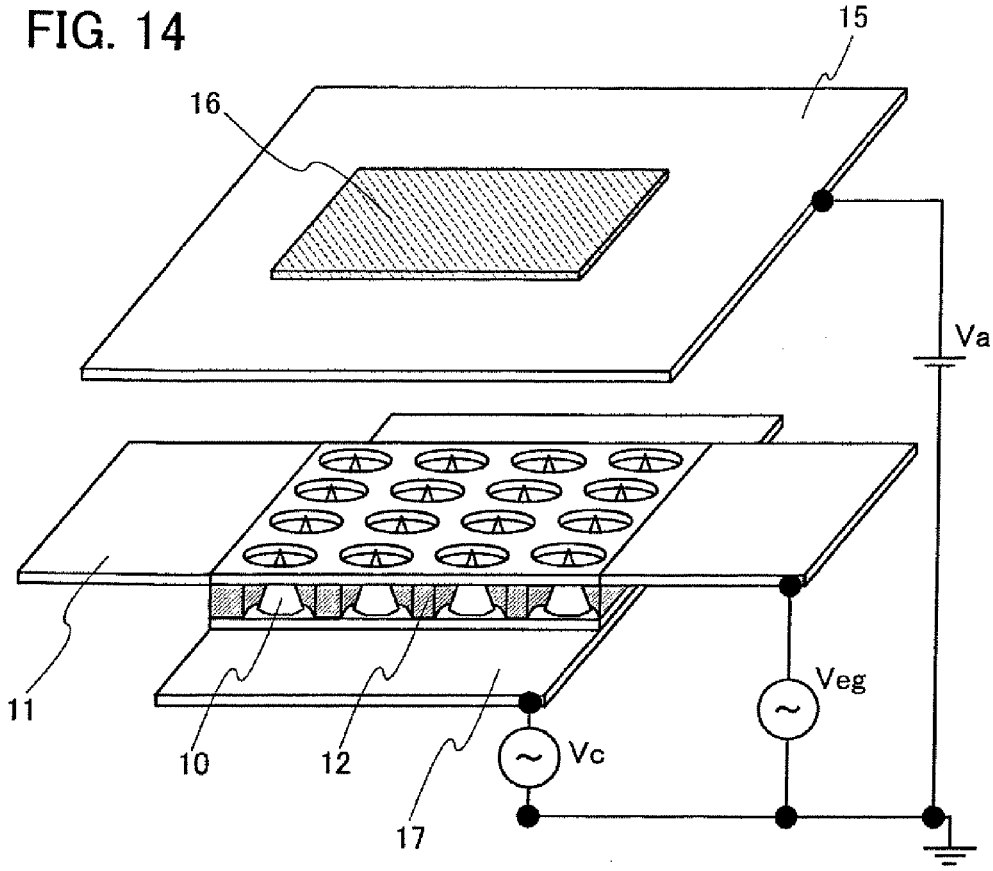
FIG. 14 is a diagram showing an FED element of a conventional active matrix display device.
Figure 15:
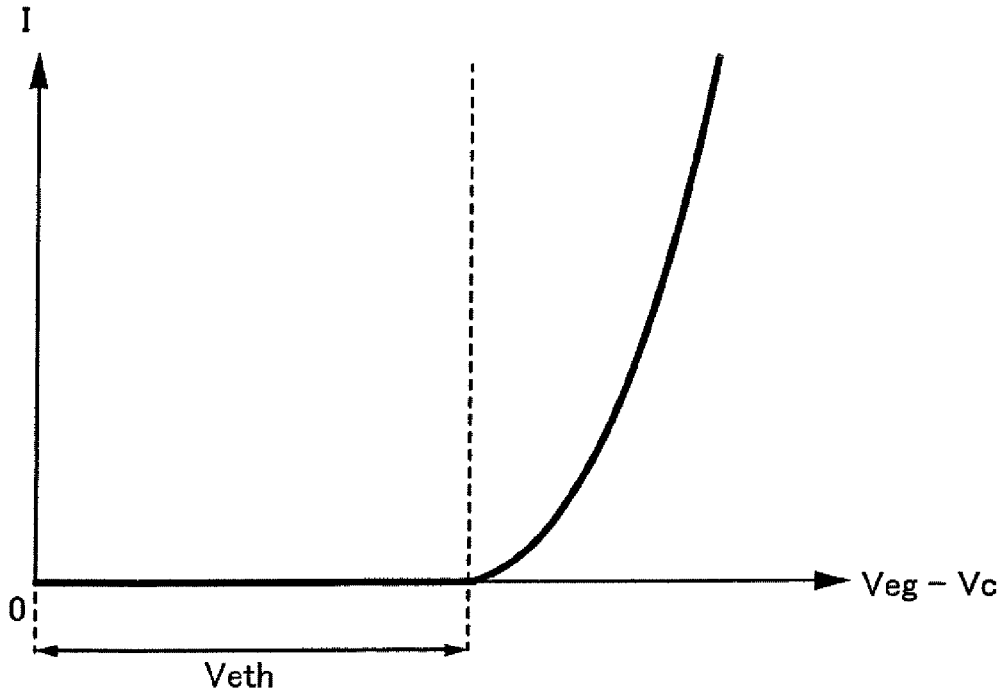
FIG. 15 is a diagram showing an operating point of an FED element of a conventional active matrix display device.
Figure 16:
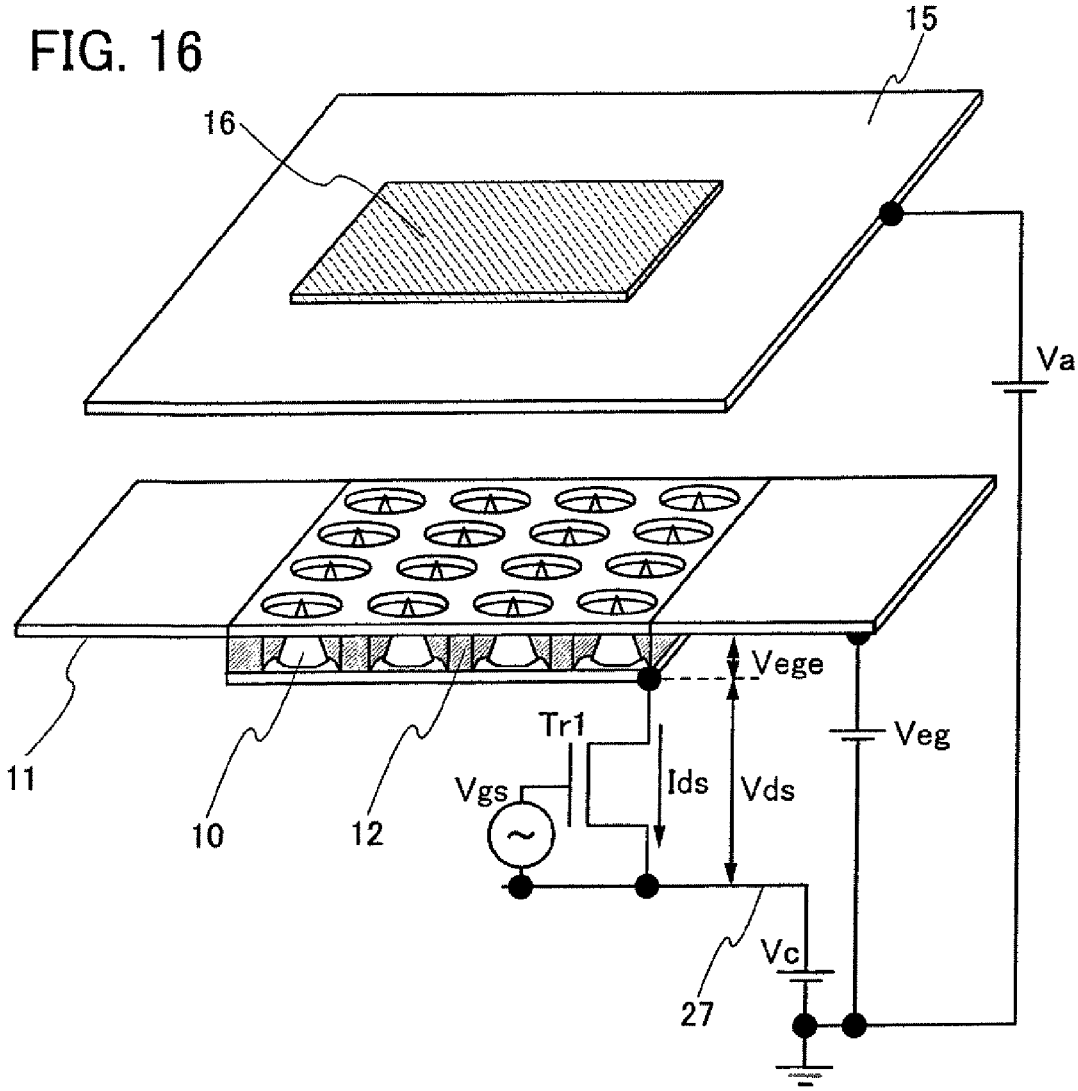
FIG. 16 is a diagram showing an FED element of a conventional active matrix display device.
Figure 17A:
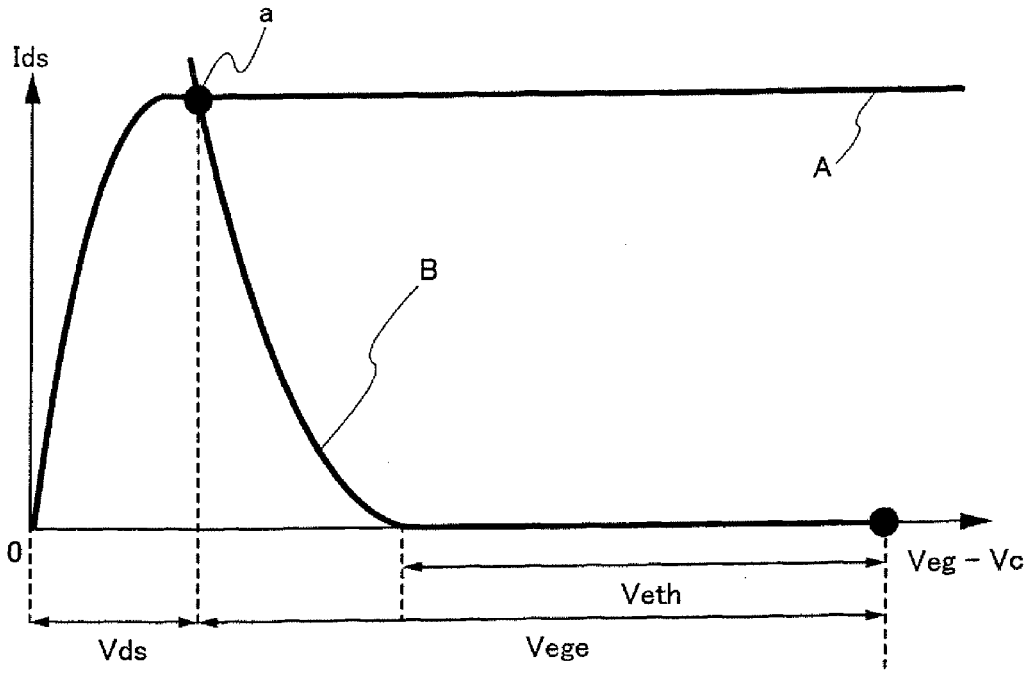
FIGS. 17A and 17B are diagrams showing operating points of an FED element of a conventional active matrix display device.
Figure 17B:
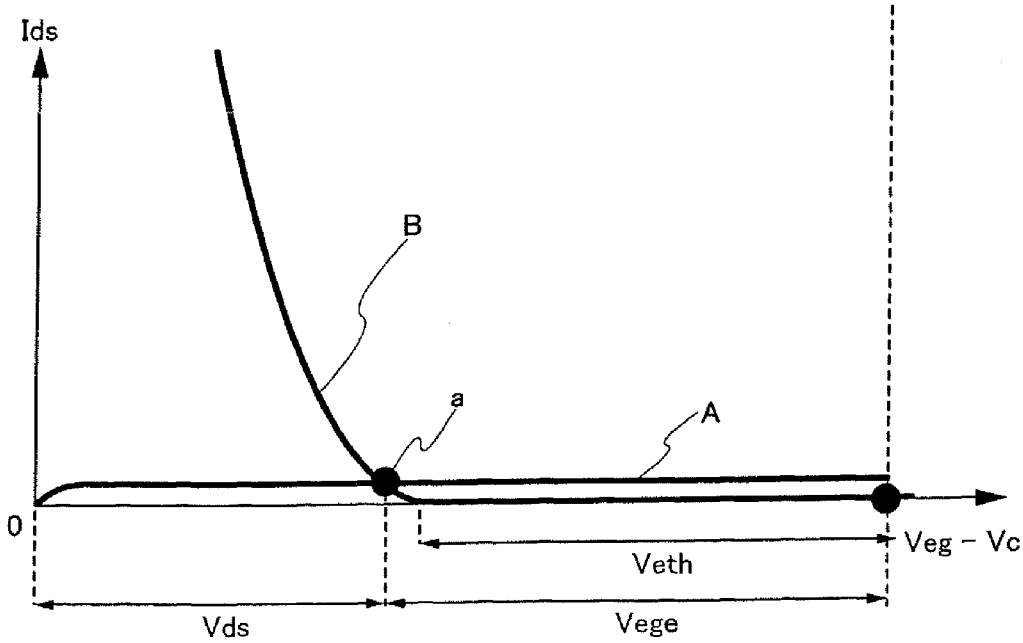
PRIOR ART FIG. 17B
Figure 18:
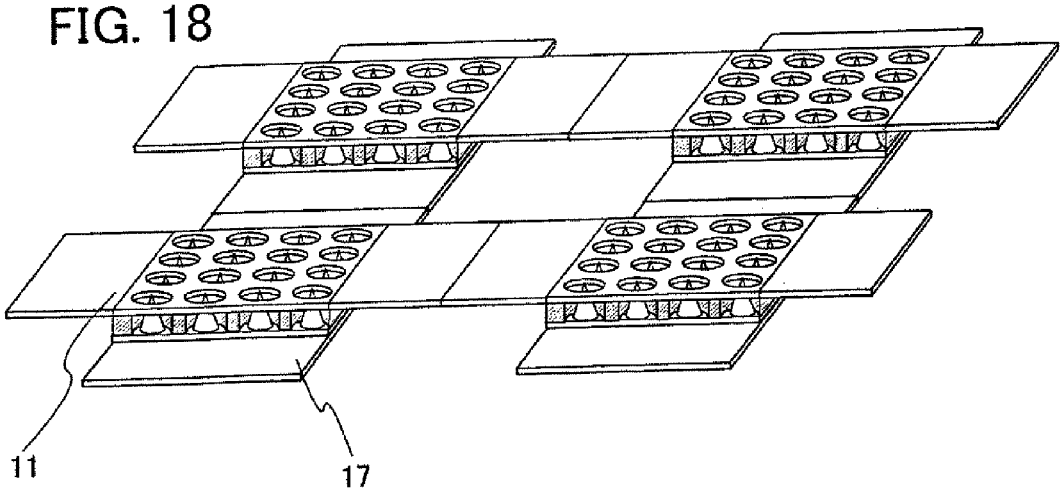
FIG. 18 is a diagram showing a display region structure of a conventional passive matrix FED.
Figure 19A:
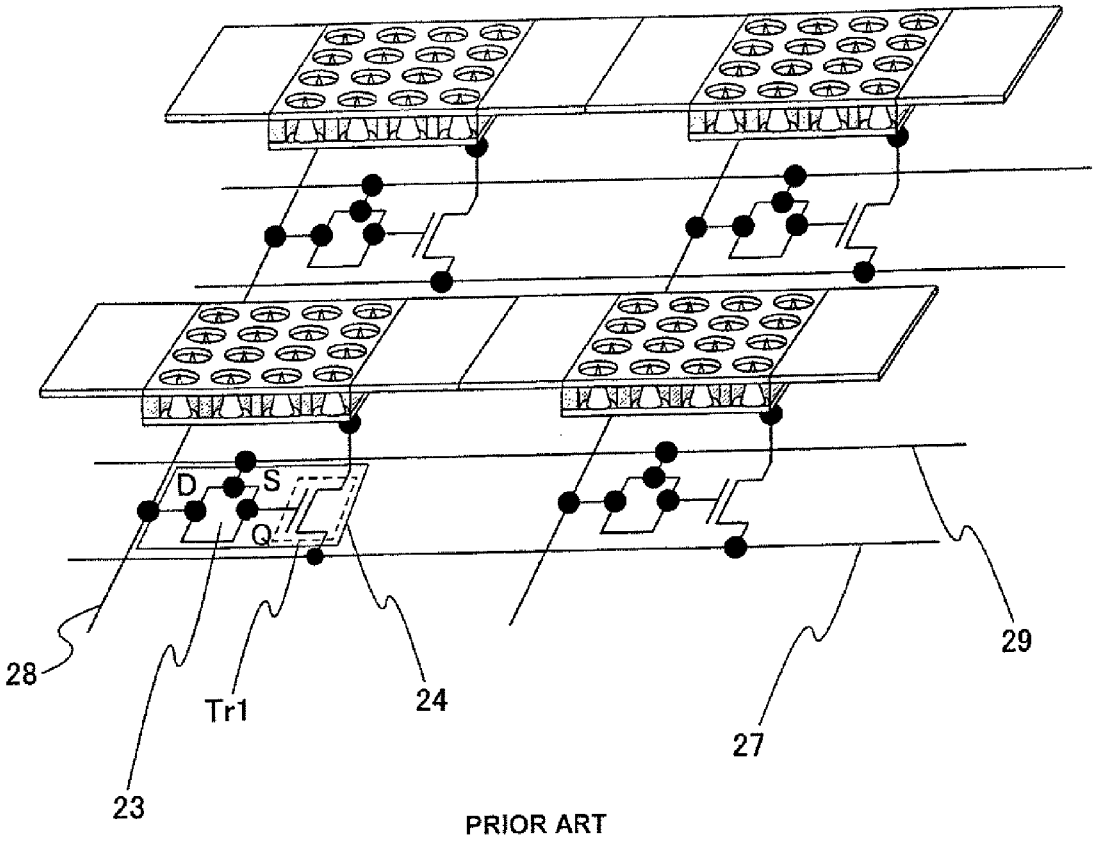
FIGS. 19A and 19B are diagrams showing a pixel circuit and a display region structure of a conventional active matrix FED.
Figure 19B:
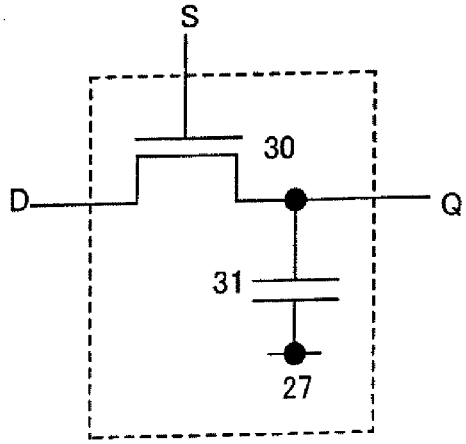
PRIOR ART FIG. 19B

An opposite substrate 978 is attached as shown in FIG. 13C. The opposite substrate 978 includes an anode electrode 976 and a fluorescent material 975. Space which is formed by attachment of the opposite substrate 978 may be filled with inert gas. A spacer is preferably formed in order to hold a gap between an insulating substrate 950 and the opposite substrate 978. A columnar spacer or a spherical spacer can be employed as the spacer. The anode electrode 976 needs to have light-transmitting properties, and can employ a light-transmitting conductive material such as ITO, zinc oxide (ZnO), indium zinc oxide (IZO), or zinc oxide to which gallium is added (GZO). Further, indium tin oxide having silicon oxide (hereinafter described as ITSO), or ITO to which zinc oxide (ZnO) is mixed can be employed as well. The fluorescent material 975 may be formed separately for each of red (R), green (G), and blue (B).

A display device which is formed in this manner can display images with electrons which are emitted from the conductive film 968 having a cone shape to be pulled toward to the anode electrode 976, and then pass through the fluorescent material 975.

In this manner, an active matrix FED device can be provided.

Embodiment Mode 11

Figure 25:
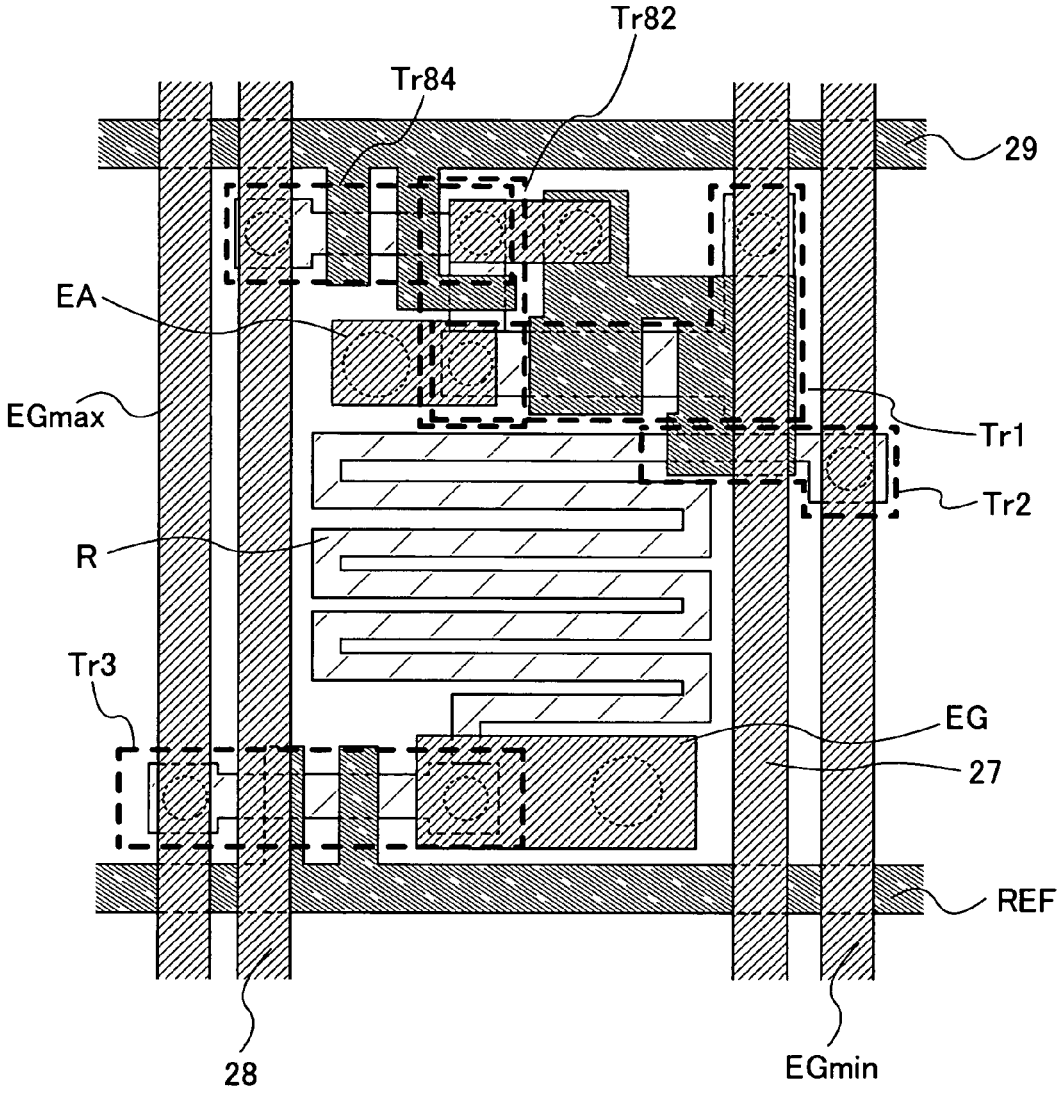
FIG. 25 is a view of a pixel portion of a display device in the invention.
Figure 26:
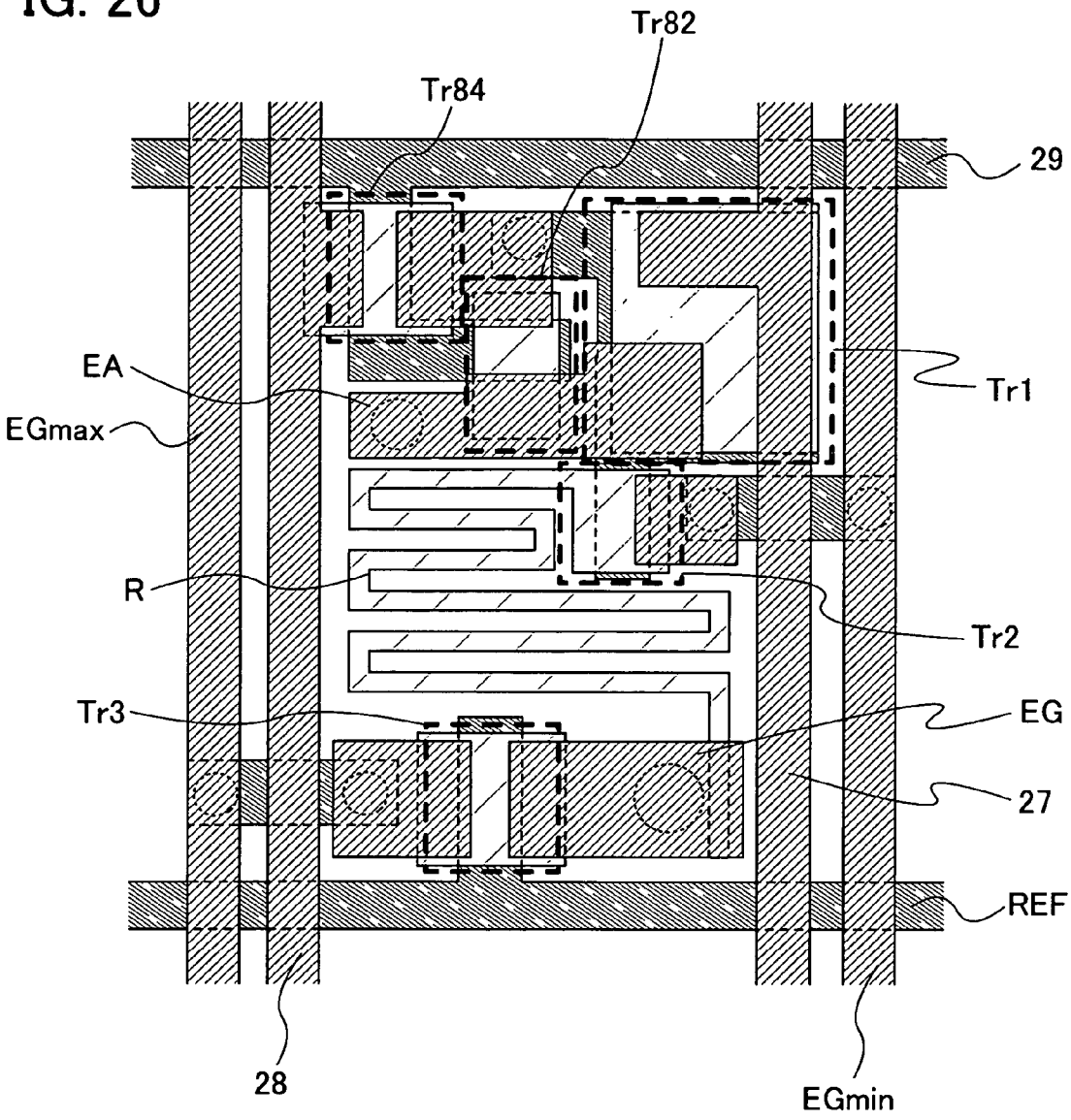
FIG. 26 is a view of a pixel portion of a display device in the invention.

In this embodiment mode, description is made of an exemplary layout of the current input pixel circuit of the invention shown in FIG. 22A with reference to FIGS. 25 and 26. FIG. 25 shows an exemplary layout of the pixel circuit of the invention shown in FIG. 22A in the case of using a polysilicon TFT as a transistor.

An exemplary layout of a pixel circuit shown in FIG. 25 includes the scan line 29, the data line 28, the wire EGmax, the wire EGmin, the cathode electrode 27, the wire REF, the driving transistor Tr1, the transistor Tr2, the transistor Tr3, the transistor Tr82, the transistor Tr83, the transistor Tr84, the resistor R, the terminal EA, and the terminal EG.

The scan line 29 may be connected to a gate electrode of the transistor Tr82 by extending a gate electrode of the transistor Tr84 about in the right angle direction as shown in FIG. 25. The direction of extending the gate electrode is not limited to the right angle direction, but it may a straight line direction or a diagonal direction. By employing such arrangement, a dedicated wire for controlling the transistor Tr82 is not required; therefore, the pixel region can be used for purposes other than the wire, which is advantageous in that the degree of freedom for deign can be increased and a larger element with a larger size can be formed in the pixel region. Needless to say, the dedicated wire for controlling the gate electrode of the transistor Tr84 may be provided.

The wire REF may be disposed to be in parallel to the scan line 29 since there is possibility that the wire REF is input with a signal at almost the same timing as the scan line 29. In addition, the data line 28, the wire EGmax, the wire EGmin, and the cathode electrode 27 may be disposed to be about vertical to the scan line 29 and the wire REF. Note that a wire layer having as low resistance as possible is preferably employed since an effect of reducing power consumption can be increased due to the low resistance, specifically when a large current flows through such a wire. Further, the wire EGmin is not required to be vertical to the scan line 29, but may be disposed to be in parallel to the scan line 29 since it is input with a signal at almost the same timing as the scan line 29.

A channel of the driving transistor Tr1 may be bent at almost a right angle as shown in FIG. 25. This helps the driving transistor Tr1 be disposed efficiently in the pixel portion. In addition, it may be a multi-gate transistor which uses a plurality of channels. This helps the driving transistor Tr1 have a reduced leak current when the driving transistor Tr1 is in an off state. A gate electrode of the transistor Tr2 may be connected to a gate electrode of the driving transistor Tr1 as shown in FIG. 25. The transistor Tr3 may be disposed such that a channel there s located below wires. This helps the transistor Tr3 be disposed efficiently in the pixel portion.

The resistor R may be disposed such that the total length of the resistor is lengthened by being bent at a plurality of portions in order to increase the resistance value. Note that the resistor R is preferably formed of a material having higher resistivity than a wiring material which electrically connects the elements, such as polysilicon, amorphous silicon, ITO, or the conductive film as the gate electrodes of the transistors. In addition, a connecting portion of the resistor R and one of either a source electrode or a drain electrode of the transistor Tr2 may be connected to the channel portion. This is preferable in the case of forming the resistor R with polysilicon. Further, one of either the source electrode or the drain electrode of the transistor Tr2 may be once connected to the wire layer, and then, the wire layer and the resistor R may be connected to each other. This is preferable in the case of forming the resistor R with a material other than polysilicon, for example, with the same conductive film as the gate electrodes of the transistors.

The terminal EA and the terminal EG may be formed with the wire layer. Note that the size of a contact which connects the terminal EA to the light-emitting element 42 is preferably larger than the other contacts in the pixel circuit to decrease the contact resistance, since a current flowing through the terminal EA is larger than a current flowing through the terminal EG. This helps to decrease the resistance value of a path through which a larger current flows, which is an advantage in that power consumption can be reduced.

Although FIG. 25 shows the exemplary layout of the pixel circuit of the invention shown in FIG. 22A in the case of using a polysilicon TFT as a transistor, the pixel circuit which can be applied to the invention is not limited to this. For example, the pixel circuits shown in FIGS. 20A and 21A can be applied.

FIG. 26 shows an exemplary layout of the pixel circuit of the invention shown in FIG. 22A in the case of using an amorphous silicon TFT as a transistor.

An exemplary layout of a pixel circuit shown in FIG. 26 includes the scan line 29, the data line 28, the wire EGmax, the wire EGmin, the cathode electrode 27, the wire REF, the driving transistor Tr1, the transistor Tr2, the transistor Tr3, the transistor Tr82, the transistor Tr83, the transistor Tr84, the resistor R, the terminal EA, and the terminal EG.

The scan line 29 may be connected to a gate electrode of the transistor Tr82 by extending a gate electrode of the transistor Tr84 almost in the right angle direction as shown in FIG. 26. The direction of extending the gate electrode is not limited to the right angle direction, but it may a straight line direction and a diagonal direction. By employing such arrangement, a dedicated wire for controlling the transistor Tr82 is not required; therefore, the pixel region can be used for purposes other than the wires, which is advantageous in that the degree of freedom for deign can be increased and an element with a larger size can be formed in the pixel region. Needless to say, the dedicated wire for controlling the gate electrode of the transistor Tr84 may be provided.

The wire REF may be disposed to be in parallel to the scan line 29 since there is possibility that the wire REF is input with a signal at almost the same timing as the scan line 29. In addition, the data line 28, the wire EGmax, the wire EGmin, and the cathode electrode 27 may be disposed to be about vertical to the scan line 29 and the wire REF. Note that a wire layer having as low resistance as possible is preferably employed since an effect of reducing power consumption can be increased due to the low resistance, specifically when a large current flows through such a wire. Further, the wire EGmin is not required to be vertical to the scan line 29, but may be disposed to be in parallel to the scan line 29 since it is input with a signal at almost the same timing as the scan line 29.

One of either a source electrode or a drain electrode of the driving transistor Tr1 may be bent to be almost at a right angle as shown in FIG. 26. The polysilicon TFT has lower mobility than the case of forming the driving transistor Tr1 with single crystals or polysilicon and thus few currents can flow through such a TFT. Accordingly, bending the source electrode or the drain electrode of the driving transistor Tr1 is advantageous in efficiently widening the channel width of the driving transistor Tr1. In addition, the driving transistor Tr1 can be efficiently disposed in the pixel portion. Further, it may be a multi-gate transistor which uses a plurality of channels. This helps the driving transistor Tr1 have a reduced leak current when the driving transistor Tr1 is in an off state. A gate electrode of the transistor Tr2 may be connected to a gate electrode of the driving transistor Tr1 as shown in FIG. 26. As shown in FIG. 26, a wire connected to one of either a source electrode or a drain electrode of the transistor Tr3 may be connected to the same conductive film as the gate electrode by passing under wires. This helps the transistor Tr3 be disposed efficiently in the pixel portion. By disposing the transistor Tr3 in this manner, in the case of employing a method for manufacturing an amorphous silicon TFT where etching is conducted for forming a channel using the wire layer as the mask, amorphous silicon and the wire can be prevented from being electrically connected to each other when the transistor Tr3 is disposed below the wire with the same layer as the channel thereof. Note that the same can be said for the transistor Tr2 as well.

The resistor R may be disposed such that the total length of the resistor is lengthened by being bent at a plurality of portions in order to increase the resistance value. Note that the resistor R is preferably formed of a material having higher resistivity than a wiring material which electrically connects the elements, such as polysilicon, amorphous silicon, ITO, or the same conductive film as the gate electrodes of the transistors. In addition, a connecting portion of the resistor R and one of either a source electrode or a drain electrode of the transistor Tr2 may be connected to the channel portion. This is preferable in the case of forming the resistor R with polysilicon. Further, one of either the source electrode or the drain electrode of the transistor Tr2 may be once connected to the wire layer, and then, the wire layer and the resistor R may be connected to each other. This is preferable in the case of forming the resistor R with a material other than polysilicon, for example, with the same conductive film as the gate electrodes of the transistors.

The terminal EA and the terminal EG may be formed with the wire layer. Note that the size of a contact which connects the terminal EA to the light-emitting element 42 is preferably larger than the other contacts in the pixel circuit to decrease the contact resistance, since a current flowing through the terminal EA is larger than a current flowing through the terminal EG. This helps to decrease the resistance value of a path through which a large current flows, which is advantageous in that power consumption can be reduced.

Although FIG. 26 shows the exemplary layout of the pixel circuit of the invention shown in FIG. 22A in the case of using an amorphous silicon TFT as a transistor, the pixel circuit which can be applied to the invention is not limited to this. For example, the pixel circuits shown in FIGS. 20A and 21A can be applied.

Embodiment Mode 12

Figure 27:
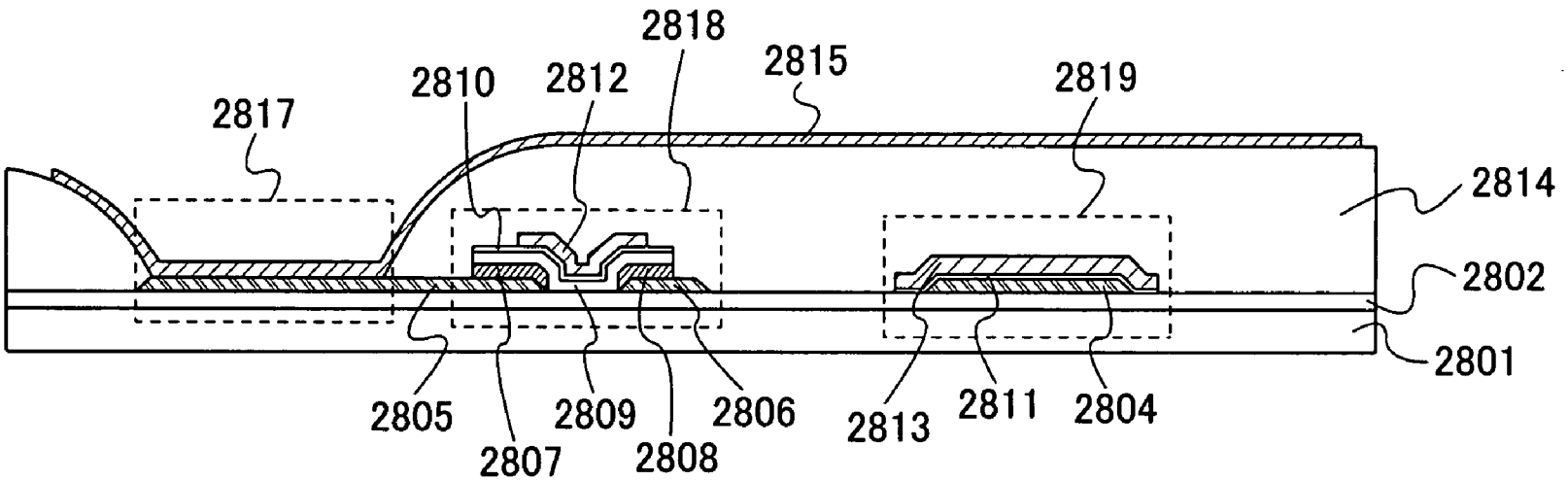
FIG. 27 is a cross-sectional view showing a pixel portion of a display device in the invention.
Figure 28:
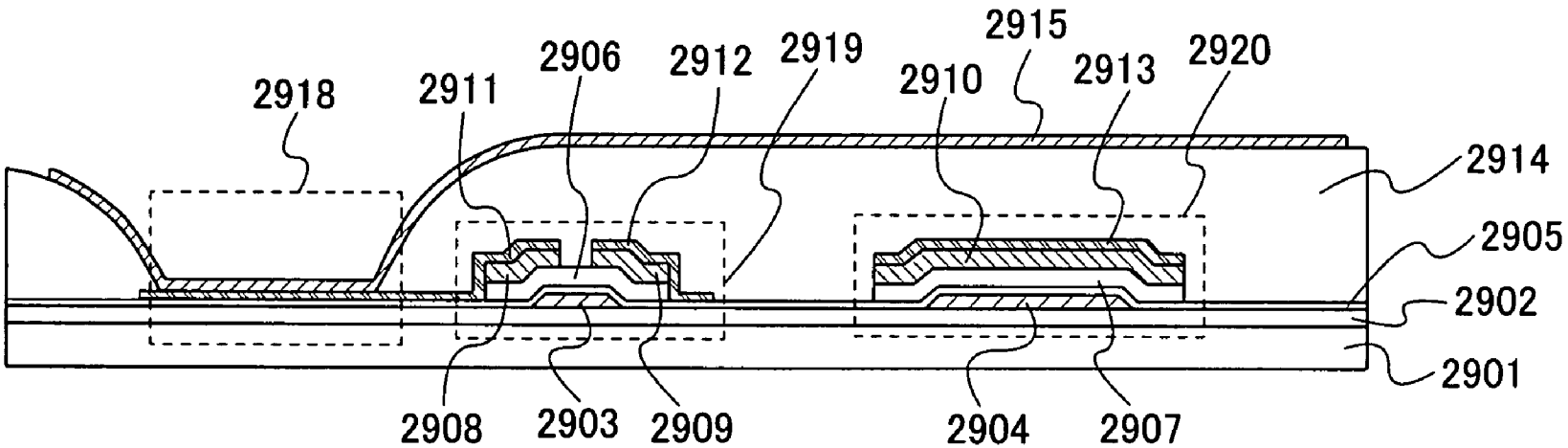
FIG. 28 is a cross-sectional view showing a pixel portion of a display device in the invention.
Figure 29:
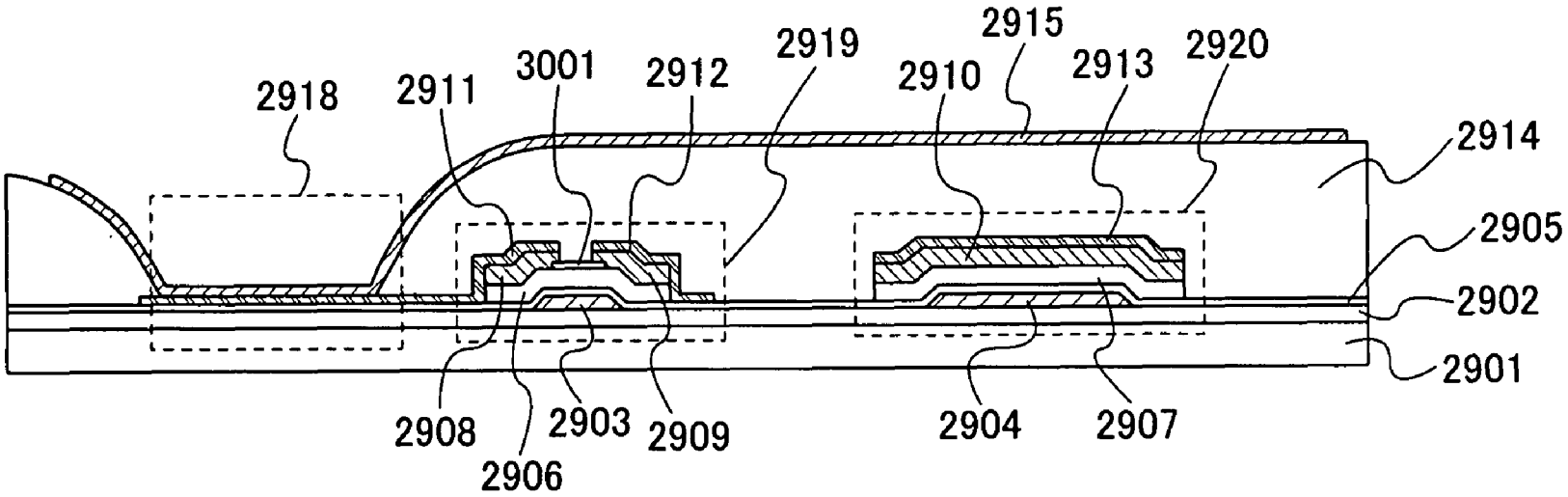
FIG. 29 is a cross-sectional view showing a pixel portion of a display device in the invention.

Next, description is made of a case of employing an amorphous silicon (a-Si:H) film for a semiconductor layer of a transistor. FIG. 27 shows a case of employing a top-gate transistor. FIGS. 28 and 29 show cases of employing a bottom-gate transistor.

FIG. 27 shows a cross section of a transistor with a top-gate structure using amorphous silicon to a semiconductor layer. As shown in FIG. 27, a base film 2802 is formed over a substrate 2801.

As a substrate, a glass substrate, a quartz substrate, a ceramic substrate, and the like can be used. In addition, as the base film 2802, a single-layer of aluminum nitride (AlN), silicon oxide ($SiO_2$), silicon oxynitride ($SiO_xN_y$), or the like, or stacked-layer thereof can be used.

In addition, an electrode 2804, an electrode 2805, and an electrode 2806 are formed over the base film 2802. An N-type semiconductor layer 2807 and an N-type semiconductor layer 2808 having N-type conductivity are formed over the electrode 2805 and the electrode 2806 respectively. A semiconductor layer 2809 is formed between the electrode 2806 and the electrode 2805 and over the base film 2802. A part of the semiconductor layer 2809 is extended to cover the N-type semiconductor layer 2807 and the N-type semiconductor layer 2808. Note that this semiconductor layer 2809 is formed of a non-crystalline semiconductor film which is made of amorphous silicon (a-Si:H), a microcrystalline semiconductor (μ-Si:H), or the like. A gate insulating film 2810 is formed over the semiconductor layer 2809. In addition, an insulating film 2811 which is formed in the same layer and with the same material as the gate insulating film 2810 is formed over the electrode 2804. Note that the gate insulating film 2810 is formed of a silicon oxide film, a silicon nitride film, or the like.

A gate electrode 2812 is formed over the gate insulating film 2810. In addition, an electrode 2813 which is formed with the same material and in the same layer as the gate electrode 2812 is formed over the electrode 2804 with the insulating film 2811 interposed therebetween. By sandwiching the insulating film 2811 between the electrode 2804 and the electrode 2813, a capacitor 2819 is formed. In a region excluding a contact 2817, an interlayer insulating film 2814 is formed to cover a transistor 2818 and the capacitor 2819.

In the contact 2817, an electrode 2815 and the electrode 2805 are electrically connected to each other. The electrode 2815 becomes a base electrode of an electron source. The electron source is formed over the electrode 2815 as shown in Embodiment Modes 9 and 10. Here, the electrode 2815 may be independently provided in each pixel and is not required to be electrically connected to other pixels. If the electrode 2815 is independently provided in each pixel, a structure of the pixel circuit of the invention where a current supplied to a light-emitting element can be controlled with a transistor can be employed.

FIG. 28 shows a partial cross-sectional view of a panel of a display device using a transistor with a bottom-gate structure where amorphous silicon for a semiconductor layer.

A base film 2902 is formed over a substrate 2901. In addition, an electrode 2903 is formed over the base film 2902. An electrode 2904 which is formed with the same material and in the same layer as the gate electrode 2903 is formed. As a material used for the electrode 2903, polycrystalline silicon doped with phosphorus can be employed. In addition to polycrystalline silicon, silicide which is a compound of metal and silicon may be employed as well.

In addition, an insulating film 2905 is formed so as to cover the electrode 2903 and the electrode 2904. The insulating film 2905 is formed of a silicon oxide film, a silicon nitride film, or the like.

A semiconductor layer 2906 is formed over the insulating film 2905. In addition, a semiconductor layer 2907 which is formed with the same material and in the same layer as the semiconductor layer 2906 is formed.

As a substrate, a glass substrate, a quartz substrate, a ceramic substrate, and the like can be used. In addition, as the base film 2902, a single-layer of aluminum nitride (AlN), silicon oxide ($SiO_2$), silicon oxynitride ($SiO_xN_y$), or the like, or stacked-layer thereof can be used.

N-type semiconductor layers 2908 and 2909 each having N-type conductivity are formed over the semiconductor layer 2906 while an N-type semiconductor layer 2910 is formed over the semiconductor layer 2907.

Electrodes 2911 and 2912 are formed over the N-type semiconductors 2908 and 2909 respectively, and an electrode 2913 which is formed in the same layer with the same material as the electrodes 2911 and 2912 is formed over the N-type semiconductor layer 2910.

As shown in FIG. 28, by employing a structure where the insulating film 2905 is interposed among the semiconductor layer 2907, the N-type semiconductor layer 2910, the electrode 2913, and the electrode 2904, a capacitor 2920 is formed. Note that in the case of forming the capacitor 2920, the semiconductor layer 2907 and the N-type semiconductor layer 2910 are not necessarily to be provided. That is, the capacitor 2920 may be formed by employing a structure where the insulating film 2905 is interposed between the electrode 2913 and the electrode 2904.

In a region excluding a contact 2918, an interlayer insulating film 2914 is formed to cover a transistor 2919 and the capacitor 2920. In addition, one of edges of the electrode 2911 is extended, and an electrode 2915 is formed over the extended electrode 2911 in the contact 2918.

In the contact 2918, the electrode 2915 and the electrode 2911 are electrically connected to each other. The electrode 2915 becomes a base electrode of an electron source. The electron source is formed over the electrode 2915 as shown in Embodiment Modes 9 and 10. Here, the electrode 2915 may be independently provided in each pixel and is not required to be electrically connected to other pixels. If the electrode 2915 is independently provided in each pixel, a structure of the invention where a current supplied to a light-emitting element can be controlled with a driving transistor can be employed.

Note that although description has been made of a transistor with an inversely staggered channel-etched structure, a transistor with a channel-protected structure may be employed. A case of employing a transistor with a channel-protected structure is described with reference to FIG. 29.

A transistor with a channel-protected structure shown in FIG. 29 differs from the transistor 2919 with a channel-etched structure shown in FIG. 28 in that an insulating material 3001 to serve as an etching mask is provided over a region where a channel of the semiconductor layer 2906 is formed. Common reference numerals are used for portions common to FIGS. 28 and 29.

Note that as shown in FIG. 29, even if the insulating material 3001 to serve as an etching mask is not provided over the region where the channel of the semiconductor layer 2906 of the transistor 2919 with a channel-etched structure is formed, the channel can be etched without using a dedicated mask by employing a mask called halftone or gray tone when a resist film for patterning the electrode 2911 is exposed to light. This helps to reduce the number of processes of photolithography so that the manufacturing cost can be reduced.

By employing amorphous silicon to the semiconductor layer (a channel forming region, a source region, a drain region, or the like) of the transistor which constitutes the pixel of the invention, the manufacturing cost can be reduced.

Note that structures of transistors and capacitors which can be applied to the pixel configuration of the invention are not limited to the aforementioned configurations, and thus, various structures of transistors and capacitors can be employed.

Embodiment Mode 13

Figure 30A:
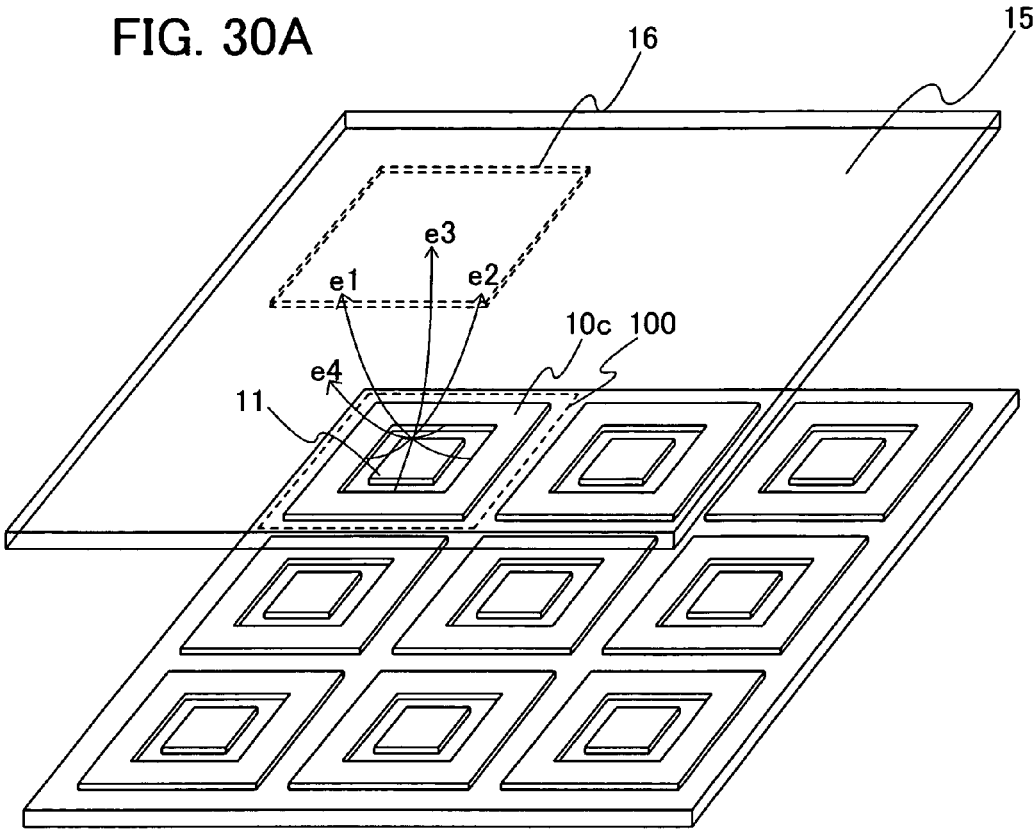
FIGS. 30A and 30B are diagrams showing light-emitting elements of a display device in the invention.
Figure 30B:
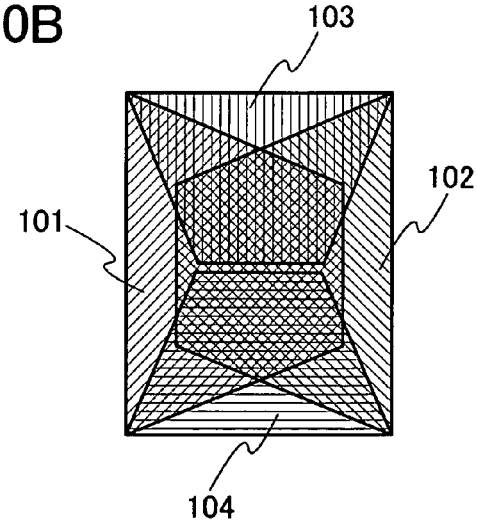

In this embodiment mode, description is made of an exemplary shape of a light-emitting element using a surface-conduction electron-emissive element shown in FIGS. 3A and 3B with reference to FIGS. 30A and 30B. The surface-conduction electron-emissive element shown in FIGS. 30A and 30B includes an emitter 10*c*, an extraction gate electrode 11, a pixel 100, an anode electrode 15 which is formed over a second substrate (not shown), a light-emitting material 16 which is formed over the anode electrode 15.

The emitter 10*c* is preferably formed so as to surround the extraction gate electrode 11 and electrically connected to the terminal EA in FIGS. 25 and 26.

The extraction gate electrode 11 is preferably formed so as to be surrounded by the emitter 10*c* and electrically connected to the terminal EG in FIGS. 25 and 26.

The light-emitting material 16 is formed over the anode electrode 15. Note that although not shown, the light-emitting material 16 which is formed over the anode electrode 15 may include a plurality of kinds of materials in accordance with colors of light emitted therefrom. In addition, the size of the light-emitting material 16 is preferably about the same as the size of the pixel 100.

The pixel 100 includes at least one emitter 10*c* and one extraction gate electrode 11. Note that when the number of the emitters 10*c* and the extraction gate electrodes 11 is small, there is an advantage that the yield can be improved since the electrode is not required to be processed minutely. Alternatively, when the number of the emitters 10*c* and the extraction gate electrodes 11 is large, there is an advantage that the driving voltage is low to reduce power consumption since sufficient luminance can be obtained even if the amount of electron emission per emitter is small. Note that since processing the shape of the electrode becomes difficult to increase the manufacturing cost when the number of the emitters 10*c* and the extraction gate electrodes 11 is too large, the number of the emitters 10*c* included in the pixel 100 is preferably not less than 1 and not more than 16, and also the number of the extraction gate electrodes 11 included in the pixel 100 is preferably not less than 1 and not more than 16.

Hereinafter, description is made of a case in which the number of the emitters 10*c* included in the pixel 100 is one, and also the number of the extraction gate electrodes 11 included in the pixel 100 is one. When an electric field is generated between the extraction gate electrode 11 and the emitter 10*c*, an electron is emitted from the emitter 10*c*. The emitted electron is influenced by the electric field generated by the anode electrode 15 which is located above and is pulled toward the anode electrode 15 while at the same time changing orbit. Then, the electron which is pulled toward the anode electrode 15 collides with the light-emitting material 16 so that it emits light with a color in accordance with the material of the light-emitting material 16. In this manner, the light-emitting element using the surface-conduction electron-emissive element emits light.

Here, distribution of the emission intensity of the light-emitting material 16 depends on a direction of the electron which is emitted from the emitter 10*c*, so that it is not uniform. For example, a region in which the light-emitting material 16 emits light with an electron e1 emitted from the emitter 10*c* which is located in right side of the pixel 100 has a shape like 101 in FIG. 30B, and thus, the light-emitting material 16 cannot emit light uniformly only with the electron e1.

Then, the emitter 10*c* may be formed so as to surround the extraction gate electrode 11 as shown in FIG. 30A. This helps electrons e2, e3, and e4 from the emitter 10*c* collide with the light-emitting material 16 in many directions, so that the distribution of the emission intensity of the light-emitting material 16 can be made uniform in a region where 101, 102, 103, and 104 are added to each other in FIG. 30B.

Note that shapes of the emitter 10*c* and the extraction gate electrode 11 are not limited to be rectangle as shown in FIG. 30A, and thus, various shapes can be employed. For example, they may be hexagons or octagons. Alternatively, the light-emitting material 16 can emit light uniformly with the emitter 10*c* and the leading gate electrode 11 having shapes of concentric circles.

Note that the light-emitting element using the surface-conduction electron-emissive element in this embodiment mode may be manufactured over a substrate having transistors. This helps to improve the emission duty ratio of pixels so that the luminance can be increased. In addition, power consumption can be reduced.

Note that the light-emitting element using the surface-conduction electron-emissive element in this embodiment mode may be manufactured over a substrate having no transistor. This helps to manufacture the light-emitting element using the surface-conduction electron-emissive element relatively easily, so that the yield can be improved. In addition, an impulse-type display device having no blur (after image) at the time of displaying a moving image can be provided.

Note that this embodiment can be freely combined with the other embodiment modes in this specification.

Embodiment Mode 14

In this embodiment, description is made of application examples of a display panel which has the display device of the invention as a display portion, with reference to the drawings. A display panel which uses the display device of the invention for its display portion can be incorporated in a moving object or a structure.

Figure 32A:
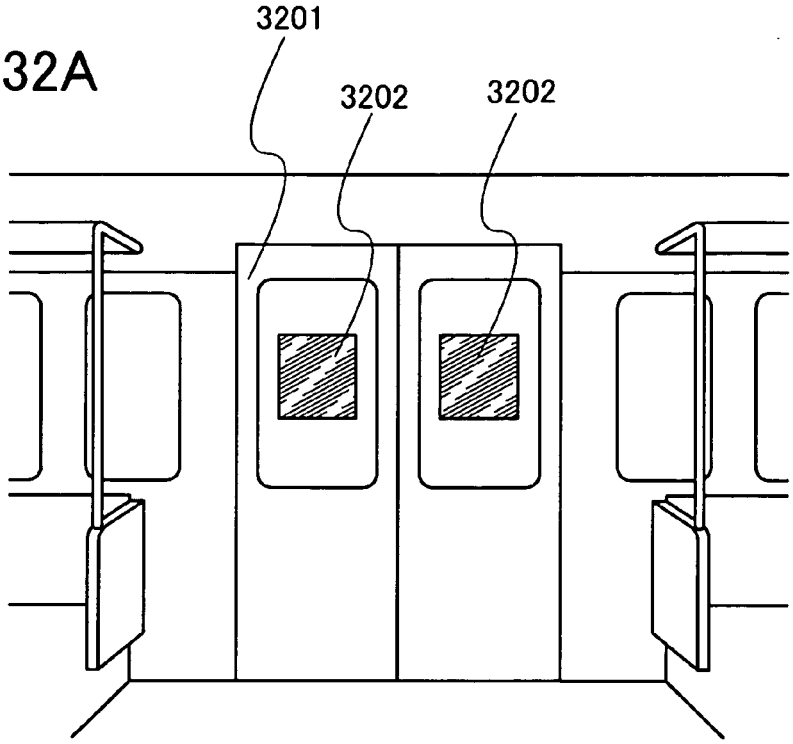
FIGS. 32A and 32B are views showing moving objects using a display device which can be applied to the invention.
Figure 32B:
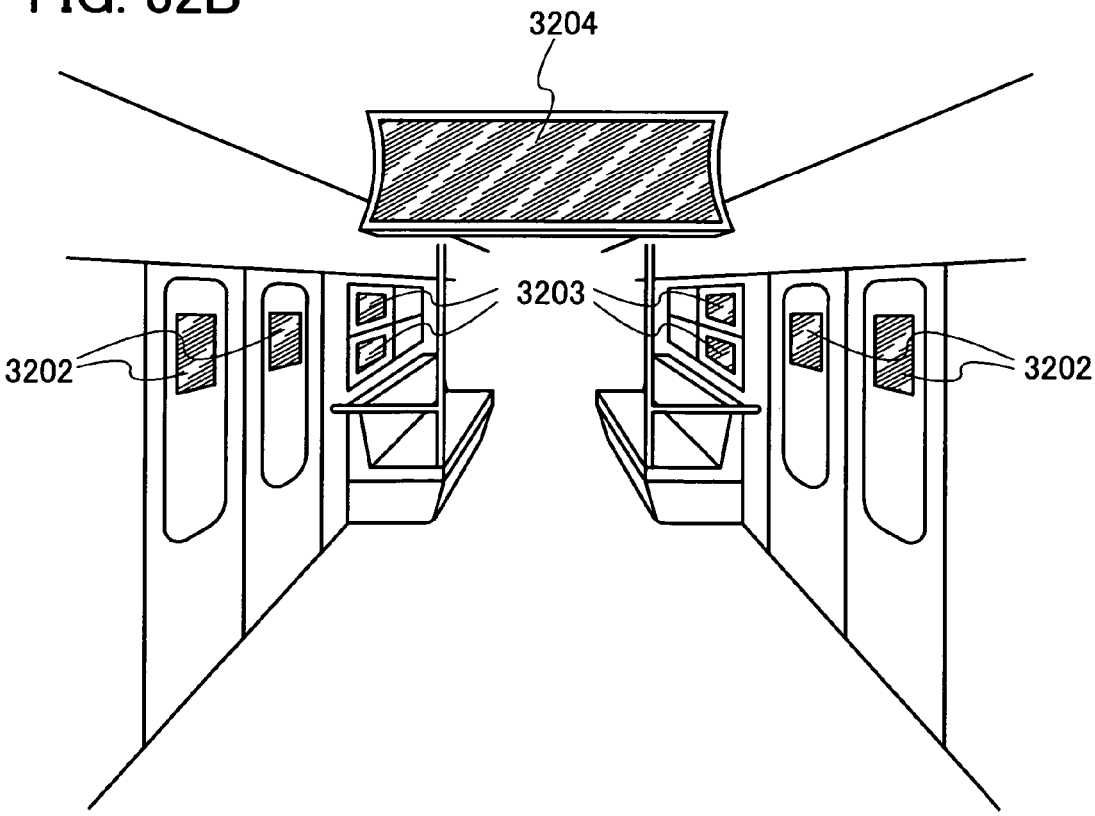

FIGS. 32A and 32B each show a moving object incorporating a display device, as an exemplary display panel which has the display device of the invention as a display portion. FIG. 32A shows a display panel 3202 which is attached to a glass door in a train car body 3201, as an exemplary moving object incorporating a display device. The display panel 3202 shown in FIG. 32A which has the display device of the invention as a display portion can easily switch images displayed on the display portion in response to external signals. Therefore, images on the display panel can be periodically switched in accordance with the time cycle through which passengers' ages or sex vary, thereby a more efficient advertising effect can be expected.

Note that the position for setting a display panel which has the display device of the invention as a display portion is not limited to a glass door of a train car body as shown in FIG. 32A, and thus a display panel can be placed in various places by changing the shape of the display panel. FIG. 32B shows an example thereof.

FIG. 32B shows an interior view of a train car body. In FIG. 32B, display panels 3203 attached to glass windows and a display panel 3204 hung on the ceiling are shown in addition to the display panels 3202 attached to the glass doors shown in FIG. 32A. The display panels 3203 each having the pixel configuration of the invention has self-luminous display elements. Therefore, by displaying images for advertisement in rush hours, while displaying no images in off-peak hours, outside views can be seen from the train windows. In addition, the display panel 3204 having the display device of the invention can be flexibly bent by providing switching elements such as organic transistors over a substrate in a film form, and images can be displayed on the display panel 3204 by driving self-luminous display elements.

Another example where a display panel having the display device of the invention as a display portion is applied to a moving object incorporating a display device is described with reference to FIG. 33.

Figure 33:
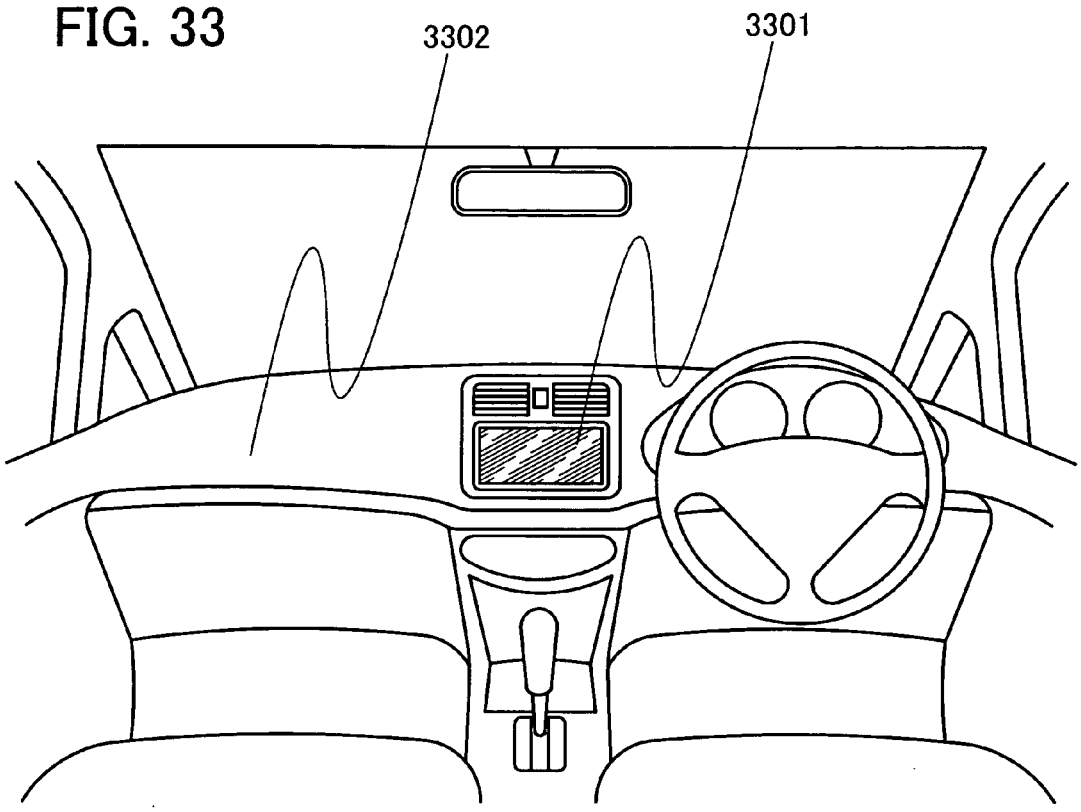
FIG. 33 is a view showing a moving object using a display device which can be applied to the invention.

FIG. 33 shows a moving object incorporating a display device, as an exemplary display panel which has the display device of the invention as a display portion. FIG. 33 shows a display panel 3301 which is incorporated in a body 3302 of a car, as an exemplary moving object incorporating a display device. The display panel 3301 having the display device of the invention as a display portion shown in FIG. 33 is incorporated in a body of a car, and displays information on the operation of the car or information input from outside of the car on an on-demand basis. Further, it has a navigation function to a destination of the car.

Note that the position for setting a display panel which has the display device of the invention as a display portion is not limited to a front portion of a car body as shown in FIG. 33, and thus a display panel can be placed in various places such as glass windows or doors by changing the shape of the display panel.

Another example where a display panel having the display device of the invention as a display portion is applied to a moving object incorporating a display device is described with reference to FIGS. 31A and 31B.

Figure 31A:
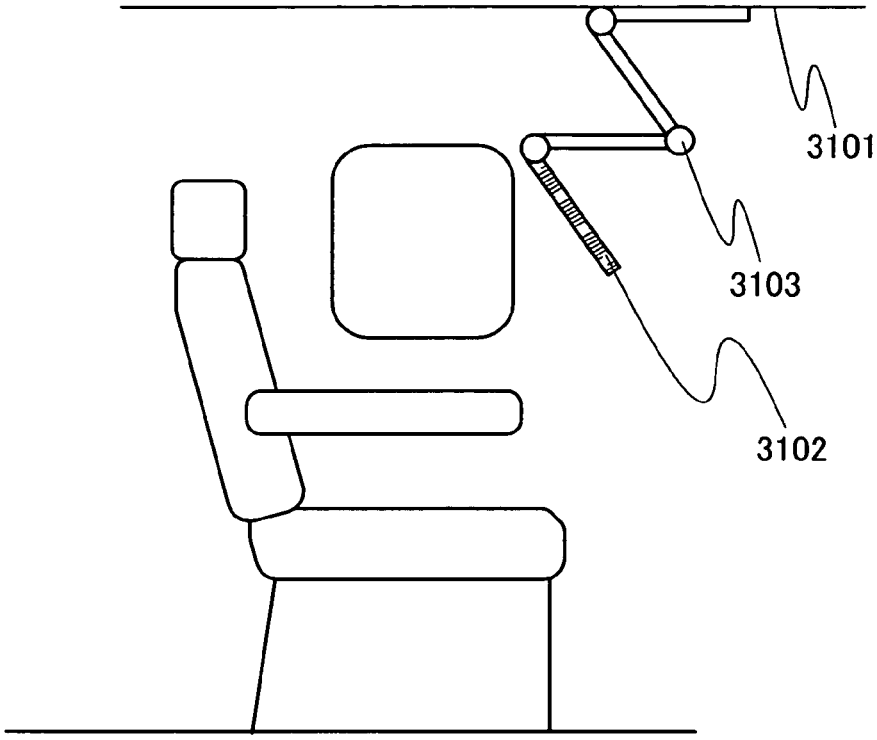
FIGS. 31A and 31B are views showing moving objects using a display device which can be applied to the invention.
Figure 31B:
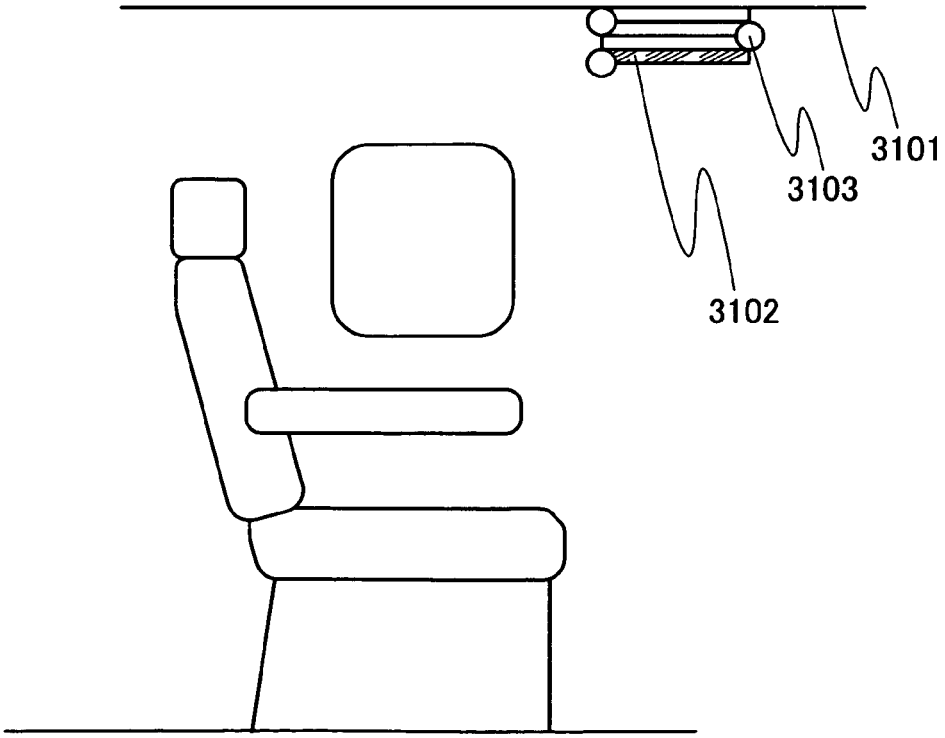

FIGS. 31A and 31B each show a moving object incorporating a display device, as an exemplary display panel which has the display device of the invention as a display portion. FIG. 31A shows a display panel 3102 which is incorporated in a part of the ceiling above the passenger's seat inside an airplane body 3101, as an exemplary moving object incorporating a display device. The display panel 3102 shown in FIG. 31A which has the display device of the invention as a display portion is fixed on the airplane body 3101 with a hinge portion 3103, so that passengers can see the display panel 3102 with the help of a telescopic motion of the hinge portion 3103. The display panel 3102 has a function of displaying information as well as a function of an advertisement or amusement means with the operation of passengers. In addition, by storing the display panel 3102 in the airplane body 3101 by folding the hinge portion 3103 as shown in FIG. 31B, safety during the airplane's takeoff and landing can be secured. Note that the display panel can be also utilized as a guide light by lighting display elements of the display panel in an emergency.

Note that the position for setting a display panel which has the display device of the invention as a display portion is not limited to the ceiling of the airplane body 3101, and thus a display panel can be placed in various places such as seats or doors by changing the shape of the display panel. For example, the display panel may be set on the backside of a seat so that a passenger on the rear seat can perform and view the display panel.

Although this embodiment has illustrated a train car body, a car body, and an airplane body as exemplary moving objects, the invention is not limited to these, and can be applied to motorbikes, four-wheeled vehicles (including cars, buses, and the like), trains (including monorails, railroads, and the like), ships and vessels, and the like. By employing a display panel having the display device of the invention, downsizing and low power consumption of a display panel can be achieved, as well as a moving object having a display medium with an excellent operation can be provided. In addition, since images displayed on a plurality of display panels incorporated in a moving object can be switched all at once, in particular, the invention is quite advantageous to be applied to advertising media for unspecified number of customers, or information display boards in an emergency.

An example where a display panel having the display device of the invention as a display portion is applied to a structure is described with reference to FIG. 34.

Figure 34:
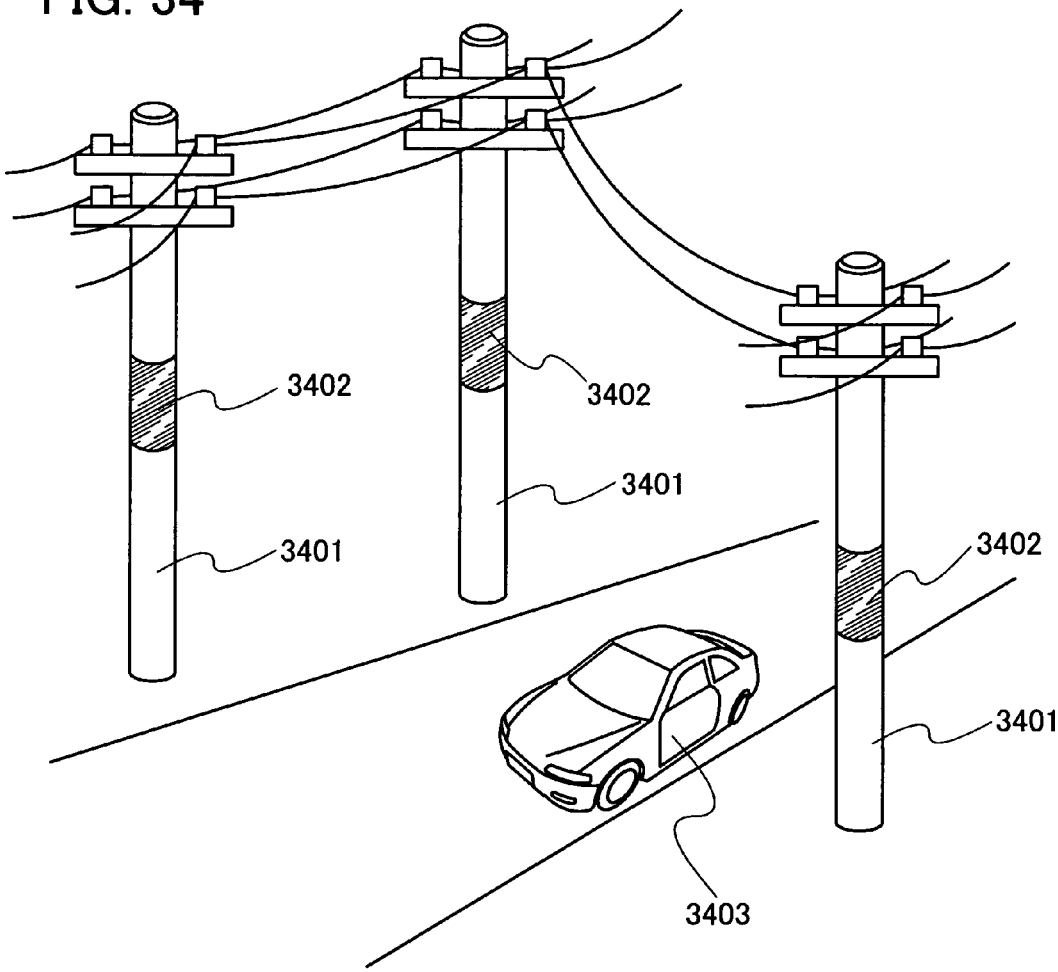
FIG. 34 is a view showing a columnar object using a display device which can be applied to the invention.

FIG. 34 illustrates an example where a flexible display panel capable of displaying images is realized by providing switching elements such as organic transistors over a substrate in a film form, and driving self-luminous display elements, as an exemplary display panel having the display device of the invention as a display portion. In FIG. 34, a display panel is provided on a curved surface of an outside pole such as a telephone pole as a structure, and specifically, described here is a structure where display panels 3402 are attached to telephone poles 3401 which are columnar objects.

The display panels 3402 shown in FIG. 34 are positioned at about a half height of the telephone poles, so as to be at higher than the eye level of humans. When the display panels are viewed from a moving object 3403, images on the display panels 3402 can be recognized. By displaying the same images on the display panels 3402 provided on the telephone poles standing together in large numbers, such as outside telephone poles, viewers can recognize the displayed information or advertisement. The display panels 3402 provided on the telephone poles 3401 in FIG. 34 can easily display the same images by using external signals; therefore, quite effective information display and advertising effects can be expected. In addition, since self-luminous display elements are provided as display elements in the display panel of the invention, it can be effectively used as a highly visible display medium even at night.

Another example where a display panel having the display device of the invention as a display portion is applied to a structure is described with reference to FIG. 35, which differs from FIG. 34.

Figure 35:
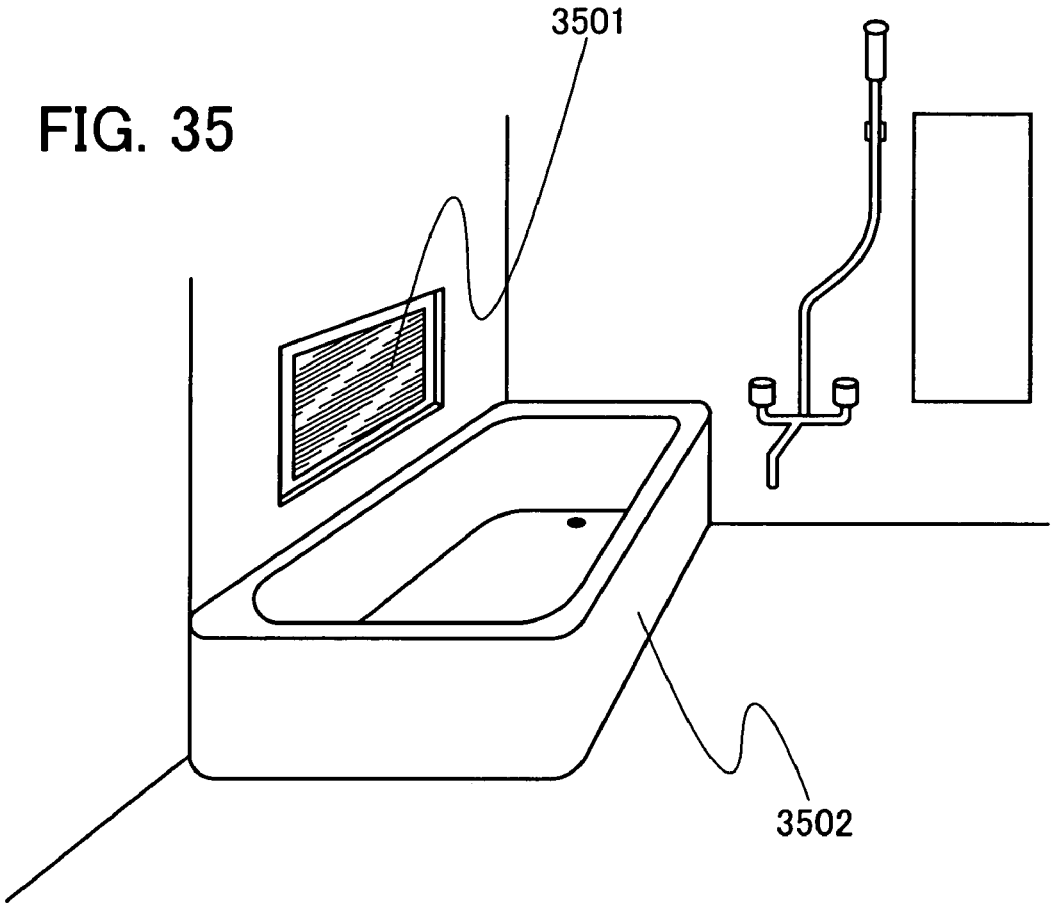
FIG. 35 is a view showing an application mode of a structure using a display device which can be applied to the invention.

FIG. 35 shows another application example of a display panel which has the display device of the invention as a display portion. In FIG. 35, an example of a display panel 3502 which is incorporated in the sidewall of a prefabricated bath unit 3501 is shown. The display panel 3502 shown in FIG. 35 which has the display device of the invention as a display portion is incorporated in the prefabricated bath unit 3501, so that a bather can see the display panel 3502. The display panel 3501 has a function of displaying information as well as a function of an advertisement or amusement means with the operation of a bather.

The position for setting a display panel which has the display device of the invention as a display portion is not limited to the sidewall of the prefabricated bath unit 3501 shown in FIG. 35, and thus a display panel can be placed in various places by changing the shape of the display panel, such that it can be incorporated in a part of a mirror or a bathtub.

Figure 36:
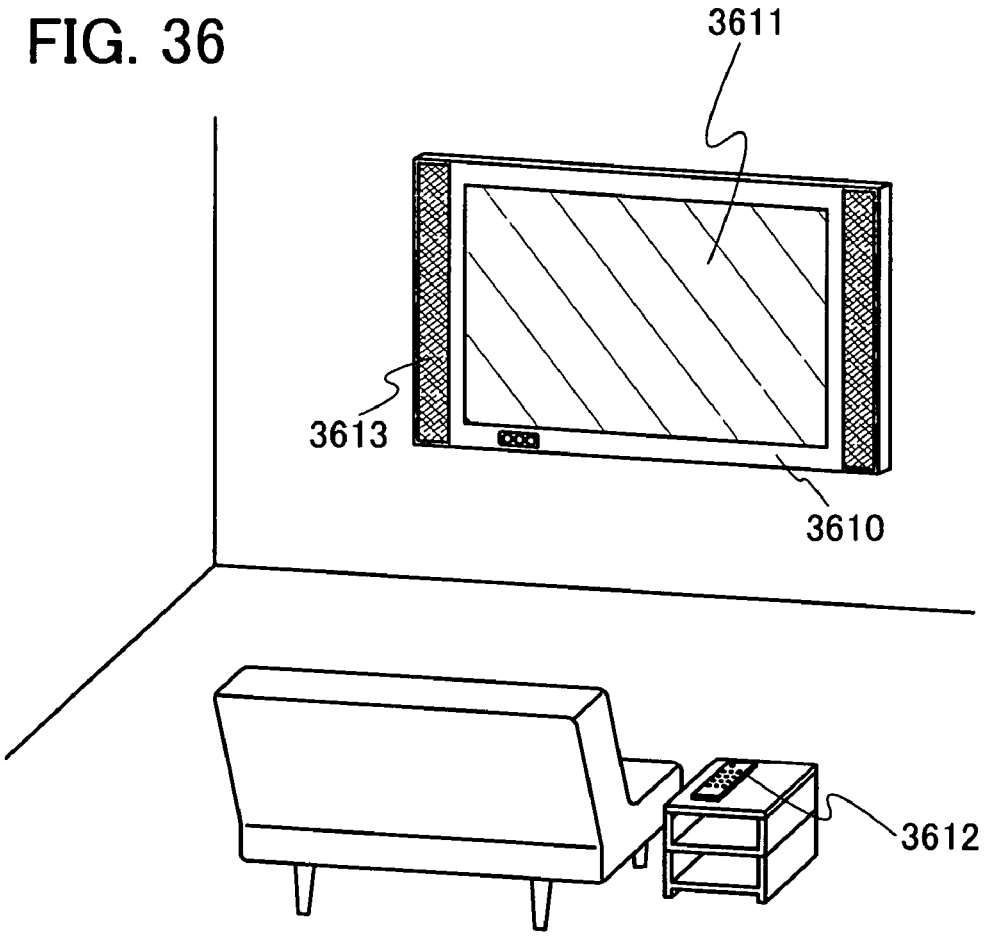
FIG. 36 is a view showing an application mode of a structure using a display device which can be applied to the invention.

FIG. 36 shows an example where a television set having a large display portion is provided in a building. FIG. 36 includes a housing 3610, a display portion 3611, a remote controlling device 3612 which is an operating portion, a speaker portion 3613, and the like. A display panel having the display device of the invention as a display portion is applied to the manufacture of the display portion 3611. The television set in FIG. 36 is incorporated in a building as a wall-mount type television set, and can be installed without requiring a large space.

Although this embodiment has illustrated a columnar telephone pole, a prefabricated bath unit, an interior side of a building, and the like as exemplary structures, this embodiment is not limited to these, and can be applied to any structures which can incorporate a display device. By employing a display panel having the display device of the invention, downsizing and low power consumption of a display panel can be achieved, as well as a moving object having a display medium with an excellent operation can be provided.

As a semiconductor device of the invention, a camera (e.g., a video camera, a digital camera, or the like), a goggle display, a navigation system, an audio reproducing device (e.g., a car audio, an audio component set, or the like), a computer, a game machine, a portable information terminal (e.g., a mobile computer, a mobile phone, a portable game machine, an electronic book, or the like), an image reproducing device provided with a recording medium (specifically, a device for reproducing a recording medium such as a digital versatile disc (DVD) and having a display for displaying the reproduced image), and the like can be given. FIGS. 38A to 38D and FIG. 37 show exemplary semiconductor devices.

Figure 38A:
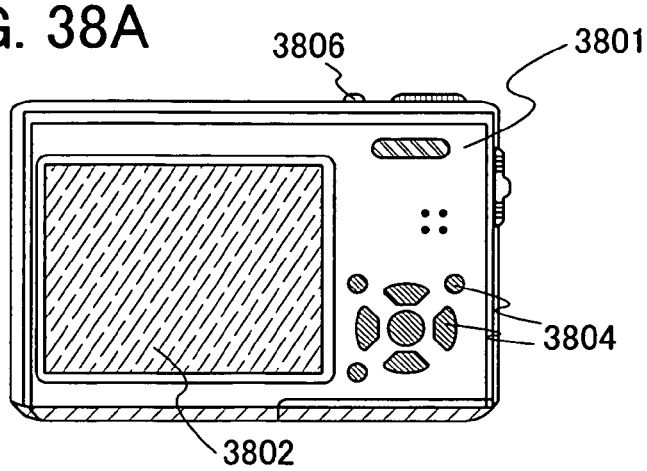
FIGS. 38A to 38D are views showing an electronic device using a display device which can be applied to the invention.

FIG. 38A shows a digital camera which includes a main body 3801, a display portion 3802, an imaging portion, operating keys 3804, a shutter 3806, and the like. Note that FIG. 38A is a view seen from the side of the display portion so that the imaging portion is not shown. By employing the invention, a digital camera with high reliability and low power consumption can be provided.

Figure 38B:
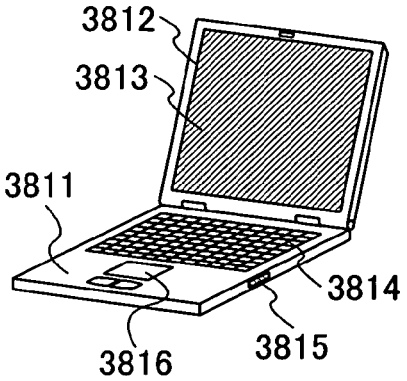

FIG. 38B shows a notebook personal computer which includes a main body 3811, a housing 3812, a display portion 3813, a keyboard 3814, an external connecting port 3815, a pointing device 3816, and the like. By employing the invention, a notebook personal computer with high reliability and low power consumption can be provided.

Figure 38C:
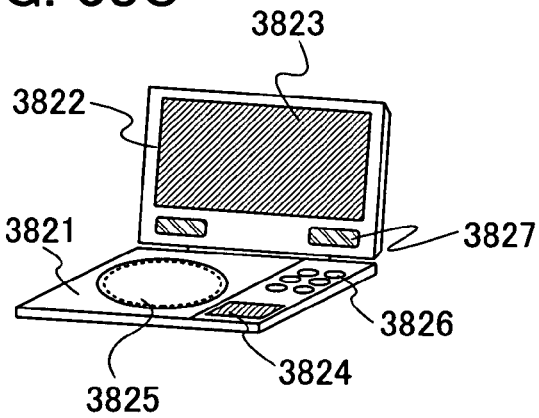

FIG. 38C shows a portable image reproducing device provided with a recording medium (e.g., a DVD player), which includes a main body 3821, a housing 3822, a display portion A3823, a display portion B3824, a recording medium (e.g., DVD) reading portion 3825, operating keys 3826, a speaker portion 3827, and the like. The display portion A3823 can mainly display image data, while the display portion B3824 can mainly display text data. Note that an image reproducing device provided with a recording medium includes a home game machine and the like. By employing the invention, an image reproducing device with high reliability and low power consumption can be provided.

Figure 38D:
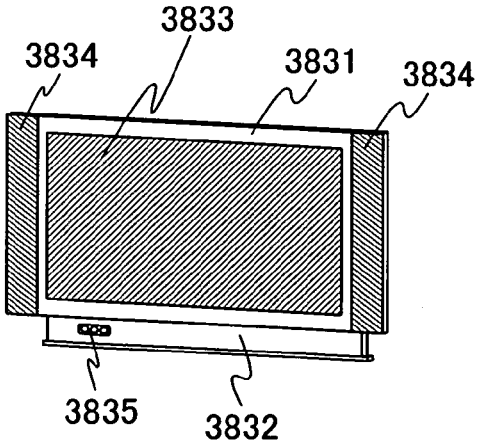

FIG. 38D shows a display device which includes a housing 3831, a supporting base 3832, a display portion 3833, a speaker 3834, video input terminals 3835, and the like. The display device can be manufactured by applying thin film transistors formed by the manufacturing method shown in the aforementioned embodiment modes to the display portion 3833 and driving circuits. Note that the display device includes all of information display devices such as those for personal computers, television broadcast reception, and advertisement display. By employing the invention, a large display device, particularly a device having a large screen size of 22 inches to 50 inches with high reliability and low power consumption can be provided.

Figure 37:
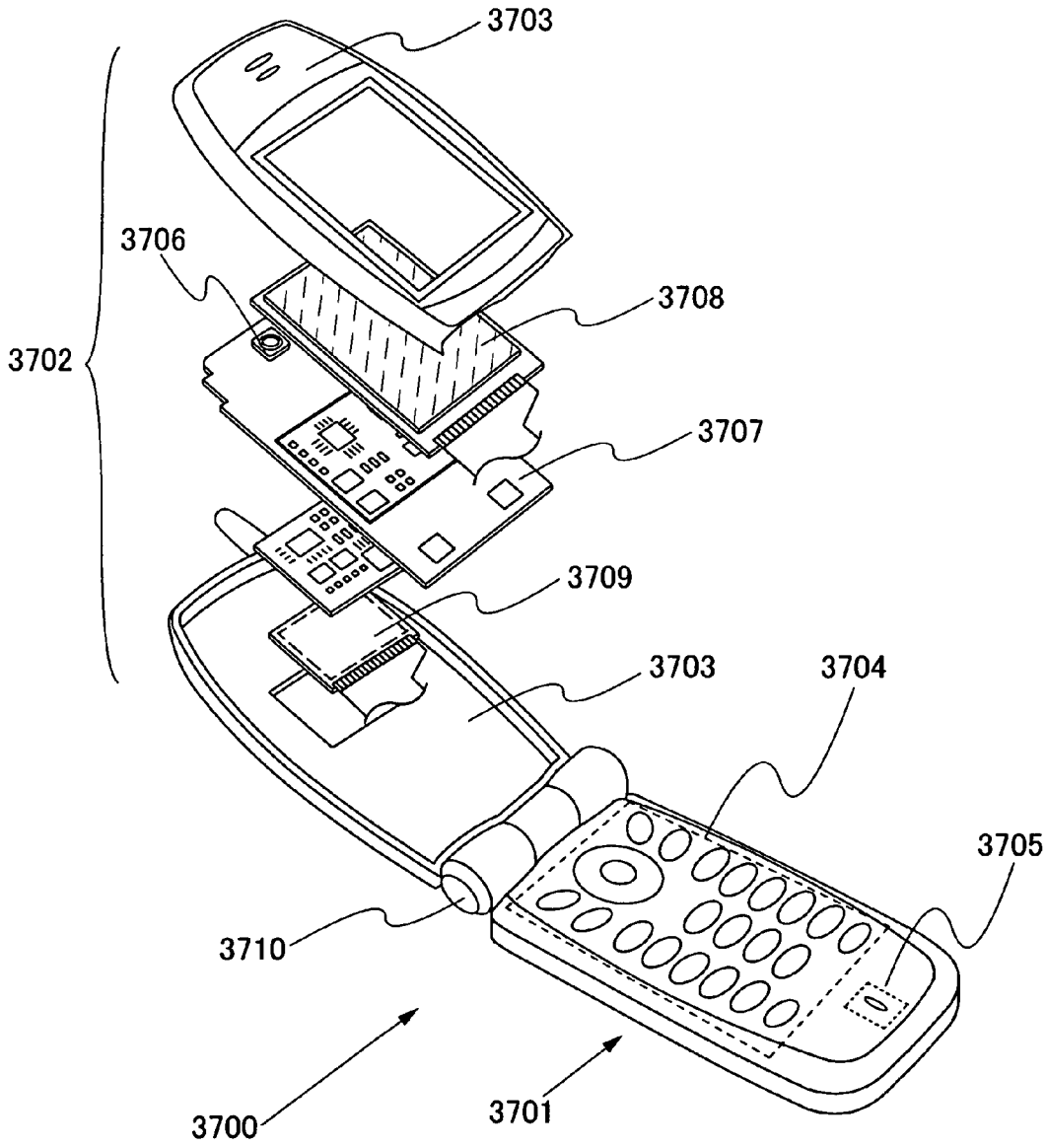
FIG. 37 is a view showing a mounting method for an electronic device using a display device which can be applied to the invention.

In addition, in a mobile phone shown in FIG. 37, a main body A3701 including operating keys 3704, a microphone 3705, and the like is connected to a main body B3702 including a display panel A3708, a display panel B3709, a speaker 3706, and the like with a hinge 3710 so that they can be opened and folded. The display panel A3708 and the display panel B3709 are incorporated into the housing 3703 with a circuit substrate 3707. The pixel portions of the display panel A3708 and the display panel B3709 are arranged such that they can be viewed from an opening window formed in the housing 3703.

The specification of the display panel A3708 and the display panel B3709 such as the number of pixels can be set in accordance with the functions of the mobile phone 3700. For example, the display panel A3708 and the display panel B3709 can be combined such that the display panel A3708 serves as a main screen while the display panel B3709 serves as a sub screen.

By employing the invention, a portable information terminal with high reliability and low power consumption can be provided.

A mobile phone of this embodiment mode can be changed into various modes in accordance with the functions and the uses. For example, a mobile phone with a camera may be provided by incorporating an imaging sensor into a portion of the hinge 3710. Alternatively, by employing a structure where the operating keys 3704, the display panel A3708, and the display panel B3709 are incorporated into one housing, the aforementioned operation-effect can be obtained. Further alternatively, by applying the configuration of this embodiment mode to a portable information terminal having a plurality of display portions, a similar effect can be obtained.

Note that this embodiment can be freely combined with the other embodiment modes or embodiments in this specification.

The present application is based on Japanese Priority application No. 2005-303767 filed on Oct. 18, 2005 with the Japanese Patent Office, the entire contents of which are hereby incorporated by reference.

What is claimed is:

1. A display device comprising:

a first electrode provided below an emitter;

a second electrode provided around the emitter;

a transistor receiving a signal from a data line; and a potential control circuit receiving the signal from the data line, wherein one of either a source or a drain of the transistor is connected to the first electrode;

wherein a first terminal of the potential control circuit is connected to the second electrode;

wherein a second terminal of the potential control circuit is connected to a gate of the transistor; and wherein a potential of the first electrode and a potential of the second electrode are controlled by the signal from the data line.

2. A display device comprising:

a first electrode provided below an emitter;

a second electrode provided around the emitter;

a first transistor receiving a signal from a data line; and a potential control circuit receiving the signal from the data line, wherein the potential control circuit comprises a second transistor and a resistor;

wherein one of terminals of the resistor is connected to the second electrode;

wherein the other terminal of the resistor is connected to one of either a source or a drain of the second transistor;

wherein a gate of the first transistor is connected to a gate of the second transistor;

wherein one of either a source or a drain of the first transistor is connected to the first electrode;

and wherein a potential of the first electrode and a potential of the second electrode are controlled by the signal from the data line.

3. A display device comprising a plurality of pixels each comprising a light-emitting element and a pixel circuit, wherein the light-emitting element comprises an extraction gate electrode, an anode electrode, and a fluorescent material;

wherein the pixel circuit comprises a potential control circuit and an active element;

wherein the extraction gate terminal has a function of applying an electric field to an electron-emissive element;

wherein the anode electrode has a function of accelerating an electron emitted from the electron-emissive element;

wherein the fluorescent material is formed to be connected directly or indirectly to the anode electrode;

wherein the potential control circuit has a function of controlling a potential of the extraction gate electrode in accordance with a signal input from a data line; and wherein the active element is connected to the light-emitting element in series to control a current flowing to the light-emitting element in accordance with the signal input from the data line.

4. A display device comprising a plurality of pixels comprising a light-emitting element and a pixel circuit, wherein the light-emitting element comprises an extraction gate electrode, an anode electrode, and a fluorescent material;

wherein the pixel circuit comprises a potential control circuit and an active element;

wherein the extraction gate electrode has a function of applying an electric field to an electron-emissive element;

wherein the anode electrode has a function of accelerating an electron emitted from the electron-emissive element;

wherein the fluorescent material is formed to be connected directly or indirectly to the anode electrode;

wherein the potential control circuit has a function of controlling a potential of the extraction gate electrode in accordance with a potential of a gate of the active element; and wherein the active element is connected to the light-emitting element in series to control a current flowing to the light-emitting element in accordance with the potential of the gate of the active element.

5. The display device according to claim 3, wherein the pixel circuit further includes a switching element for controlling supply of a signal to the gate electrode of the active element.

6. The display device according to claim 4, wherein the pixel circuit further includes a switching element for controlling supply of a signal to the gate electrode of the active element.

7. The display device according to claim 3, wherein the pixel circuit further includes a circuit including a switching element and a voltage holding element.

8. The display device according to claim 4, wherein the pixel circuit further includes a circuit including a switching element and a voltage holding element.

9. The display device according to claim 3, further comprising a cathode electrode which is electrically connected to the pixel circuit, wherein at least the active element is electrically connected between the cathode electrode and the electron-emissive element.

10. The display device according to claim 4, further comprising a cathode electrode which is electrically connected to the pixel circuit, wherein at least the active element is electrically connected between the cathode electrode and the electron-emissive element.

11. The display device according to claim 3,
wherein the active element is a transistor;
wherein the pixel circuit includes a transistor and a capacitor; and
wherein the potential control circuit includes a transistor and a resistor.

12. The display device according to claim 4,
wherein the active element is a transistor;
wherein the pixel circuit includes a transistor and a capacitor; and
wherein the potential control circuit includes a transistor and a resistor.

13. The display device according to claim 11, wherein the resistor includes a diode-connected transistor.

14. The display device according to claim 12, wherein the resistor includes a diode-connected transistor.

15. The display device according to claim 3, wherein the electron-emissive element is a Spindt-type electron-emissive element.

16. The display device according to claim 4, wherein the electron-emissive element is a Spindt-type electron-emissive element.

17. The display device according to claim 3, wherein the electron-emissive element is a carbon nanotube electron-emissive element.

18. The display device according to claim 4, wherein the electron-emissive element is a carbon nanotube electron-emissive element.

19. The display device according to claim 3, wherein the electron-emissive element is a surface-conduction electron-emissive element.

20. The display device according to claim 4, wherein the electron-emissive element is a surface-conduction electron-emissive element.

21. The display device according to claim 3, wherein the electron-emissive element is a hot-electron electron-emissive element.

22. The display device according to claim 4, wherein the electron-emissive element is a hot-electron electron-emissive element.

23. The display device according to claim 7, wherein all of transistors which are included in the circuit including the switching element and the voltage holding element have the same polarity.

24. The display device according to claim 8, wherein all of transistors which are included in the circuit including the switching element and the voltage holding element have the same polarity.

25. The display device according to claim 3, wherein all of transistors which are included in the potential control circuit have the same polarity.

26. The display device according to claim 4, wherein all of transistors which are included in the potential control circuit have the same polarity.

27. The display device according to claim 3, wherein the electron-emissive element is a surface-conduction electron-emissive element, and a plurality of surface-conduction electron-emissive elements are provided with respect to one pixel electrode.

28. The display device according to claim 4, wherein the electron-emissive element is a surface-conduction electron-emissive element, and a plurality of surface-conduction electron-emissive elements are provided with respect to one pixel electrode.

29. The display device according to claim 1, wherein the display device is used in electronic apparatus selected from the group consisting of a digital camera, a notebook personal computer, a portable image reproducing device and a mobile phone.

30. The display device according to claim 2, wherein the display device is used in electronic apparatus selected from the group consisting of a digital camera, a notebook personal computer, a portable image reproducing device and a mobile phone.

31. The display device according to claim 3, wherein the display device is used in electronic apparatus selected from the group consisting of a digital camera, a notebook personal computer, a portable image reproducing device and a mobile phone.

32. The display device according to claim 4, wherein the display device is used in electronic apparatus selected from the group consisting of a digital camera, a notebook personal computer, a portable image reproducing device and a mobile phone.

* * * * *